US009136053B2

(12) United States Patent
Daitoku et al.

(10) Patent No.: US 9,136,053 B2
(45) Date of Patent: Sep. 15, 2015

(54) SOLENOID DEVICE

(71) Applicants: ANDEN CO., LTD., Aichi-Pref. (JP); NIPPON SOKEN, INC., Aichi-Pref (JP)

(72) Inventors: Osamu Daitoku, Kariya (JP); Tomoaki Tanaka, Okazaki (JP); Ken Tanaka, Nukata-gun (JP); Tomoya Katoh, Nagoya (JP); Kiyonari Kojima, Miyoshi (JP)

(73) Assignees: ANDEN CO., LTD., Anjo (JP); NIPPON SOKEN, INC., Nishio (JP)

( * ) Notice: Subject to any disclaimer, the term of this patent is extended or adjusted under 35 U.S.C. 154(b) by 133 days.

(21) Appl. No.: 13/775,741

(22) Filed: Feb. 25, 2013

(65) Prior Publication Data

US 2013/0222089 A1 Aug. 29, 2013

(30) Foreign Application Priority Data

Feb. 29, 2012 (JP) ..... 2012-044055
Nov. 19, 2012 (JP) ..... 2012-253654

(51) Int. Cl.

| | |
|---|---|
| ***H01F 7/18*** | (2006.01) |
| ***H01F 7/08*** | (2006.01) |
| ***H01H 51/20*** | (2006.01) |
| ***H01H 50/16*** | (2006.01) |
| ***H01H 50/30*** | (2006.01) |
| ***H01H 50/40*** | (2006.01) |

(52) U.S. Cl.

CPC ..... *H01F 7/1877* (2013.01); *H01F 7/081* (2013.01); *H01H 50/163* (2013.01); *H01H 50/30* (2013.01); *H01H 50/40* (2013.01); *H01H 51/20* (2013.01)

(58) Field of Classification Search

CPC ..... H01F 7/1607; H01H 47/00; H01H 50/36
USPC ..... 335/259, 265, 119, 184, 232, 242, 267
See application file for complete search history.

(56) References Cited

U.S. PATENT DOCUMENTS

| | | | | | |
|---|---|---|---|---|---|
| 269,453 | A | * | 12/1882 | Parker | 314/109 |
| 634,912 | A | * | 10/1899 | Richardson et al. | 315/211 |
| 731,741 | A | * | 6/1903 | Baxter | 335/265 |

(Continued)

FOREIGN PATENT DOCUMENTS

| | | |
|---|---|---|
| JP | A-2005-222871 | 8/2005 |
| JP | A-2010-212035 | 9/2010 |

(Continued)

OTHER PUBLICATIONS

U.S. Appl. No. 13/751,201, filed Jan. 28, 2013, Daitoku et al.

*Primary Examiner* — Mohamad Musleh
(74) *Attorney, Agent, or Firm* — Posz Law Group, PLC

(57) ABSTRACT

A solenoid device includes: a first electromagnetic coil; first and second plungers movable according to energization to the first electromagnetic coil; first and second fixed cores facing the first and second plungers, respectively; and a yoke. When the first electromagnetic coil is not energized, first and second gaps are formed between the first and second plungers and the first and second fixed cores, respectively. When the first electromagnetic coil is energized, the magnetic flux flows in a first magnetic circuit, provided by the first plunger, the first fixed core and the yoke, via the first gap, and a second magnetic circuit, provided by the first and second plungers, the first and second fixed cores and the yoke, via the first and second gaps, so that the first and second plungers are attracted toward the first and second fixed cores.

14 Claims, 50 Drawing Sheets

(56) References Cited

U.S. PATENT DOCUMENTS

| | | | | | |
|---|---|---|---|---|---|
| 946,215 | A | * | 1/1910 | Geissinger | 361/154 |
| 2,138,275 | A | * | 11/1938 | Heinrich | 361/191 |
| 2,528,777 | A | * | 11/1950 | Persons | 361/194 |
| 2010/0207713 | A1 | * | 8/2010 | Sugisawa | 335/192 |

FOREIGN PATENT DOCUMENTS

| | | | |
|---|---|---|---|
| JP | A-2010-287455 | | 12/2010 |
| JP | 2013-164900 | A | 8/2013 |
| JP | 2013-182701 | A | 9/2013 |
| JP | 2013-182702 | A | 9/2013 |

* cited by examiner

SOLENOID DEVICE

CROSS REFERENCE TO RELATED APPLICATIONS

This application is based on Japanese Patent Applications No. 2012-44055 filed on Feb. 29, 2012, and No. 2012-253654 filed on Nov. 19, 2012, the disclosures of which are incorporated herein by reference.

TECHNICAL FIELD

The present disclosure relates to a solenoid device having an electromagnetic coil and a plurality of plungers.

BACKGROUND

A solenoid device having an electromagnetic coil which generates magnetic flux when current is passed, a plurality of plungers, and a fixed core made of soft magnetic material is known (refer to Japanese Unexamined Patent Application Publication No. 2005-222871).

The solenoid device is constructed to generate magnetic force by passing current to the electromagnetic coil so that the plungers are attracted by the fixed core. A spring member is disposed between the plungers and the fixed core. When passage of current to the electromagnetic coil is stopped, the magnetic force decreases, and the plungers are apart from the fixed core by the elastic force of the spring member. In such a manner, the plungers are moved forward/backward. By the forward/backward operation of the plungers, for example, the solenoid device is used for turning on/off a switch or opening/closing a valve.

There is a solenoid device in which a plurality of plungers is attracted in predetermined order. Such a solenoid device is used for, for example, a circuit which turns on a plurality of switches in predetermined order. The solenoid device is provided with a plurality of electromagnetic coils, and a plunger is disposed in the center of each of the electromagnetic coils. By passing current to each of the electromagnetic coils, the plurality of plungers is attracted separately. The order of attracting the plungers is controlled by a control circuit connected to the electromagnetic coils.

In the conventional solenoid device, however, the electromagnetic coils of the same number as that of the plungers are necessary to attract the plurality of plungers in order, so that the number of the electromagnetic coils increases. It causes a problem that the manufacture cost of the solenoid device tends to be high. Consequently, a solenoid device in which a plurality of plungers can be attracted in predetermined order and whose manufacture cost is low is demanded.

SUMMARY

It is an object of the present disclosure to provide a low-manufacture-cost solenoid device in which a plurality of plungers can be attracted in predetermined order.

According to an example aspect of the present disclosure, a solenoid device includes: a first electromagnetic coil for generating magnetic flux when current passes through the first electromagnetic coil; a first plunger and a second plunger, each of which moves backward and forward according to energization to the first electromagnetic coil; a first fixed core facing the first plunger in a backward-forward movement direction of the first plunger; a second fixed core facing the second plunger in a backward-forward movement direction of the second plunger; and a yoke. The yoke, the first plunger, the first fixed core, the second plunger, and the second fixed core provide a magnetic circuit, in which the magnetic flux flows. When the first electromagnetic coil is not energized in a unenergization state, a first gap is formed between the first plunger and the first fixed core, and a second gap is formed between the second plunger and the second fixed core. When the first electromagnetic coil is energized in a energization state, the magnetic flux flows in a first magnetic circuit, provided by the first plunger, the first fixed core and the yoke, and a second magnetic circuit, provided by the first plunger, the first fixed core, the second plunger, the second fixed core and the yoke. When the first electromagnetic coil is energized in the energization state, the first plunger is attracted toward the first fixed core by magnetic force, which is generated by a flow of the magnetic flux in the first magnetic circuit, and the second plunger is attracted toward the second fixed core by magnetic force, which is generated by a flow of the magnetic flux in the second magnetic circuit. While switching from the unenergization state to the energization state, the magnetic flux flowing in the first magnetic circuit passes through the first gap, and the magnetic flux flowing in the second magnetic circuit passes through the first gap and the second gap.

In the solenoid device, at the time of switching the first electromagnetic coil from the no-current passage state to the current passage state, the magnetic flux flowing in the first magnetic circuit passes through one gap (first gap), and the magnetic flux flowing in the second magnetic circuit passes two gaps (first and second gaps). Since the gaps are large magnetic resistance as compared with the yoke, the magnetic resistance of the first magnetic circuit having only one gap is low, and that of the second magnetic circuit having two gaps is high. Consequently, a large amount of the magnetic flux flows in the first magnetic circuit, and strong magnetic force for attracting the first plunger is generated. On the other hand, the amount of the magnetic flux flowing in the second magnetic circuit is small, and the magnetic force sufficient to attract the second plunger is not generated. Therefore, the first plunger is attracted before the second plunger.

When the first plunger is attracted and comes into contact with the first fixed core, the first gap disappears. Consequently, the magnetic resistance of the second magnetic circuit decreases, and the amount of the magnetic flux flowing in the second magnetic circuit increases. Therefore, the second plunger is attracted by the second fixed core.

As described above, the first plunger is attracted first and, then, the second plunger can be attracted.

Moreover, in the solenoid device, an electromagnetic coil dedicated to attract the second plunger does not have to be provided. Consequently, the manufacture cost of the solenoid device can be reduced, and the solenoid device can be miniaturized.

As described above, according to the present invention, the solenoid device in which a plurality of plungers can be attracted in predetermined order can be provided at low manufacture cost.

BRIEF DESCRIPTION OF THE DRAWINGS

The above and other objects, features and advantages of the present disclosure will become more apparent from the following detailed description made with reference to the accompanying drawings. In the drawings.

DETAILED DESCRIPTION

Figure 1:
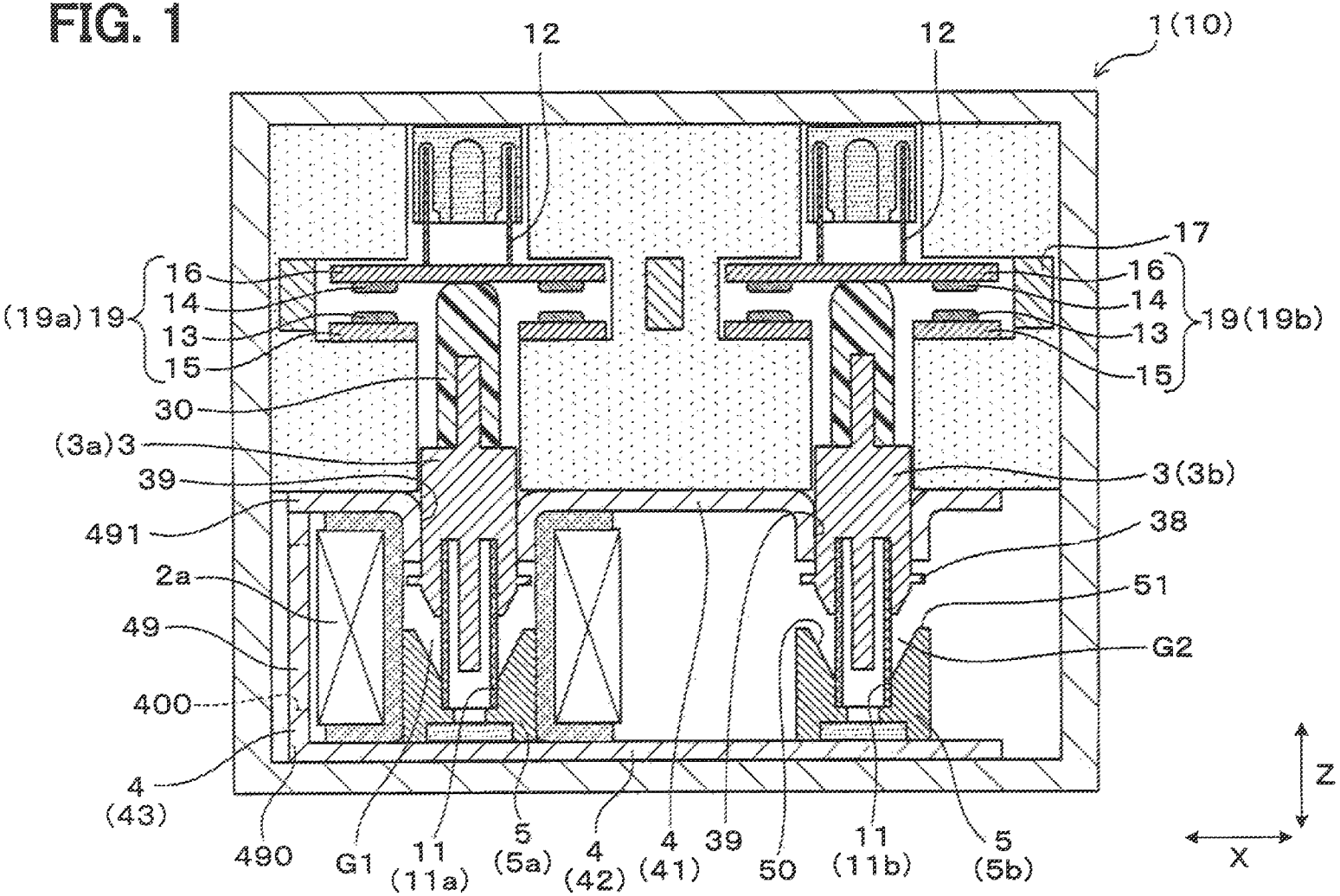
FIG. 1 is a diagram showing a cross section of an electromagnetic relay using a solenoid device, in a first embodiment.

The solenoid device can be used for, for example, an electromagnetic relay. For example, an electromagnetic relay is provided with two switches, one of the switches is turned on/off by a first plunger, and the other switch can be turned on/off by a second plunger.

A magnetic saturation part in which magnetic saturation locally occurs is formed in the yoke existing in the first magnetic circuit, and the amount of the magnetic flux flowing in the first magnetic circuit is regulated by the magnetic saturation part.

In this case, at the time of passing the magnetic flux, the two plungers can be attracted reliably. Specifically, if the amount of the magnetic flux flowing in the first magnetic circuit becomes too large when the first plunger is attracted, the amount of the magnetic flux flowing in the second magnetic circuit becomes small, and a problem occurs that the second plunger is not easily attracted. However, by forming the magnetic saturation part, the amount of the magnetic flux flowing in the first magnetic circuit can be regulated. Consequently, after the first plunger is attracted, the magnetic flux can be sufficiently passed also to the second magnetic circuit. Thus, both of the first and second plungers can be attracted reliably.

If the magnetic saturation part is not formed, magnetic saturation may occur in the first plunger and the first fixed core, and the amount of the magnetic flux flowing in the second magnetic circuit easily decreases. However, by forming the magnetic saturation part, magnetic saturation occurs in the magnetic saturation part before the first plunger and the first fixed core, so that such an inconvenience can be prevented.

The expression "occurrence of magnetic saturation" denotes that magnetic flux density enters a magnetic saturation region of a BH curve. The magnetic saturation region can be defined as a region in which the magnetic flux density is equal to or higher than 50% of the saturation magnetic flux density. The saturation magnetic flux density is magnetic flux density in a state where the magnetic field is applied to a magnetic member from the outside and the strength of magnetization does not increase even when the magnetic field is further applied from the outside.

The first electromagnetic coil has first and second coil parts to which current can be passed separately. The first coil part is disposed in a position closer to the first fixed core than the second coil part in a forward/backward movement direction of the first plunger. The yoke includes an intermediate yoke disposed between the first and second coil parts and a sliding-contact yoke provided in a position farther from the first fixed core than the intermediate yoke in the forward/backward movement direction of the first plunger and with which the first and second plungers come into slide-contact. When current is passed only to the first coil part as one of the first and second coil parts, the first plunger is attracted by the first fixed core by magnetic force generated by magnetic flux flowing in the intermediate yoke, the first plunger, and the first fixed core. When current is passed only to the second coil part as one of the first and second coil parts, the first plunger is attracted and moved apart from the first fixed core by the sliding-contact yoke by magnetic force generated by magnetic flux flowing in the intermediate yoke, the first plunger, and the sliding-contact yoke.

In this case, by passing current only to the first coil part in the first electromagnetic coil, the first plunger can be attracted by the first fixed core. By passing current only to the second coil part, the first plunger can be attracted by the slide-contact yoke. That is, the first plunger can be moved close to the first fixed core or apart from the first fixed core. Consequently, when the first plunger should not be attracted by the first fixed core, the first plunger can be forcedly moved apart from the first fixed core. Thus, the first plunger can be prevented from being erroneously attracted by the first fixed core.

In the first plunger, a flange whose diameter is enlarged in the radial direction is formed. In the no-current passage state, length from the flange to the sliding-contact yoke in the forward/backward movement direction of the first plunger is shorter than length from the intermediate yoke to the flange.

In this case, in the no-current passage state, the flange of the first plunger is in a position closer to the slide-contact yoke more than the intermediate yoke. Therefore, when current is passed only to the second coil part, strong magnetic force is generated between the flange and the slide-contact yoke. Consequently, the first plunger can be reliably attracted by the slide-contact yoke, and the first plunger can be prevented from being attracted by the intermediate yoke.

Each of the two plungers, the first and second plungers, is formed in a plate shape, the plungers move forward/backward in the plate thickness direction, and the plungers come into contact with/separate from the surface of the yoke in association with the forward/backward movement operation of the plungers.

In this case, the plunger does not come into slide-contact with the yoke even when it performs the forward/backward moving operation. Therefore, abrasion of the plungers can be suppressed. In the case where the plunger does not come into slide-contact with the yoke, to prevent abrasion of the plungers, in many cases, a thin film made of solid lubricant is formed on the surface. However, by preventing the plungers from coming into slide contact with the yoke as described above, it is unnecessary to form a thin film of solid lubricant. Thus, the manufacture cost of the plungers can be reduced.

A pillar-shaped core in which the first and second fixed cores are integrated is inserted in the center of the first electromagnetic coil, the first plunger is provided on one side in the axial direction of the pillar-shaped core with respect to the first electromagnetic coil, and the second plunger is provided on the other side in the axial direction with respect to the first electromagnetic coil.

In this case, since the first and second fixed cores are integrated, as compared with the case of forming the first and second fixed cores separately, the cores can be miniaturized. In addition, the number of components can be decreases, so that the manufacture cost of the solenoid device can be decreased.

In the no-current passage state, a third gap is formed between the first plunger and the yoke and a fourth gap is formed between the second plunger and the yoke. At the time of switch from the no-current passage state to the current passage state, the magnetic flux flowing in the first magnetic circuit passes through the first gap and the third gap, and the magnetic flux flowing in the second magnetic circuit passes through the first gap, the third gap, the fourth gap, and the second gap.

In this case, at the time of switch from the no-current passage state to the current passage state, the magnetic flux flowing in the second magnetic circuit has to pass through the four gaps of the first to fourth gaps, so that the force of attracting the second plunger becomes weak. Due to this, until the first plunger is attracted, the second plunger is not attracted. Therefore, the first plunger is attracted first and, then, the second plunger can be attracted with reliability.

The solenoid device further includes: a second electromagnetic coil which generates magnetic flux when current is passed to the coil; a third plunger which moves forward/backward when current is passed to the second electromagnetic coil; and a third fixed core disposed so as to be opposed to the third plunger in the forward/backward movement direction of the third plunger. The first and second plungers are attracted by passage of current to the first electromagnetic coil and, after that, by passing current to the second electromagnetic coil, the third plunger is attracted by the third fixed core.

In this case, two attraction states; a state where the first and second plungers are attracted by passing current to the first electromagnetic coil (first attraction state) and a state where the first to third plungers are attracted by, after the passage of current to the first electromagnetic coil, passing current also to the second electromagnetic coil (second attraction state) can be obtained by the passage of current/no current to the two electromagnetic coils.

By passing current to the first electromagnetic coil and, after that, passing current to the second electromagnetic coil, the magnetic flux generated by the passage of current to the second electromagnetic coil flows also in the second plunger.

By passing current to the second electromagnetic coil and, after that, stopping the passage of current to the first electromagnetic coil, attraction of only the first plunger is cancelled in a state where the second and third plungers are attracted by the magnetic flux of the second electromagnetic coil.

In this case, three attraction states, a state where only the second and third plungers are attracted (third attraction state) and the first and second attraction states, can be obtained by the passage of current/no current to the two electromagnetic coils.

For example, in the case of using the solenoid device for an electromagnetic relay, in a state where switches which are turned on/off by the second and third plungers are on, a switch which is turned on/off by the first plunger can be turned off. Consequently, in the case where sudden surge occurs, adhesion of the switch which is turned on/off by the first plunger can be suppressed.

In the case of passing current to the second electromagnetic coil before passage of current to the first electromagnetic coil, only the third plunger out of the first, second, and third plungers is attracted.

In this case, since only the third plunger can be attracted, for example, in the case of using the solenoid device for an electromagnetic relay, only a switch which is turned on/off by the third plunger can be turned on. In this state, for example, whether another switch is adhered or not can be determined.

The second plunger has a body to be attracted by the second fixed core, a diameter-reduced part which projects from the body to the side opposite to the second fixed core in the forward/backward movement direction, and a diameter-enlarged part which is formed in the diameter-reduced part and has a diameter larger than that of the diameter-reduced part. The body, the diameter-reduced part, and the diameter-enlarged part are made of soft magnetic material. The yoke has a first part with which the body of the second plunger comes into slide-contact and a second part which is apart from the first part and with which the third plunger comes into slide-contact. In an attraction state where the second plunger is attracted by the second fixed core, the diameter-enlarged part comes close to the second part and a gap between the second plunger and the second part becomes relatively small. In a no-attraction state where the second plunger is not attracted by the second fixed core, the diameter-enlarged part is apart from the second part and the diameter-reduced part moves close to the second part, so that the gap between the second plunger and the second part becomes wider than that in the attraction state.

In this case, the gap between the second plunger and the second part is wider than that in the attraction state, so that the magnetic resistance between the second plunger and the second part can be increased. Consequently, flow of the magnetic flux of the first electromagnetic coil to the second part is suppressed. Therefore, the magnetic flux of the first electromagnetic coil flows in the second plunger more easily, and the second plunger can be attracted by the stronger magnetic force.

In the attraction state, the gap between the second plunger and the second part is narrower than that in the no-attraction state. Consequently, the magnetic flux generated by the passage of current to the second electromagnetic coil flows in the second plunger more easily. Therefore, at the time of stopping the passage of current to the first electromagnetic coil, the second plunger can be attracted reliably by the magnetic flux of the second electromagnetic coil.

As described above, with the above configuration, the first and second plungers can be attracted reliably by the passage of current to the first electromagnetic coil. After that, by passing current to the second electromagnetic coil and stopping the passage of current to the first electromagnetic coil, only the second and third plungers can be reliably attracted.

With the configuration, in the case of passing current to the second electromagnetic coil before current is passed to the first electromagnetic coil, since the second plunger is in the no-attraction state, the magnetic resistance between the second part and the second plunger can be increased. It suppresses flow of the magnetic flux of the second electromagnetic coil to the second plunger. Therefore, without attracting the second plunger, only the third plunger can be attracted.

The second plunger has a body to be attracted by the second fixed core and a diameter-enlarged part whose diameter is larger than that of the body. The body and the diameter-enlarged part are made of soft magnetic material. The yoke has a first part with which the body of the second plunger and the first plunger come into slide-contact, a second part which is apart from the first part and with which the third plunger comes into slide-contact, a third part connected to the third fixed core, a fourth part connected to the second fixed core and the first fixed core, a fifth part connecting the first and third parts, and a sixth part connecting the second and third parts. A notch for suppressing flow of the magnetic flux between the third and fourth parts is formed between the third and fourth parts. In an attraction state where the second plunger is attracted by the second fixed core, the diameter-enlarged part conies close to the second part and shortest distance from the second plunger to the second part becomes relatively short, and in a no-attraction state where the second plunger is not attracted by the second fixed core, the diameter-enlarged part is apart from the second part, and the shortest distance from the second plunger to the second part becomes longer than that in the attraction state.

In this case, since the notch is formed between the third and fourth parts in the yoke, the magnetic flux does not easily flow between the third and fourth parts. Consequently, if current is passed to the first electromagnetic coil in a state where the second plunger is in the no-attraction state, it can suppress that the magnetic flux generated flows from the second plunger to the second part and, further, to the fourth part via the sixth part and the third part. Therefore, the magnetic flux of the first electromagnetic coil flows in the second plunger more easily, and the second plunger can be attracted by the strong magnetic force. By forming the notch, when current is passed to the second electromagnetic coil, flow of the magnetic flux generated by the passage of current between the third part and the fourth part is disturbed. Accordingly, the magnetic flux of the second electromagnetic coil does not easily flow in the first plunger, the first fixed core, the fourth part, and the third part. Therefore, when the passage of current to the first electromagnetic coil is stopped, the attraction of the first plunger can be smoothly cancelled.

The solenoid device is constructed so that the shortest distance from the second plunger to the second part in the attraction state is shorter than that in the no-attraction state. Consequently, in the attraction state, the magnetic resistance between the second plunger and the second part can be made low, so that the magnetic flux generated by the passage of current to the second electromagnetic coil flows more easily in the second plunger. Therefore, when the passage of current to the first electromagnetic coil is stopped, the second plunger can be reliably attracted by the magnetic flux of the second electromagnetic coil.

With the configuration, by passing current to the first electromagnetic coil, the first and second plungers can be attracted reliably. After that, by passing current to the second electromagnetic coil and stopping the passage of current to the first electromagnetic coil, only the second and third plungers can be attracted reliably.

Although the third and fourth parts are completely apart from each other in the "notch", the third and fourth parts may be magnetically slightly connected.

The center axis of one of the three plungers, the first, second, and third plungers, is in a direction different from the center axes of the other two plungers.

In this case, the solenoid device can be used also in a place where vibration easily occurs such as the inside of a vehicle. Specifically, when the three plungers are oriented in the same direction in a place where vibration easily occurs, there is a case that, due to vibration, the three plungers move in the same direction at the same time and, in the case of using the solenoid device for, for example, an electromagnetic relay, there is a case that three switches are turned on at the same time. However, by setting one of the three plungers in a direction different from the direction of the other two plungers, the three plungers can be prevented from being simultaneously moved in the same direction due to vibration. Therefore, also in the case of using the solenoid device for an electromagnetic relay, an inconvenience such that the three switches are simultaneously turned on can be prevented.

In at least one of the first, second, and third plungers, a flange which projects in the radial direction of the plunger is formed, and the magnetic flux passes through the flange.

In this case, the magnetic flux passes through the flange, so that the amount of the magnetic flux flowing in the plunger can be increased. Consequently, when current is passed to the first electromagnetic coil, the magnetic force generated in each of the plungers can be further enhanced, and the plunger can be attracted by stronger magnetic force. Since the contact area between the plunger and the fixed core increases, the fixed core and the plunger can be prevented from being magnetically saturated before the magnetic saturation part formed in the yoke.

First Embodiment

An embodiment of the solenoid device will be described with reference to FIGS. 1 to 6. As illustrated in FIG. 1, a solenoid device 1 of a first embodiment has a first electromagnetic coil 2*a*, a first plunger 3*a*, a second plunger 3*b*, a first fixed core 5*a*, a second fixed core 5*b*, and a yoke 4. When current is passed to the first electromagnetic coil 2*a*, a magnetic flux Φ is generated (refer to FIG. 3). Accompanying passage of current to the first electromagnetic coil 2*a*, the first and second plungers 3*a* and 3*b* move forward/backward. The first fixed core 5*a* is disposed so as to oppose to the first plunger 3*a* in the forward/backward movement direction of the first plunger 3*a*. The second fixed core 5*b* is disposed so as to oppose to second plunger 3*b* in the forward/backward movement direction of the second plunger 3*b*. A magnetic circuit in which the magnetic flux Φ flows is constructed by the yoke 4 together with the first plunger 3*a*, the first fixed core 5*a*, the second plunger 3*b*, and the second fixed core 5*b* (refer to FIG. 3).

The first plunger 3*a* is constructed to move forward/backward along the center axis of the turns on the inside of the first electromagnetic coil 2*a*. The second plunger 3*b* is disposed on the outside of the first electromagnetic coil 2*a*.

As illustrated in FIG. 1, in a no-current passage state in which no current is passed to the first electromagnetic coil 2*a*, a first gap G1 is formed between the first plunger 3*a* and the first fixed core 5*a*. A second gap G2 is formed between the second plunger 3*b* and the second fixed core 5*b*.

Figure 3:
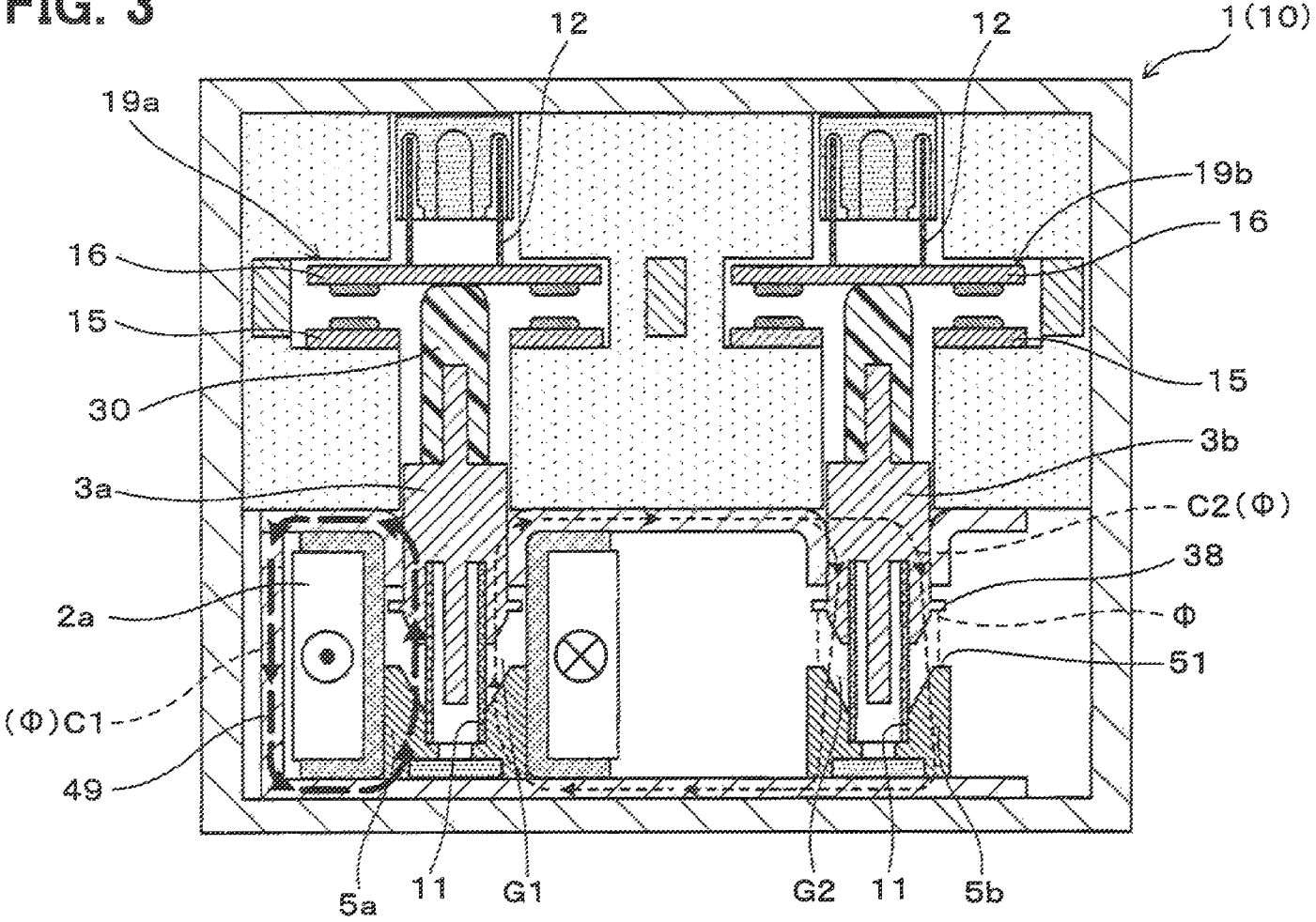
FIG. 3 is a diagram for explaining a path of magnetic flux in the case of passing current to a first electromagnetic coil and the order of attraction of plungers, in the first embodiment.
Figure 4:
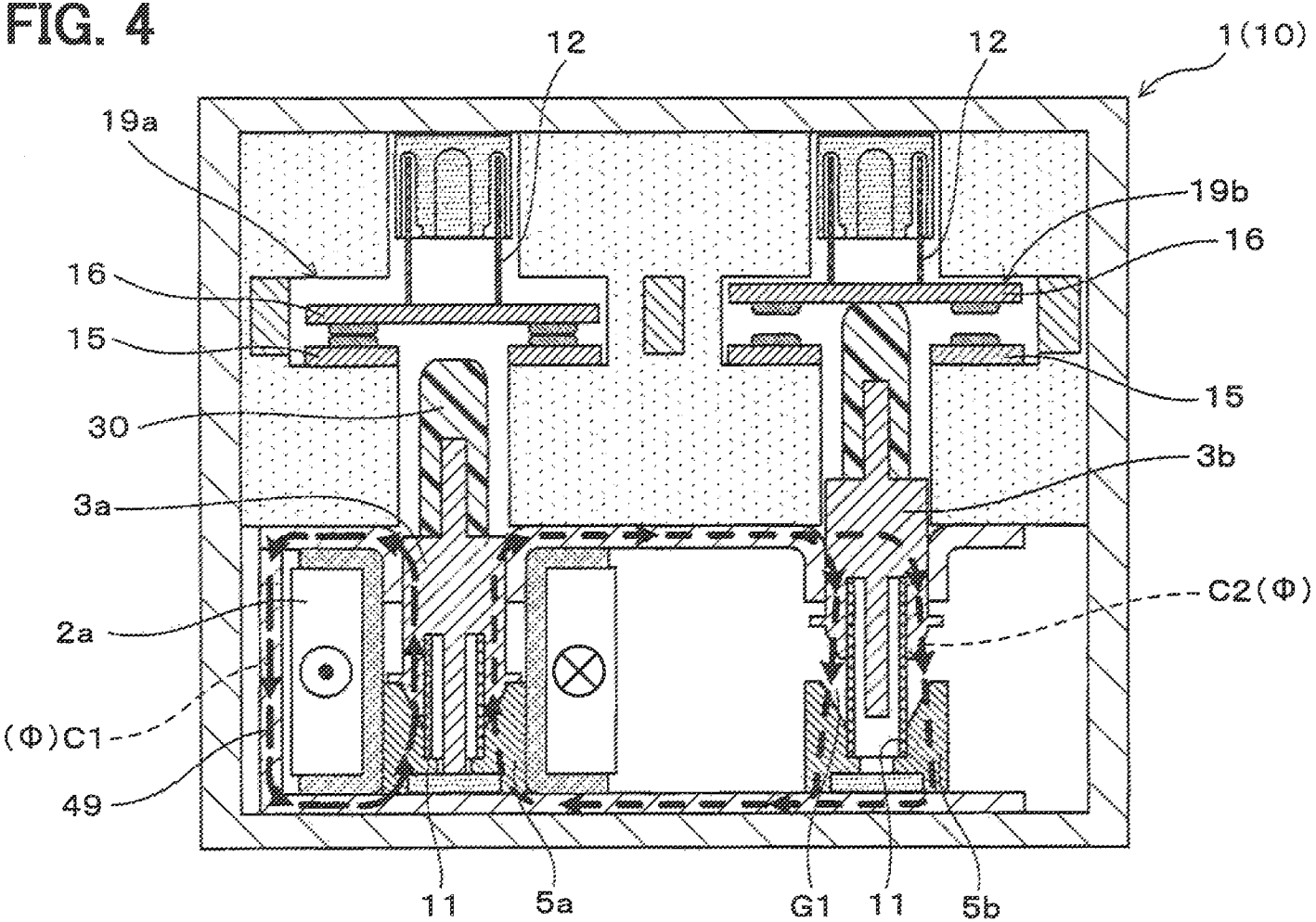
FIG. 4 is a diagram continued from FIG. 3.
Figure 5:
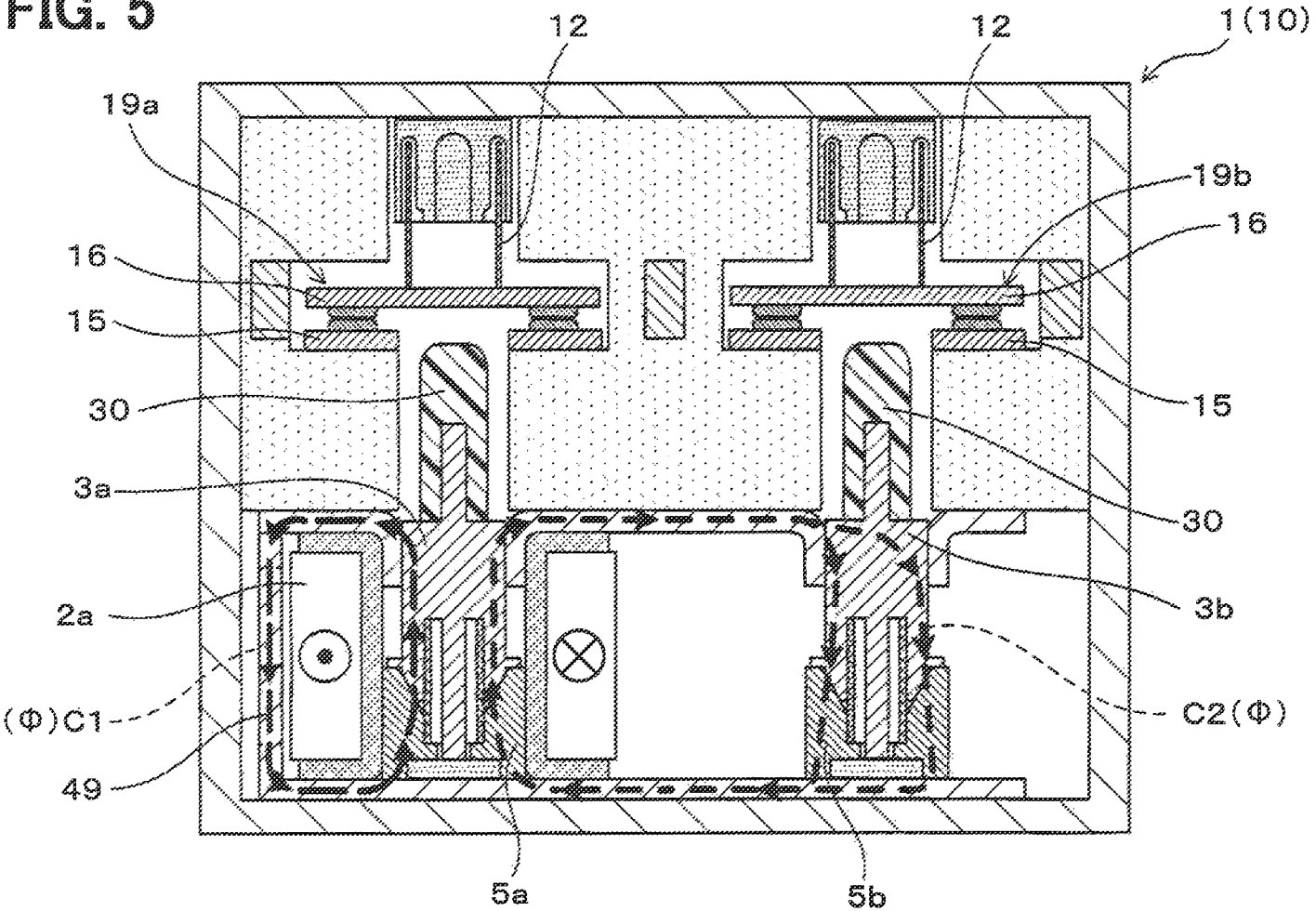
FIG. 5 is a diagram continued from FIG. 4.

As illustrated in FIGS. 3 to 5, in a current passage state in which current is passed to the first electromagnetic coil 2*a*, the magnetic flux Φ flows in first and second magnetic circuits C1 and C2. The first magnetic circuit C1 is a magnetic circuit in which the magnetic flux Φ passes through the first plunger 3*a*, the first fixed core 5*a*, and the yoke 4. The second magnetic circuit C2 is a magnetic circuit in which the magnetic flux Φ passes through the first plunger 3*a*, the first fixed core 5*a*, the second plunger 3*b*, the second fixed core 5*b*, and the yoke 4.

As illustrated in FIG. 5, by magnetic force generated by the flow of the magnetic flux Φ in the first magnetic circuit C1, the first plunger 3*a* is attracted by the first fixed core 5*a*. By magnetic force generated by the flow of the magnetic flux Φ in the second magnetic circuit C2, the second plunger 3*b* is attracted by the second fixed core 5*b*.

As illustrated in FIG. 3, when the no-current passage state is switched to a current passage state, the magnetic flux Φ flowing in the first magnetic circuit C1 passes through the first gap G1, and the magnetic flux Φ flowing in the second magnetic circuit C2 passes through both the first and second gaps G1 and G2.

The solenoid device 1 of the embodiment is used for an electromagnetic relay 10. In the electromagnetic relay 10, two switches 19*a* and 19*b* are formed. Each switch 19 has a fixed contact 13, a moving contact 14, a fixed-contact supporting part 15 made of metal and supporting the fixed contact 13, and a moving-contact supporting part 16 made of metal and supporting the moving contact 14. To the moving-contact supporting part 16, a contact-side spring member 12 is attached. The contact-side spring member 12 presses the moving-contact supporting part 16 toward the fixed-contact supporting part 15 side.

Between the plunger 3 and the fixed core 5, a core-side spring member 11 is provided. The core-side spring member 11 presses the plunger 3 toward the moving-contact supporting part 16 side. The spring constant of the core-side spring member 11 is larger than that of the contact-side spring member 12.

As illustrated in FIG. 1, in the plunger 3, a flange 38 projected in the radial direction of the plunger 3 is formed. In the fixed core 5, a recessed conical surface 50 with which the plunger 3 comes into contact and an end face 51 parallel to the flange 38 are formed. A part of the magnetic flux Φ generated by passage of current to the first electromagnetic coil 2*a* passes through the flange 38 and goes toward the end face 51 of the fixed core 5. With the configuration, the amount of the magnetic flux Φ flowing in the plunger 3 is increased.

As illustrated in FIG. 1, the yoke 4 includes a sliding contact yoke 41, a bottom yoke 42, and a side-wall yoke 43. In the sliding contact yoke 41, a through hole 39 through which the plunger 3 passes is formed. The bottom yoke 42 is provided on the side opposite to the sliding contact yoke 41 of the first electromagnetic coil 2*a* in the axial direction (Z direction) of the plunger 3. The side-wall yoke 43 is provided in a position connecting ends 490 and 491 on the first plunger 3*a* side of the sliding contact yoke 41 and the bottom yoke 42 in the arrangement direction (X direction) of the two plungers 3*a* and 3*b*.

Figure 2:
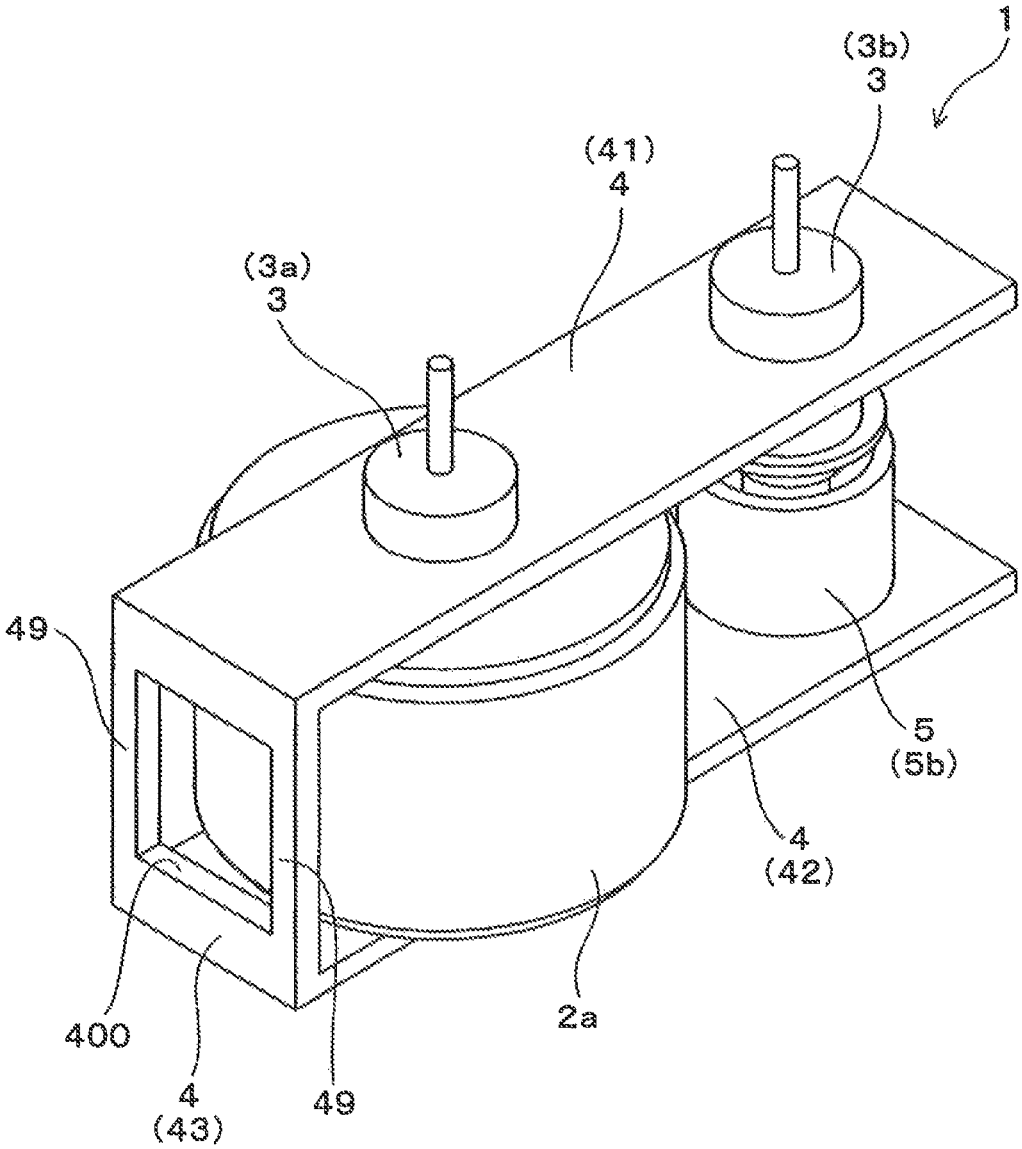
FIG. 2 is a diagram showing a perspective view of the solenoid device of FIG. 1.

As illustrated in FIG. 2, a through hole 400 is formed in the side-wall yoke 43. By forming the through hole 400, the sectional area of the side-wall yoke 43 is reduced to form a magnetic saturation part 49.

As illustrated in FIG. 3, at the time of switching the first plunger 3*a* from the no-current passage state to the current passage state (refer to FIG. 4), the magnetic flux Φ flowing in the first magnetic circuit C1 passes through the first gap G1.

The magnetic flux Φ flowing in the second magnetic circuit C2 passes through the first and second gaps G1 and G2. Since the first and second gaps G1 and G2 serve as magnetic resistors, the magnetic resistance of the first magnetic circuit C1 having only one gap is small, and the magnetic resistance of the second magnetic circuit C2 having two gaps is large. Consequently, the large amount of the magnetic flux Φ flows in the first magnetic circuit C1 and strong magnetic force which attracts the first plunger 3*a* is generated. On the other hand, the amount of the magnetic flux Φ flowing in the second magnetic circuit C2 is small, and magnetic force which sufficiently attracts the second plunger 3*b* is not generated. Therefore, as illustrated in FIG. 4, the first plunger 3*a* is attracted before the second plunger 3*b*.

As illustrated in FIG. 4, when the first plunger 3*a* is attracted by the first fixed core 5*a*, by the pressing force of the contact-side spring member 12, the moving-contact supporting part 16 is pressed toward against the fixed-contact supporting part 15 side. As a result, the first switch 19*a* is turned on.

As illustrated in FIG. 4, when the first plunger 3*a* comes into contact with the first fixed core 5*a*, the first gap G1 disappears. Consequently, the magnetic resistance of the second magnetic circuit C2 decreases, and the amount of the magnetic flux Φ flowing in the second magnetic circuit C2 increases. Accordingly, as illustrated in FIG. 5, the second plunger 3*b* is attracted by the second fixed core 5*b*.

As described above, in the embodiment, the magnetic saturation part 49 is formed in the yoke 4 (the side-wall yoke 43) as a component of the first magnetic circuit C1. When the first plunger 3*a* is attracted, the magnetic flux Φ is saturated in the magnetic saturation part 49. Therefore, the magnetic flux Φ can be sufficiently passed also to the second magnetic circuit C2.

When the second plunger 3*b* is attracted by the second fixed core 5*b*, by the pressing force of the contact-side spring member 12, the moving-contact supporting part 16 is pressed toward the fixed-contact supporting part 15 side. As a result, the second switch 19*b* is turned on.

After that, as illustrated in FIG. 1, when the first electromagnetic coil 2*a* is set to the no-current passage state, the magnetic flux Φ disappears and, by the pressing force of the core-side spring member 11, the plunger 3 is pressed toward the moving-contact supporting part 16 side. An insulating part 30 attached to the plunger 3 comes into contact with the moving-contact supporting part 16 and, against the pressing force of the contact-side spring member 12, the moving-contact supporting part 16 is made apart from the fixed-contact supporting part 15. As a result, the switches 19*a* and 19*b* are turned off.

Figure 6:
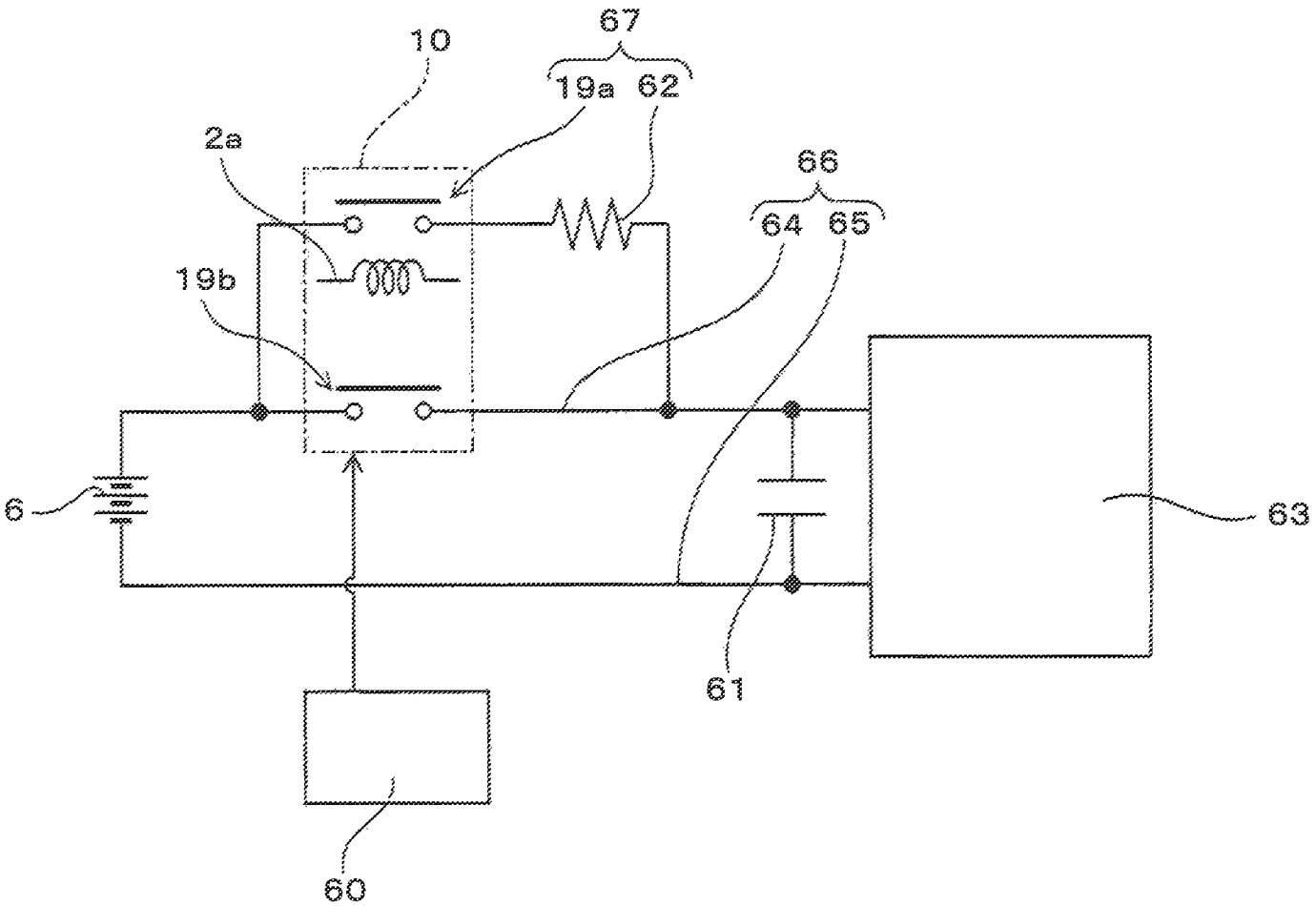
FIG. 6 is a diagram illustrating an example of a circuit using the electromagnetic relay in the first embodiment.

Next, a circuit using the electromagnetic relay 10 of the embodiment will be described. In the embodiment, as illustrated in FIG. 6, the electromagnetic relay 10 is provided for a power supply input part 66 connecting a DC power supply 6 and an electronic device 63. The power supply input part 66 has a positive-side line 64 connecting the positive electrode of the DC power supply 6 and the electronic device 63 and a negative-side line 65 connecting the negative electrode of the DC power supply 6 and the electronic device 63. Between the positive-side line 64 and the negative-side line 65, a smoothing capacitor 61 for smoothing DC voltage applied to the electronic device 63 is connected.

The positive-side line 64 is provided with the second switch 19*b*. A series member 67 in which a precharge resistor 62 and the first switch 19*a* are connected in, series is connected in parallel with the second switch 19*b*.

At the time of starting the electronic device 63, if the second switch 19*b* is turned on first, there is the possibility that inrush current flows in the smoothing capacitor 61 and the second switch 19*b* adheres. Consequently, the first switch 19*a* is turned on first, and current is gradually passed to the smoothing capacitor 61 via the precharge resistor 62. After charges are accumulated sufficiently in the smoothing capacitor 61, the second switch 19*b* is turned on.

As described above, the electromagnetic relay 10 of the embodiment can be suitably used for the circuit for a reason that when the first electromagnetic coil 2*a* is set to a current passage state, the first switch 19*a* is turned on first and, after that, the second switch 19*b* is turned on.

Although the first switch 19*a*, the precharge resistor 62, and the second switch 19*b* are provided for the positive-side line 64 in the embodiment, they may be provided for the negative-side line 65.

The operation and effect of the embodiment will be described. In the embodiment, as illustrated in FIG. 3, when the first electromagnetic coil 2*a* is switched from the no-current passage state to the current passage state, the magnetic flux Φ flowing in the first magnetic circuit C1 passes through one gap (first gap G1), and the magnetic flux Φ flowing in the second magnetic circuit C2 passes through two gaps (first and second gaps G1 and G2). Since those gaps become magnetic resistance larger than the yoke 4, the magnetic resistance of the first magnetic circuit C1 having only one gap is small, and the magnetic resistance of the second magnetic circuit C2 having two gaps is large. Consequently, the large amount of the magnetic flux Φ flows in the first magnetic circuit C1 and strong magnetic force which attracts the first plunger 3*a* is generated. On the other hand, the amount of the magnetic flux Φ flowing in the second magnetic circuit C2 is small, and magnetic force which sufficiently attracts the second plunger 3*b* is not generated. Therefore, as illustrated in FIG. 4, the first plunger 3*a* is attracted before the second plunger 3*b*.

When the first plunger 3*a* is attracted and comes into contact with the first fixed core 5*a*, the first gap G1 disappears. Consequently, the magnetic resistance of the second magnetic circuit C2 decreases, and the amount of the magnetic flux Φ flowing in the second magnetic circuit C2 increases. Accordingly, as illustrated in FIG. 5, the second plunger 3*b* is attracted.

In such a manner, the first plunger 3*a* can be attracted first and, after that, the second plunger 3*b* can be attracted.

The solenoid device 1 of the embodiment does not have to be provided with an electromagnetic coil dedicated to attract the second plunger 3*b*. Therefore, the manufacture cost of the solenoid device 1 can be reduced, and the solenoid device 1 can be miniaturized.

In the embodiment, the second gap G2 can be made larger than the first gap G1. In such a manner, time since the first plunger 3*a* is attracted until the second plunger 3*b* is attracted can be made longer. The spring constant of the plunger-side spring member 11*b* used for the second plunger 3*b* can be made larger than that of the plunger-side spring member 11*a* used for the first plunger 3*a*. Also in this case, time since first plunger 3*a* is attracted until the second plunger 3*b* is attracted can be made longer. The second plunger 3*b* can be made heavier than the first plunger 3*a*.

As illustrated in FIG. 2, in the yoke 4 (side-wall yoke 43) existing on the first magnetic circuit C1, the magnetic saturation part 49 in which magnetic saturation occurs locally. By the magnetic saturation part 49, the amount of the magnetic flux Φ flowing in the first magnetic circuit C1 is regulated.

In such a manner, when the magnetic flux Φ is passed, the two plungers 3*a* and 3*b* can be attracted reliably. Specifically, a problem occurs such that if the magnetic flux Φ flowing in the first magnetic circuit C1 becomes too large when the first plunger 3*a* is attracted, the magnetic flux Φ flowing in the second magnetic circuit C2 becomes small so that it becomes difficult to attract the second plunger 3*b*. However, by forming the magnetic saturation part 49 as described above, the amount of the magnetic flux Φ flowing in the first magnetic circuit C1 can be regulated. Consequently, after the first plunger 3*a* is attracted, the magnetic flux Φ can be sufficiently passed also to the second magnetic circuit C2. Thus, both the first and second plungers 3*a* and 3*b* can be attracted reliably.

As illustrated in FIG. 3, each plunger 3 has the flange 38 which projects in the radial direction of the plunger 3. The magnetic flux Φ generated by passage of current to the first electromagnetic coil 2*a* passes through the flange 38.

With such a configuration, the magnetic flux Φ passes through the flange 38, so that the amount of the magnetic flux Φ flowing in the plunger 3 can be increased. Consequently, when current is passed to the first electromagnetic coil 2*a*, the magnetic force generated in the plunger 3 can be further enhanced, and the plunger 3 can be attracted by stronger magnetic force. Since the contact area between the plunger 3 and the fixed core 5 increases, the fixed core 5 and the plunger 3 can be prevented from being magnetically saturated before the magnetic saturation part 49.

As described above, according to the embodiment, the solenoid device in which the plurality of plungers can be attracted in predetermined order can be provided at lower manufacture cost.

Although the magnetic saturation part 49 is formed by partly reducing the sectional area by forming the through hole 400 in the yoke 4 in the embodiment, the magnetic saturation part 49 may be formed by using a material which easily magnetically saturates for a part of the yoke 4.

Second Embodiment

Figure 7:
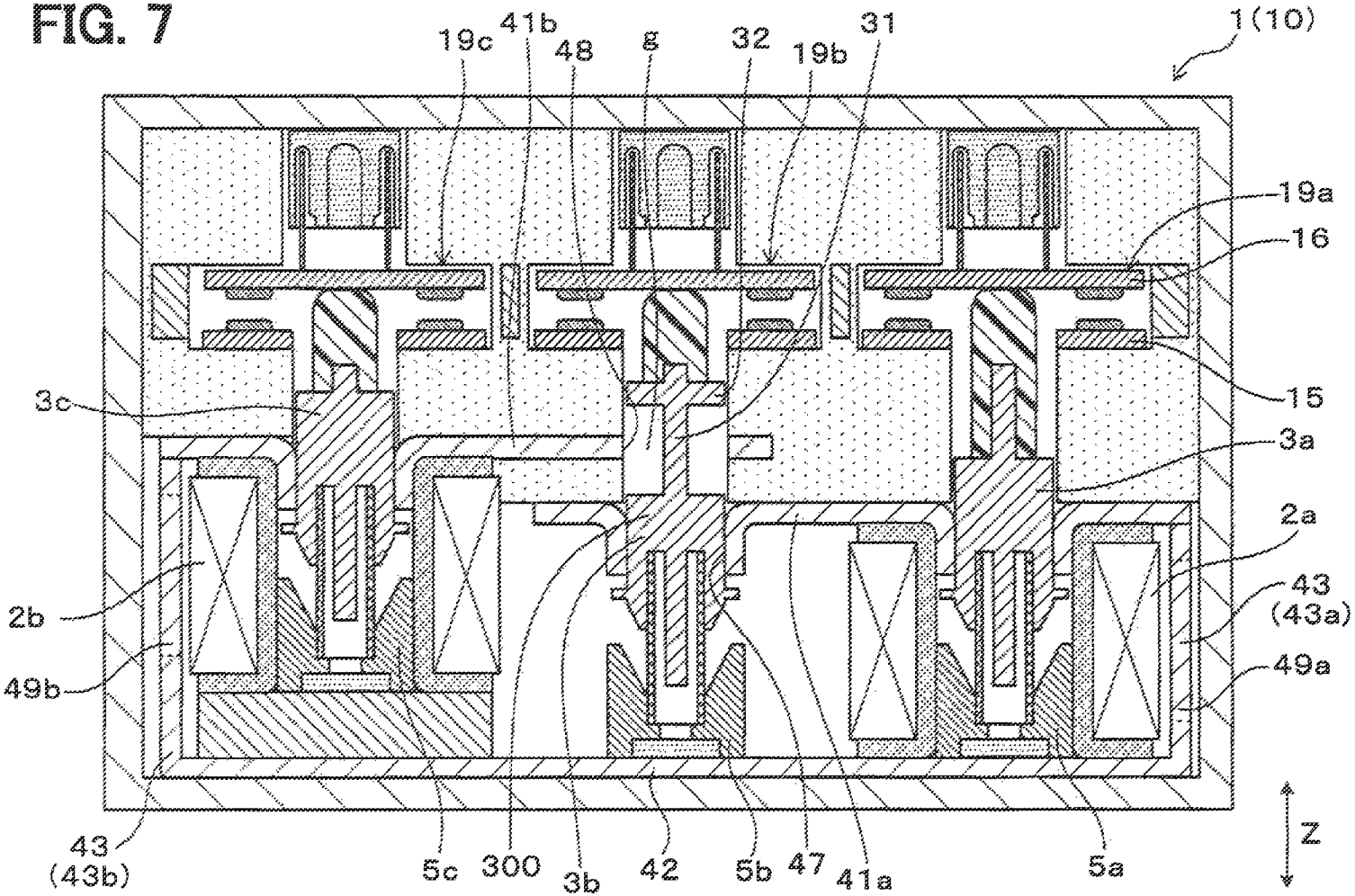
FIG. 7 is a diagram showing a cross section of an electromagnetic relay using a solenoid device, in a second embodiment.

In a second embodiment, the number of the plungers 3 and the number of the electromagnetic coils 2 are changed as illustrated in FIGS. 7 to 12. As illustrated in FIG. 7, the solenoid device 1 of the embodiment has three plungers 3 which are a first plunger 3*a*, a second plunger 3*b*, and a third plunger 3*c*. The solenoid device 1 has two electromagnetic coils 2 which are a first electromagnetic coil 2*a* and a second electromagnetic coil 2*b*. In a manner similar to the first embodiment, the first plunger 3*a* is disposed on the inside of the first electromagnetic coil 2*a*, and the second plunger 3*b* is disposed on the outside of the first electromagnetic coil 2*a*. In the embodiment, the third plunger 3*c* is disposed on the inside of the second electromagnetic coil 2*b*. In a position opposed to the third plunger 3*c* in the forward/backward movement directions (Z directions) of the third plunger 3*c*, a third fixed core 5*c* made of soft magnetic material is provided.

In the embodiment, as illustrated in FIG. 7, the second plunger 3*b* has a body 300 to be attracted by the second fixed core 5*b*, a diameter-reduced part 31, and a diameter-enlarged part 32. The diameter-reduced part 31 is projected from the body 300 to the side opposite to the second fixed core 5*b* in the Z direction. The diameter-enlarged part 32 is formed in the diameter-reduced part 31 and has a diameter larger than that of the diameter-reduced part 31. The body 300, the diameter-reduced part 31, and the diameter-enlarged part 32 are made of soft magnetic material.

Figure 11:
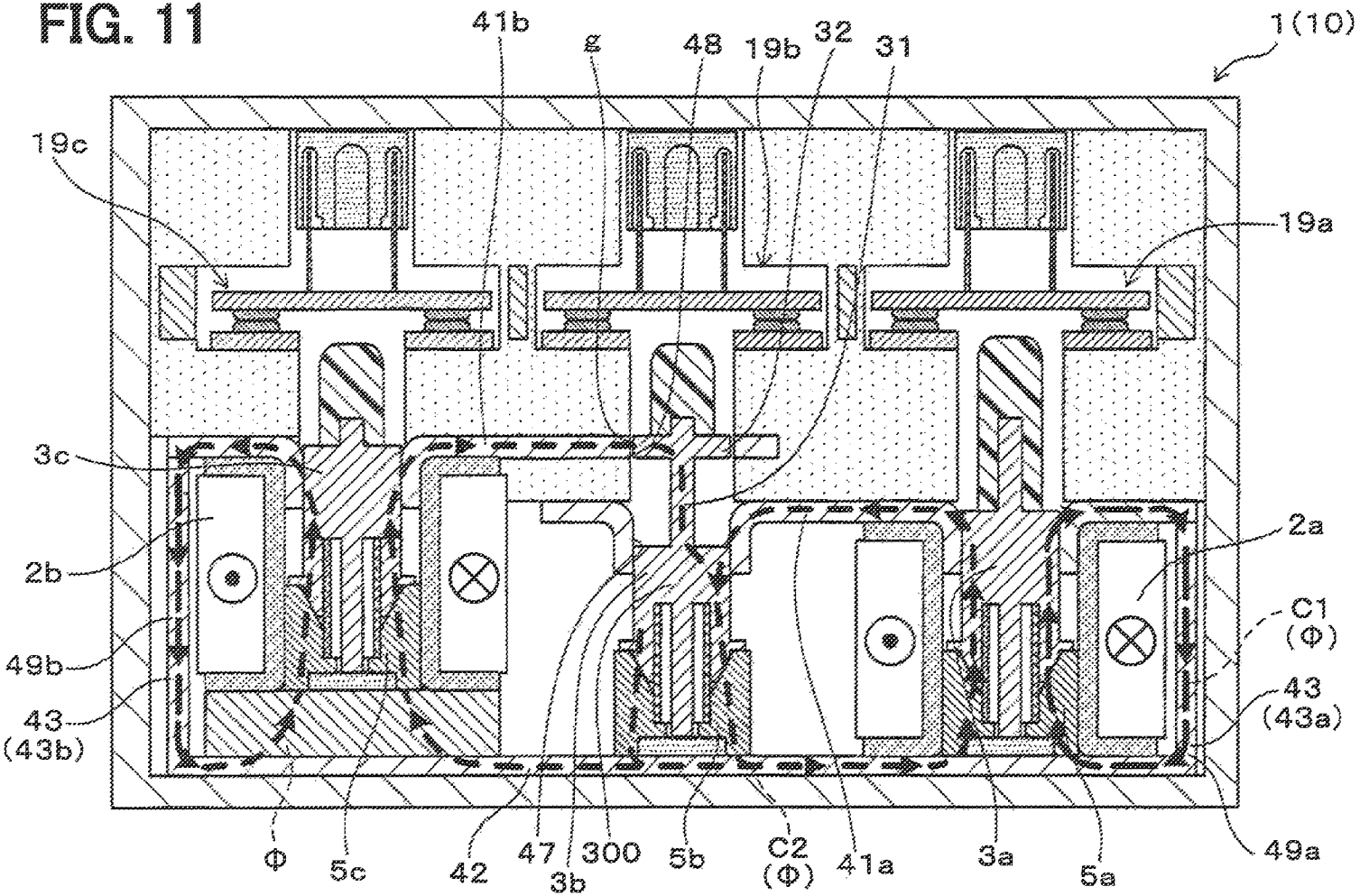
FIG. 11 is a diagram continued from FIG. 10.

The yoke 4 has a first part 41*a* along which the body 300 of the second plunger 3*b* slides and a second part 41*b* which is apart from the first part 41*a* and along which the third plunger 3*c* slides. As illustrated in FIG. 11, in an attraction state where the second plunger 3*b* is attracted by the second fixed core 5*b*, the diameter-enlarged part 32 comes close to the second part 41*b*, and a gap "g" between the second plunger 3*b* and the second part 41*b* becomes relatively small. As illustrated in FIG. 7, in a no-attraction state where the second plunger 3*b* is not attracted by the second fixed core 5*b*, the diameter-enlarged part 32 is apart from the second part 41*b* and the diameter-reduced part 31 moves close to the second part 41*b*. Consequently, the gap "g" between the second plunger 3*b* and the second part 41*b* becomes wider than that in the attraction state (refer to FIG. 11).

Each of the first and second parts 41*a* and 41*b* is formed in a plate shape. The first and second parts 41*a* and 41*b* are disposed at a predetermined interval in the Z direction so as to be partly overlapped. In the overlapped part, through holes 47 and 48 are formed in the first and second parts 41*a* and 41*b*, respectively. The second plunger 3*b* is inserted in the through holes 47 and 48. The body 300 of the second plunger 3*b* slides along the inner face of the through hole 47 in association with the forward/backward moving operations.

As illustrated in FIG. 7, in the no-attraction state, the diameter-reduced part 31 is positioned in the through hole 48 in the second part 41*b*. As illustrated in FIG. 11, in the attraction state, the diameter enlarged part 32 moves in the through hole 48 in the second part 41*b*.

Figure 8:
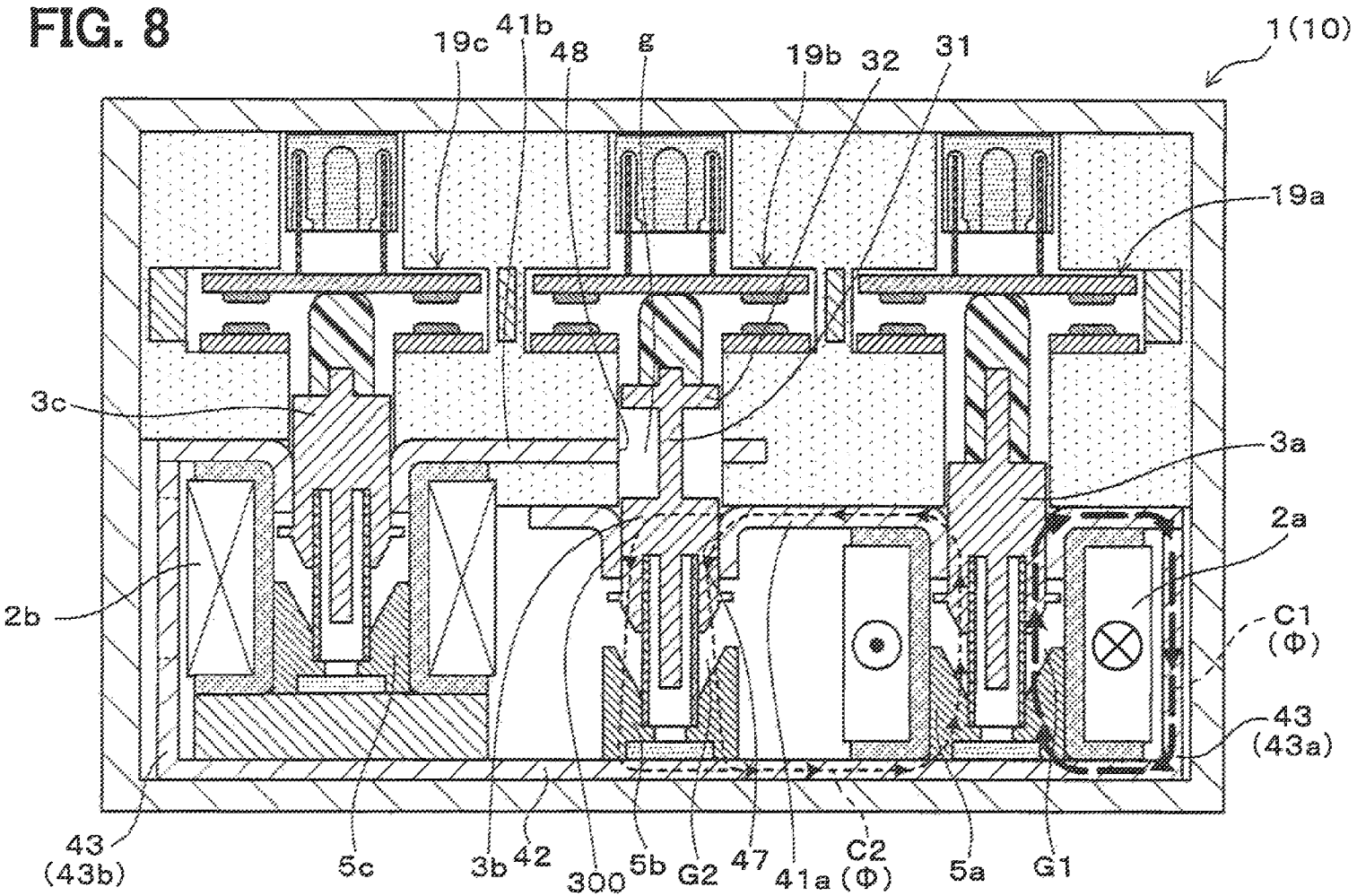
FIG. 8 is a diagram showing a diagram for explaining the order of operations of the electromagnetic relay and a path of magnetic flux in the second embodiment.

As illustrated in FIG. 8, when current is passed to the first electromagnetic coil 2*a*, the magnetic flux Φ flows separately in the first and second magnetic circuits C1 and C2. In a manner similar to the first embodiment, the first gap G1 is formed in the first magnetic circuit C1, and the two gaps, the first and second gaps G1 and G2, are formed in the second magnetic circuit C2. Consequently, the amount of the magnetic flux Φ flowing in the first magnetic circuit C1 is large, and the amount of the magnetic flux Φ flowing in the second magnetic circuit C2 is small. Therefore, as illustrated in FIG. 9, the first plunger 3*a* is attracted first, and the first switch 19*a* is turned on.

Figure 9:
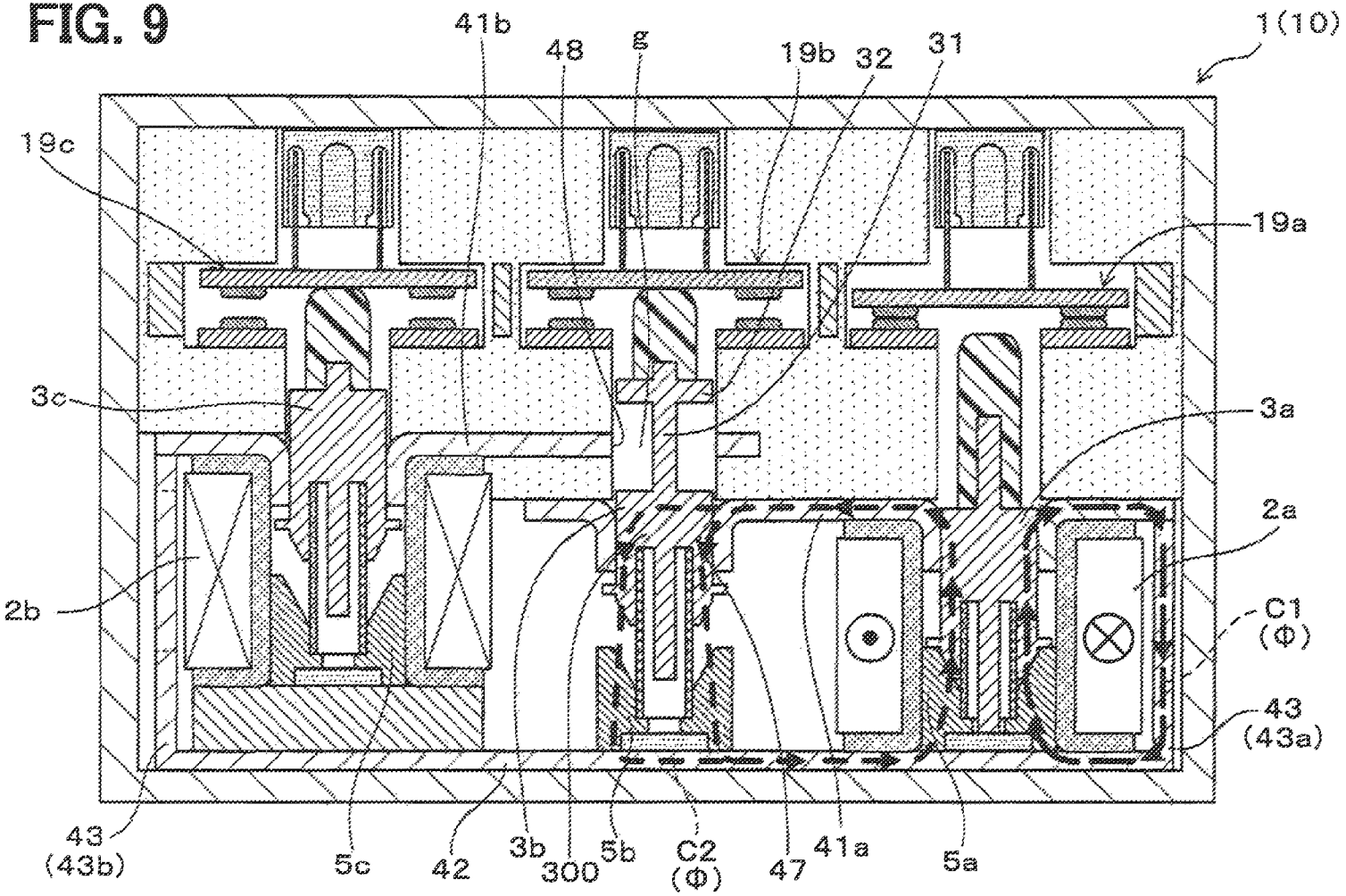
FIG. 9 is a diagram continued from FIG. 8.

As illustrated in FIG. 9, when the first plunger 3*a* is attracted, the first gap G1 disappears, so that the magnetic resistance of the second magnetic circuit C2 decreases. Consequently, the amount of the magnetic flux Φ flowing in the second magnetic circuit C2 increases. As described above, in a state where the second plunger 3*b* is not attracted (no-attraction state), the gap "g" between the second part 41*b* and the second plunger 3*b* is wide, so that the magnetic resistance between them is large. As a result, the magnetic flux Φ does not flow in the second part 41*b* so much but easily flows in the second plunger 3*b*.

Figure 10:
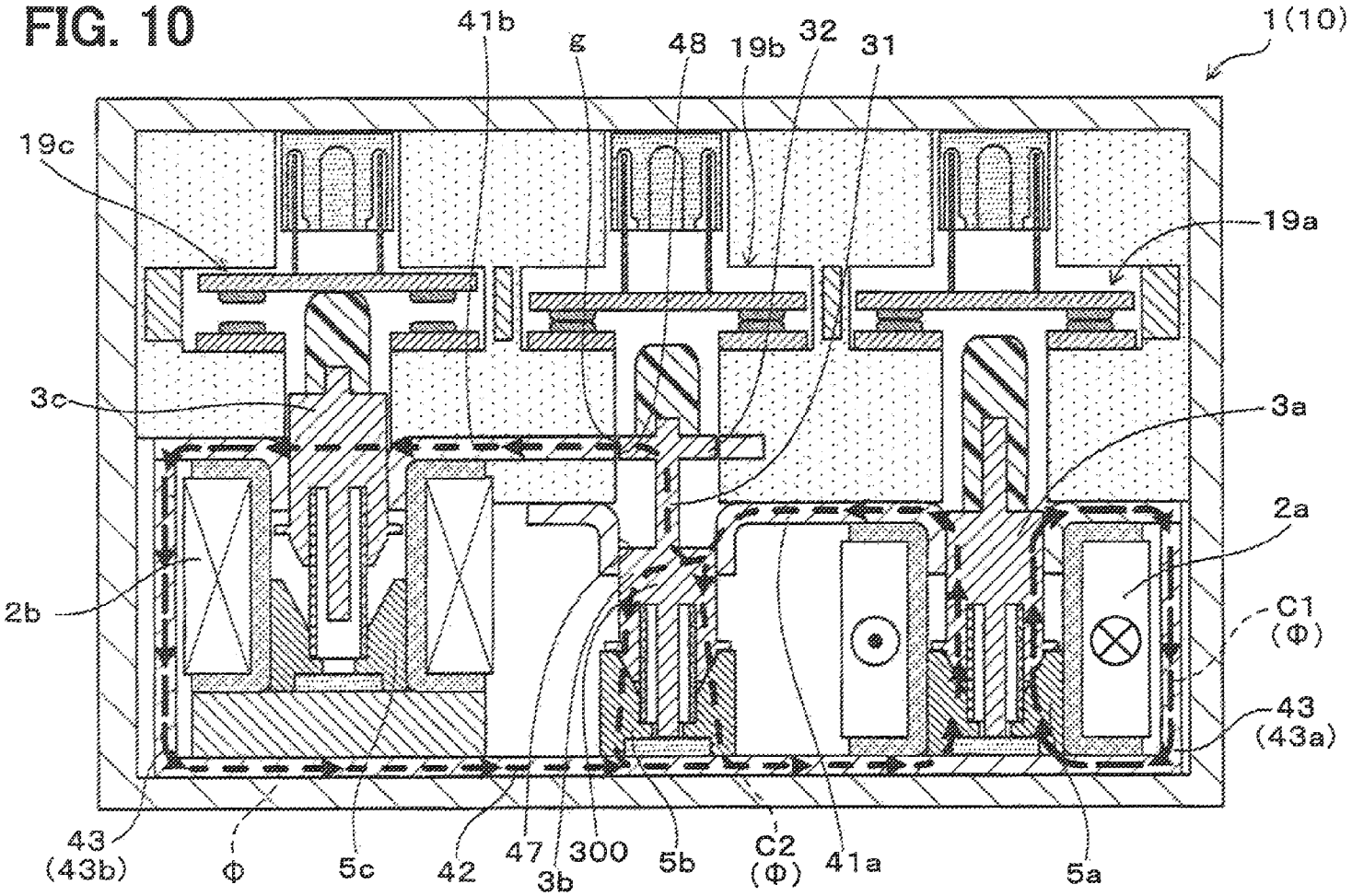
FIG. 10 is a diagram continued from FIG. 9.

As illustrated in FIG. 10, when the magnetic flux Φ flowing in the second magnetic circuit C2 increases, the second plunger 3*b* is attracted by the second fixed core 5*b* by the magnetic force. As a result, the second switch 19*b* is turned on.

After that, as illustrated in FIG. 11, current is passed to the second electromagnetic coil 2*b*, and the magnetic flux Φ is passed to the third plunger 3*c* and the third fixed core 5*c*. By the magnetic force generated by the operation, the third plunger 3*c* is attracted by the third fixed core 5*c*, and the third switch 19*c* is turned on.

As described above, in a state where the second plunger 3*b* is attracted (attraction state), the gap "g" between the second plunger 3*b* and the second part 41*b* is narrow, and the magnetic resistance between them is small. Consequently, magnetic flux Φ of the second electromagnetic coil 2*b* flows from the second part 41*b* to a diameter-enlarged part 48 (second plunger 3*b*) via the gap "g".

In the embodiment, as illustrated in FIG. 11, the directions of currents passed to the first and second electromagnetic coils 2*a* and 2*b* are determined so that the direction of the magnetic flux Φ generated by the first electromagnetic coil 2*a* and flowing to the second plunger 3*b* and that of the magnetic flux Φ generated by the second electromagnetic coil 2*b* and flowing to the second plunger 3*b* become the same for enhancement.

In the embodiment, two side-wall yokes 43 which are a first side-wall yoke 43*a* and a second side-wall yoke 43*b*, are provided. Magnetic saturation parts 49*a* and 49*b* are formed in the side-wall yokes 43*a* and 43*b*, respectively. A part of the magnetic flux Φ generated by the current passage to the second electromagnetic coil 2*b* flows in the magnetic saturation part 49*b* where magnetic saturation occurs. Therefore, the magnetic flux Φ can be efficiently passed to the second plunger 3*b*.

Figure 12:
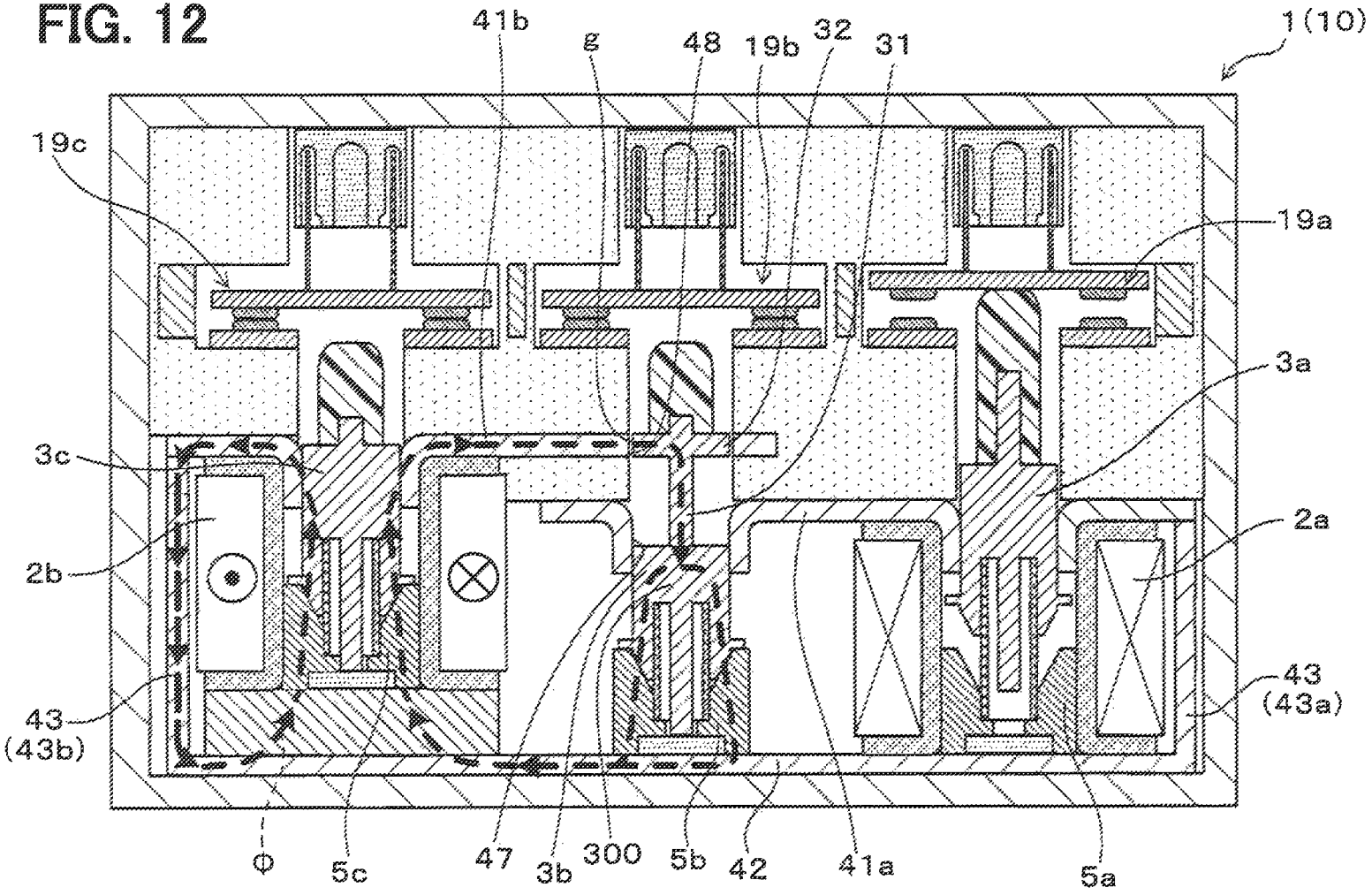
FIG. 12 is a diagram continued from FIG. 11.

After current is passed to the second electromagnetic coil 2*b*, as illustrated in FIG. 12, current passage to the first electromagnetic coil 2*a* is stopped. The magnetic flux Φ flowing in the first magnetic circuit C1 decreases, attraction of the first plunger 3*c* is cancelled, and the first switch 19*a* is turned off. Since the magnetic flux Φ generated by the passage of current to the second electromagnetic coil 2*b* flows in the second and third plungers 3*b* and 3*c*, even when the passage of current to the first electromagnetic coil 2*a* is stopped, the second and third plungers 3*b* and 3*c* are continuously attracted.

Figure 14:
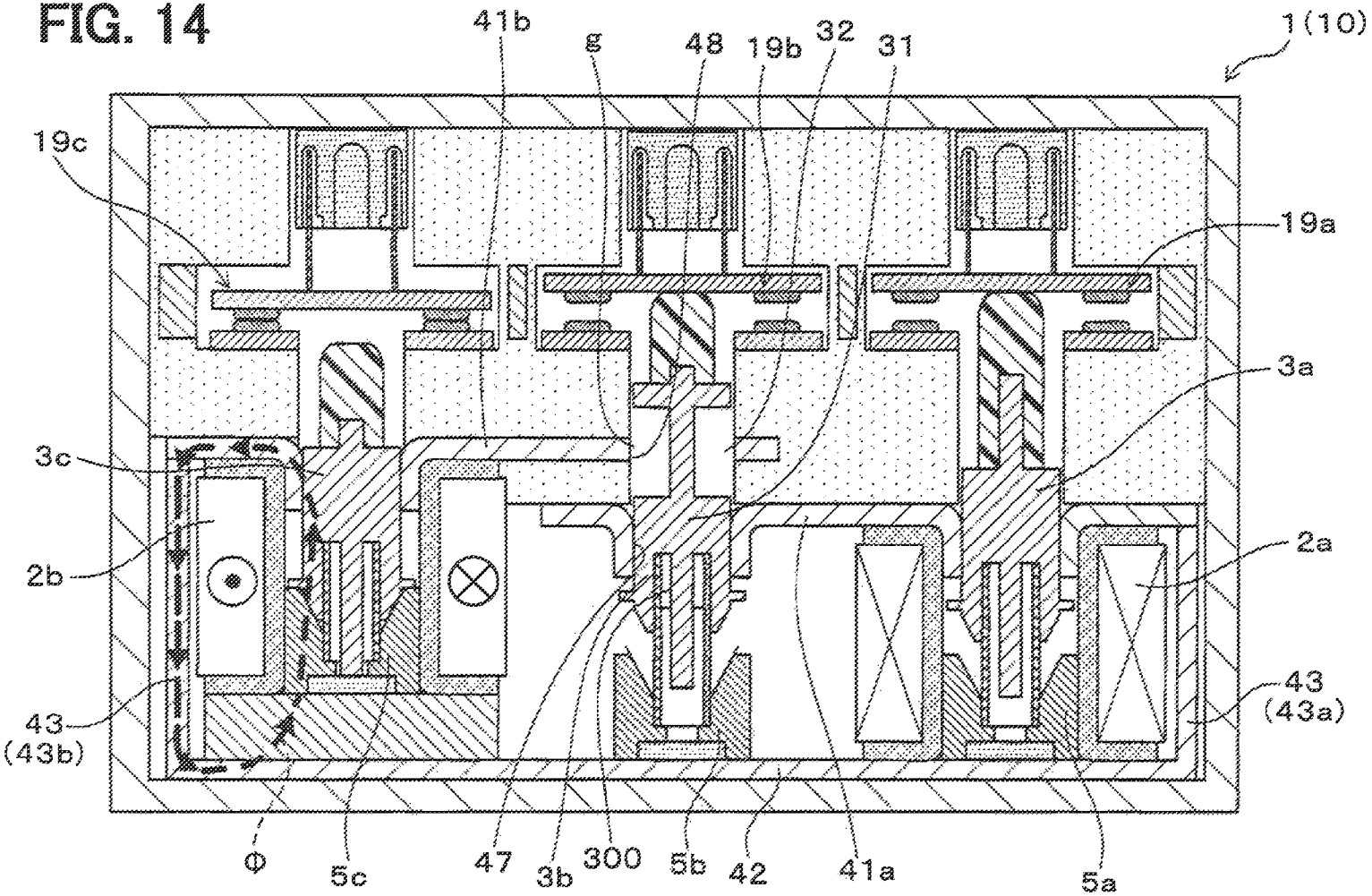
FIG. 14 is a diagram showing a cross section of the electromagnetic relay in the case of passing current to a second electromagnetic coil before current is passed to a first electromagnetic coil in the second embodiment.

On the other hand, as illustrated in FIG. 14, in the case where current is passed to the second electromagnetic coil 2*b* before current is passed to the first electromagnetic coil 2*a*, only the third plunger 3*c* is attracted. In a state where current is not passed to the first electromagnetic coil 2*a*, as illustrated in FIG. 7, the second plunger 3*b* is not attracted, and the magnetic resistance between the second plunger 3*b* and the second part 41*b* is large. Consequently, when current is passed to the second electromagnetic coil 2*b* in this state, as illustrated in FIG. 14, the magnetic flux Φ of the second electromagnetic coil 2*b* does not easily flow to the second plunger 3*b*, and the second plunger 3*b* is not attracted. Therefore, by the magnetic flux Φ of the second electromagnetic coil 2*b*, only the third plunger 3*c* is attracted. In the embodiment, as will be described later, in this state, whether the second switch 19*b* is adhered or not is determined.

Figure 13:
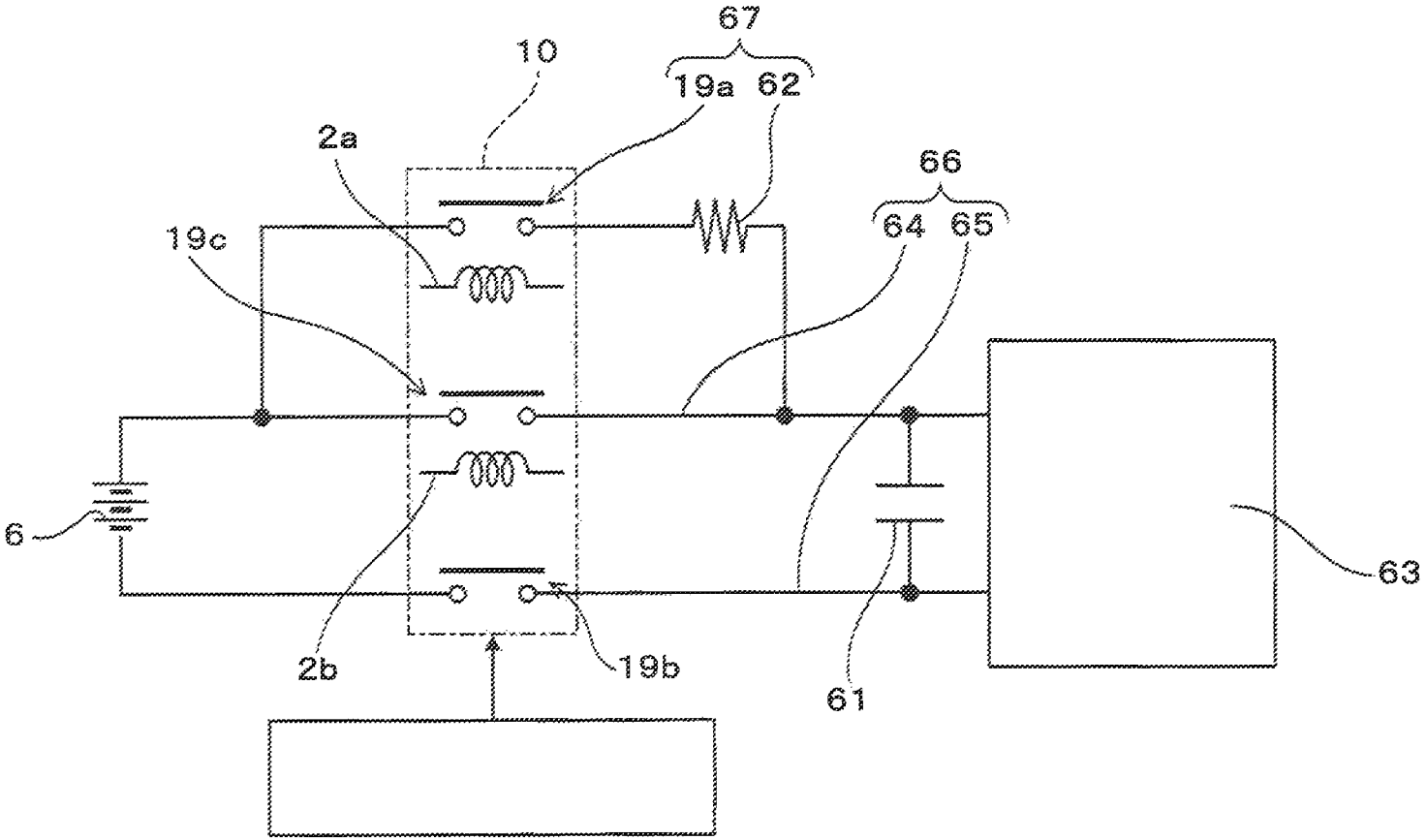
FIG. 13 is a diagram illustrating an example of a circuit using the electromagnetic relay in the second embodiment.

Next, a circuit using the electromagnetic relay 10 of the embodiment will be described. In the embodiment, as illustrated in FIG. 13, the electromagnetic relay 10 is provided for the power supply input part 66 connecting the DC power supply 6 and the electronic device 63. The power supply input part 66 has the positive-side line 64 connecting the positive electrode of the DC power supply 6 and the electronic device 63 and the negative-side line 65 connecting the negative electrode of the DC power supply 6 and the electronic device 63. Between the positive-side line 64 and the negative-side line 65, the smoothing capacitor 61 for smoothing DC voltage applied to the electronic device 63 is connected.

The positive-side line 64 is provided with a third switch 19*c*, and the negative-side line 65 is provided with the second switch 19*b*. The series member 67 in which the precharge resistor 62 and the first switch 19*a* are connected in series is connected in parallel with the third switch 19*c*.

In the embodiment, before the electronic device 63 is started, whether the second switch 19*b* is adhered or not is determined. At the time of performing the determination, first, current is passed to the second electromagnetic coil 2*b* in a state where no current is passed to the first electromagnetic coil 2*a* and only the third switch 19*c* is turned on (refer to FIG. 14). If the second switch 19*b* is adhered at this time, current flows in the capacitor 61, charges are accumulated, and the voltage of the capacitor 61 rises. Consequently, by attaching a voltage sensor to the capacitor 61 and measuring the voltage of the capacitor 61, whether the second switch 19*b* is adhered or not can be determined. Only in the case where it is determined that the second switch 19*b* is not adhered, the electronic device is started.

At the time of starting the electromagnetic device 63, by passing current to the first electromagnetic coil 2*a*, the first and second switches 19*a* and 19*b* are turned on. Current is gradually passed to the smoothing capacitor 61 via the precharge resistor 62. After charges are accumulated sufficiently in the smoothing capacitor 61, current is passed to the second switch 19*b*, and the third switch 19*c* is turned on.

After that, current passage to the first electromagnetic coil 2*a* is stopped, and the first switch 19*a* is turned off. In a state where only the second and third switches 19*b* and 19*c* are turned on, power is supplied to the electronic device 63.

The operation and effect of the embodiment will be described. In the embodiment, as illustrated in FIG. 11, current is passed to the first electromagnetic coil 2*a* to attract the first and second plungers 3*a* and 3*b*. After that, current is passed to the second electromagnetic coil 2*b* to attract the third plunger 3*c*.

In such a manner, two attraction states; the state where the first and second plungers 3*a* and 3*b* are attracted (first attraction state, refer to FIG. 10) and the state where the first to third plungers 3*a* to 3*c* are attracted (second attraction state, refer to FIG. 11) can be obtained by the passage of current/no current to the two electromagnetic coils.

In the embodiment, as illustrated in FIG. 11, by passing current to the first electromagnetic coil 2*a* and, after that, passing current to the second electromagnetic coil 2*b*, the magnetic flux Φ generated by the passage of current to the second electromagnetic coil 2*b* flows also in the second plunger 3*b*. By passing current to the second electromagnetic coil 2*b* and, after that, stopping the passage of current to the first electromagnetic coil 2*a* as illustrated in FIG. 12, attraction of only the first plunger 3*a* is cancelled in a state where the second and third plungers 3*b* and 3*c* are attracted by the magnetic flux Φ of the second electromagnetic coil 2*b*.

In such a manner, three attraction states, a state where only the second and third plungers 3*b* and 3*c* are attracted (third attraction state, refer to FIG. 12) and the first and second attraction states, can be obtained by the passage of current/no current to the two electromagnetic coils 2*a* and 2*b*.

Consequently, in a state where the second and third switches 19*b* and 19*c* are on, the first switch 19*a* can be turned off. In the case where sudden surge occurs when power is supplied to the electronic device 63, adhesion of the first switch 19*a* can be suppressed.

In the embodiment, in the case where current is passed to the second electromagnetic coil 2*b* before current is passed to the first electromagnetic coil 2*a*, only the third plungers 3*c* is attracted in the first to third plungers 3*a* to 3*c* (refer to FIG. 14).

With the configuration, only the third plunger 3*c* can be attracted, so that only the third switch 19*c* can be turned on. Consequently, whether another switch (second switch 19*b*) is adhered or not can be determined.

In the embodiment, the gap "g" between the second plunger 3*b* and the second part 41*b* in the no-attraction state (refer to FIG. 7) is wider than that in the attraction state (refer to FIG. 11).

With the configuration, in the no-attraction state, the magnetic resistance between the second plunger 3*b* and the second part 41*b* can be made large in the no-attraction state. Consequently, in the no-attraction state, the magnetic flux Φ of the first electromagnetic coil 2*a* does not easily flow in the second part 41*b*. Therefore, the magnetic flux Φ of the first electromagnetic coil 2*a* flows in the second plunger 3*b* more easily, and the second plunger 3*b* can be attracted with stronger magnetic force.

In the embodiment, in the attraction state (refer to FIG. 11), the gap "g" between the second plunger 3*b* and the second part 41*b* is narrower than that in the no-attraction state (refer to FIG. 7).

With the configuration, the magnetic resistance between the second plunger 3*b* and the second part 41*b* can be decreased. Consequently, the magnetic flux Φ generated by the passage of current to the second electromagnetic coil 2*b* flows in the second plunger 3*b* more easily. Therefore, as illustrated in FIG. 12, when the passage of current to the first electromagnetic coil 2*a* is stopped, the second plunger 3*b* can be attracted reliably by the magnetic flux Φ of the second electromagnetic coil 2*b*.

As described above, in the embodiment, the first and second plungers 3*a* and 3*b* can be attracted reliably by the passage of current to the first electromagnetic coil 2*a*. After that, by passing current to the second electromagnetic coil 2*b* and stopping the passage of current to the first electromagnetic coil 2*a* (refer to FIG. 12), only the second and third plungers 3*b* and 3*c* can be reliably attracted.

With the configuration, in the case of passing current to the second electromagnetic coil 2*b* before current is passed to the first electromagnetic coil 2*a*, since the second plunger 3*b* is in the no-attraction state (refer to FIG. 7), the magnetic resistance between the second part 41*b* and the second plunger 3*b* can be increased. It suppresses flow of the magnetic flux Φ of the second electromagnetic coil 2*b* to the second plunger 3*b*. Therefore, without attracting the second plunger 3*b*, only the third plunger 3*c* can be attracted.

The other operations and effects of the second embodiment are similar to those of the first embodiment.

In the embodiment, after current is passed to the second electromagnetic coil 2*b*, the passage of current to the first electromagnetic coil 2*a* is stopped (refer to FIG. 12), attraction of only the first plunger 3*a* is cancelled, and only the first switch 19*a* is turned off. Alternatively, without cancelling the attraction of the first plunger 3*a*, the first switch 19*a* may be continuously in the on state. In this case, power is supplied to the electromagnetic device 63 in a state where the three switches 19*a* to 19*c* are on (refer to FIG. 13). However, since the resistance value of the precharge resistor 62 is large, most of current flows in the second and third switches 19*b* and 19*c* and current hardly flows in the precharge resistor 62. Consequently, even when the first switch 19*a* is continuously on, there is no big problem in practice.

Third Embodiment

Figure 15:
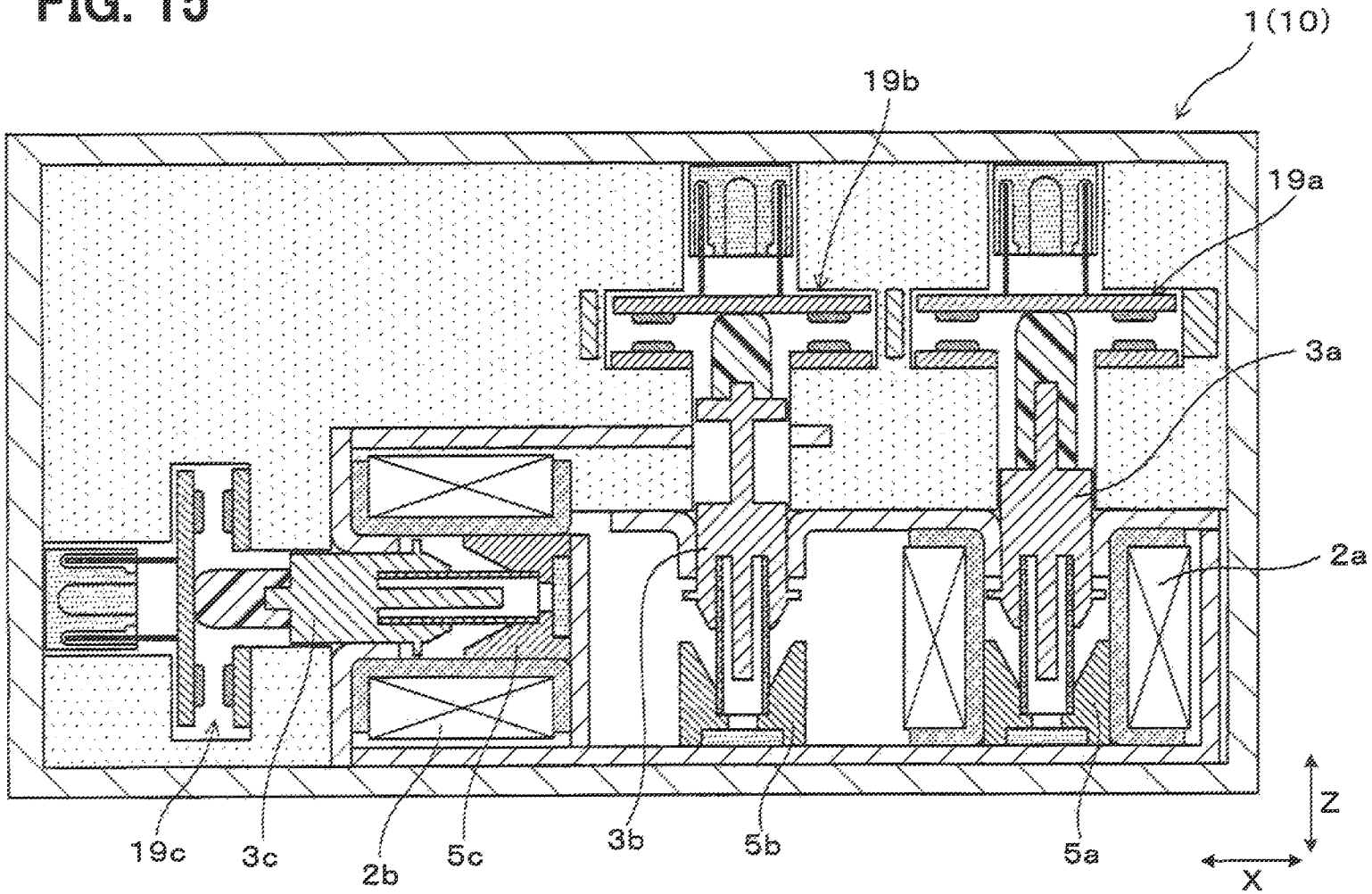
FIG. 15 is a diagram showing a cross section of an electromagnetic relay in a third embodiment.

In a third embodiment, the orientations of the plungers 3 are changed. In the embodiment, as illustrated in FIG. 15, the center axis of the third plunger 3*c* is set in a direction different from the direction of the center axes of the first and second plungers 3*a* and 3*b*. The center axis of the third plunger 3*c* is parallel to the X direction, and the center axes of the first and second plungers 3*a* and 3*b* are parallel to the Z direction.

The other configuration is similar to that of the second embodiment.

The operation and effect of the embodiment will be described. With the configuration, the electromagnetic relay 10 can be used also in a place where vibration easily occurs such as the inside of a vehicle. Specifically, when the three plungers 3 are oriented in the same direction in a place where vibration easily occurs, there is a case that, due to vibration, the three plungers move in the same direction at the same time, and three switches 19 are turned on at the same time. However, by setting one (the third plunger 3*c*) of the three plungers 3*a* to 3*c* in a direction different from the direction of the other two plungers (the first and second plungers 3*a* and 3*b*), the three plungers 3 can be prevented from being simultaneously moved in the same direction due to vibration. Therefore, an inconvenience such that the three switches 19 are simultaneously turned on can be prevented.

Fourth Embodiment

Figure 16:
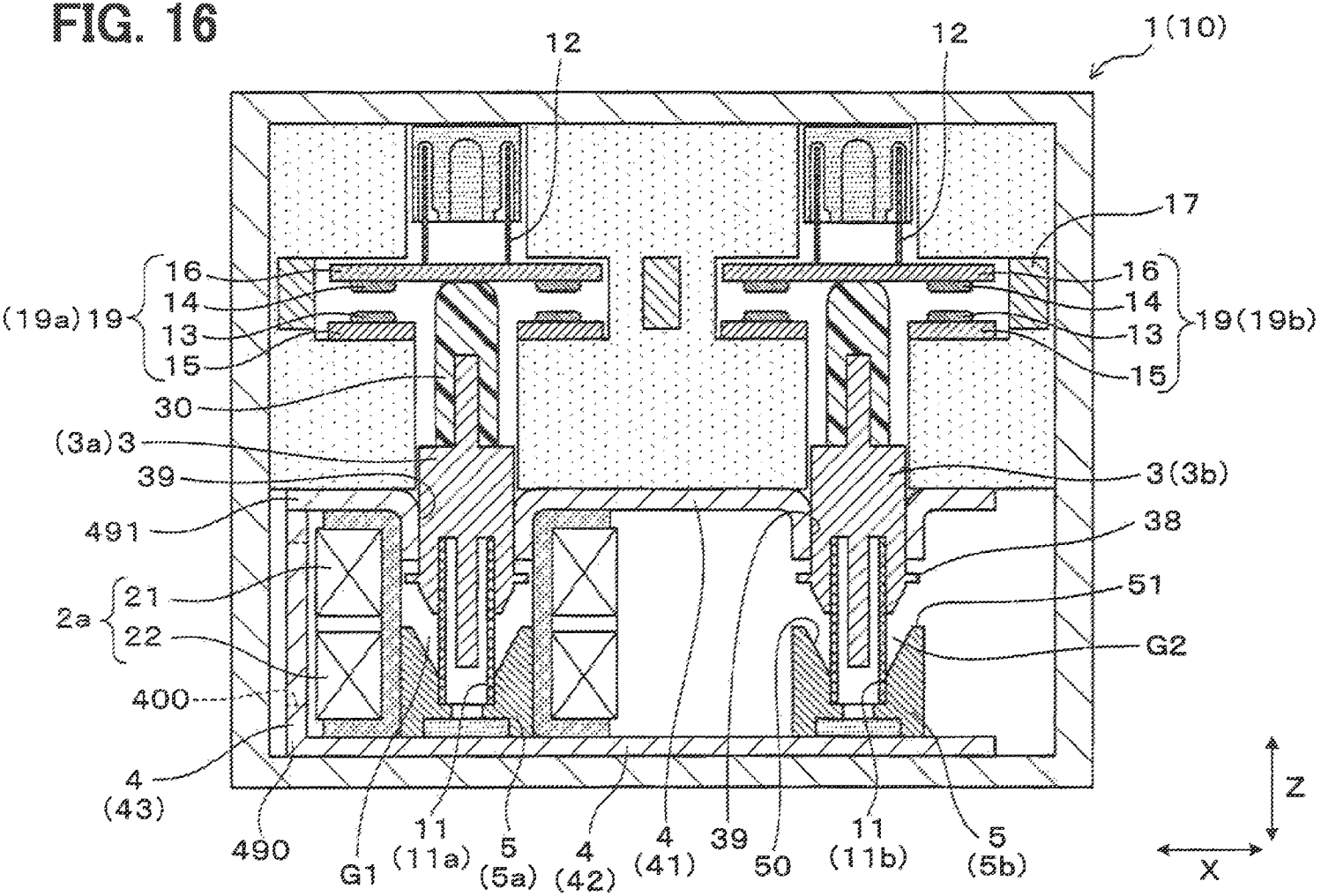
FIG. 16 is a diagram showing a cross section of an electromagnetic relay in a fourth embodiment.

In a fourth embodiment, as illustrated in FIG. 16, the first electromagnetic coil 1 is divided into two parts, a first coil part 21 and a second coil part 22. Current can be separately passed to each of the first and second coil parts 21 and 22. That is, current can be passed only to one of the first and second coil parts 21 and 22 or can be simultaneously passed to both of them.

Figure 17:
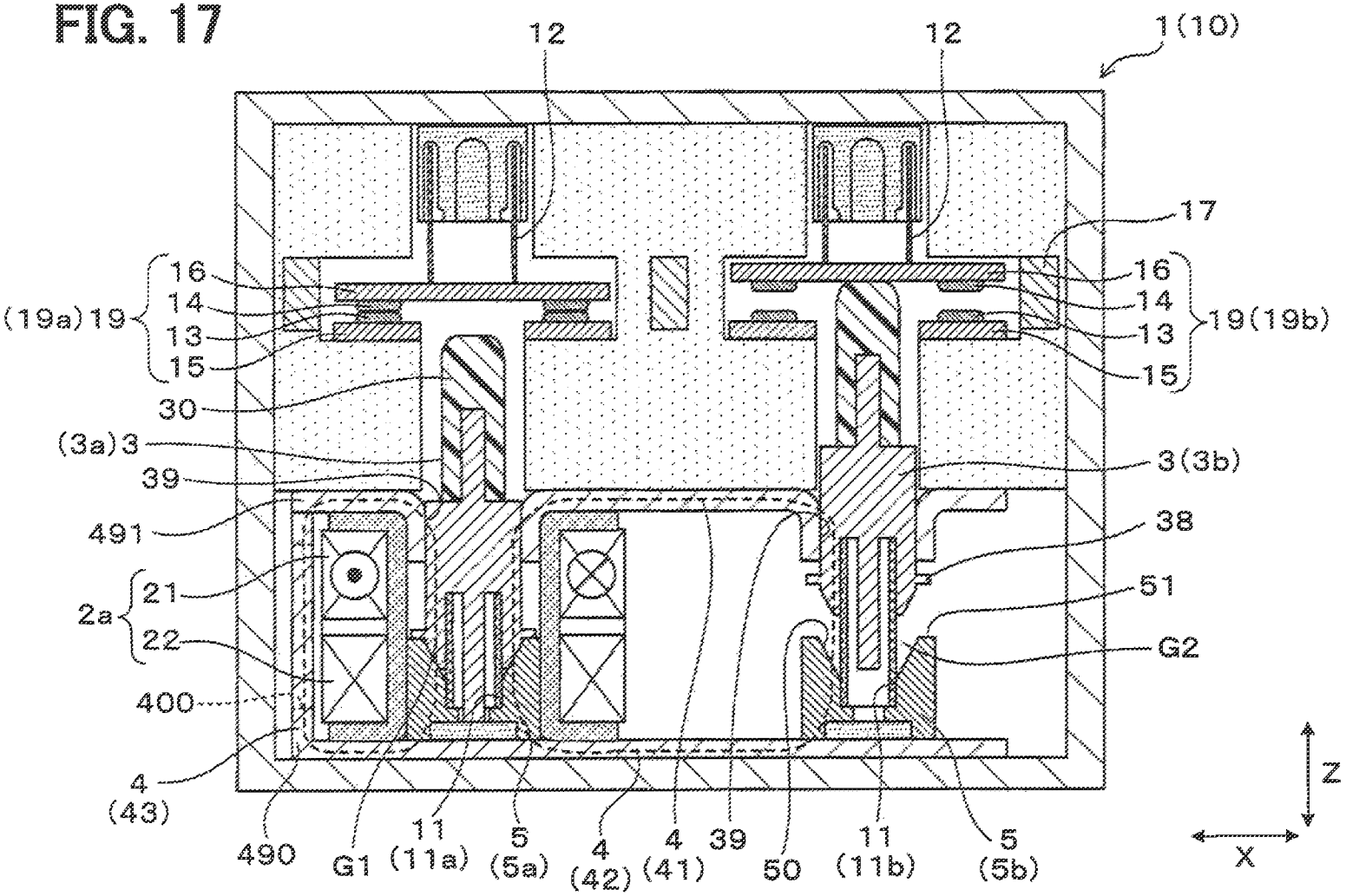
FIG. 17 is a diagram showing a cross section of the electromagnetic relay in the case of passing current only to a first part in the first electromagnetic coil in the fourth embodiment.

As illustrated in FIG. 17, when current is passed to the first coil part 21 while no current is passed to the second coil part 22, only the first plunger 3*a* is attracted by the first fixed core 5*a* by the generated magnetic flux Φ. In the embodiment, for example, the spring constant of the plunger-side spring member 11*b* of the second plunger 3*b* is set to be larger than that of the plunger-side spring member 11*a* of the first plunger 3*a*. With the configuration, even when current is passed only to the first coil part 21 and the magnetic flux Φ is generated, only the first plunger 3*a* is attracted, and the second plunger 3*b* is not attracted. Consequently, only the first switch 19*a* is turned on.

Figure 18:
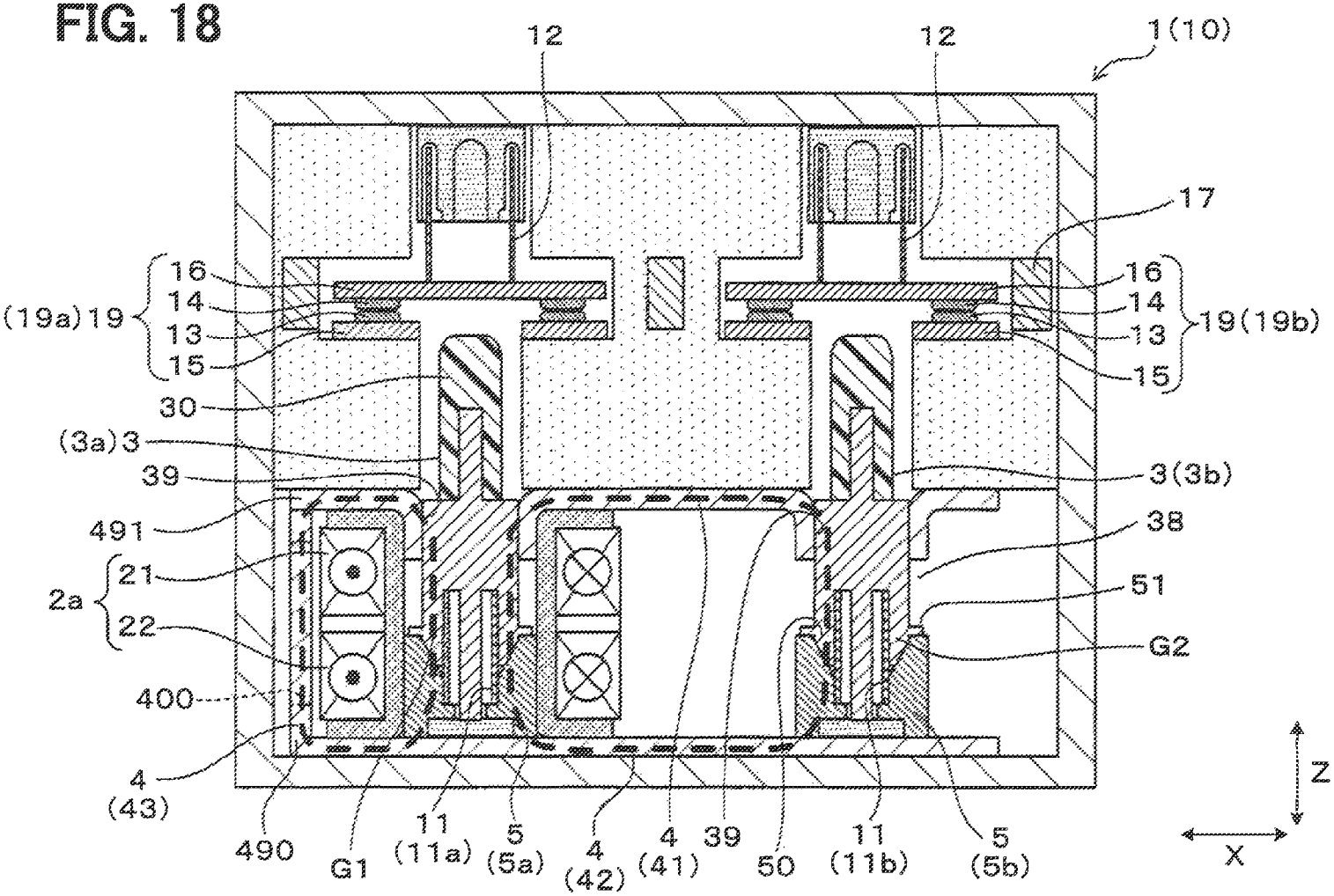
FIG. 18 is a diagram showing a cross section of the electromagnetic relay in the case of passing current to both of first and second parts in the first electromagnetic coil in the fourth embodiment.

As illustrated in FIG. 18, when current is passed to both of the first and second coil parts 21 and 22, large magnetic flux Φ is generated. By the magnetic flux Φ, both of the first and second plungers 3*a* and 3*b* are attracted. Accordingly, both of the two switches 19*a* and 19*b* are turned on.

The other configuration is similar to that of the first embodiment.

The operation and effect of the fourth embodiment will be described. In the embodiment, in a manner similar to the first embodiment, an electromagnetic coil dedicated to attract the second plunger 3*b* is not provided. Consequently, as compared with the case of attracting each of the plungers by using the electromagnetic coil, the amount of copper lines constructing the electromagnetic coil can be decreased. Thus, the manufacture cost of the electromagnetic relay 10 can be reduced.

In the embodiment, time to attract the second plunger 3*b* can be controlled. That is, current is passed only to the first coil part 21 to attract only the first plunger 3*a*. After lapse of predetermined time, current is passed also to the second coil part 22 to attract the second plunger 3*b* as well. Consequently, by controlling the time to pass current to the second coil part 22, the time to attract the second plunger 3*b* can be controlled.

Since there is no gap "G" after attracting the plungers 3*a* and 3*b*, the magnetic resistance in the magnetic circuit becomes small. Consequently, also by decreasing the amount of the magnetic flux Φ generated by stopping the passage of current to the second coil part 22 after attracting the plungers 3*a* and 3*b*, the plungers 3*a* and 3*b* can be continuously attracted. In such a manner, the power consumption in the first electromagnetic coil 2*a* can be decreased.

The other configuration is similar to that of the first embodiment.

In the embodiment, after passing current only to the first coil part 21, current is passed also to the second coil part 22. The order of passing current may be opposite. That is, current may be passed only to the second coil part 22 and, after that, also to the first coil part 21.

Fifth Embodiment

Figure 19:
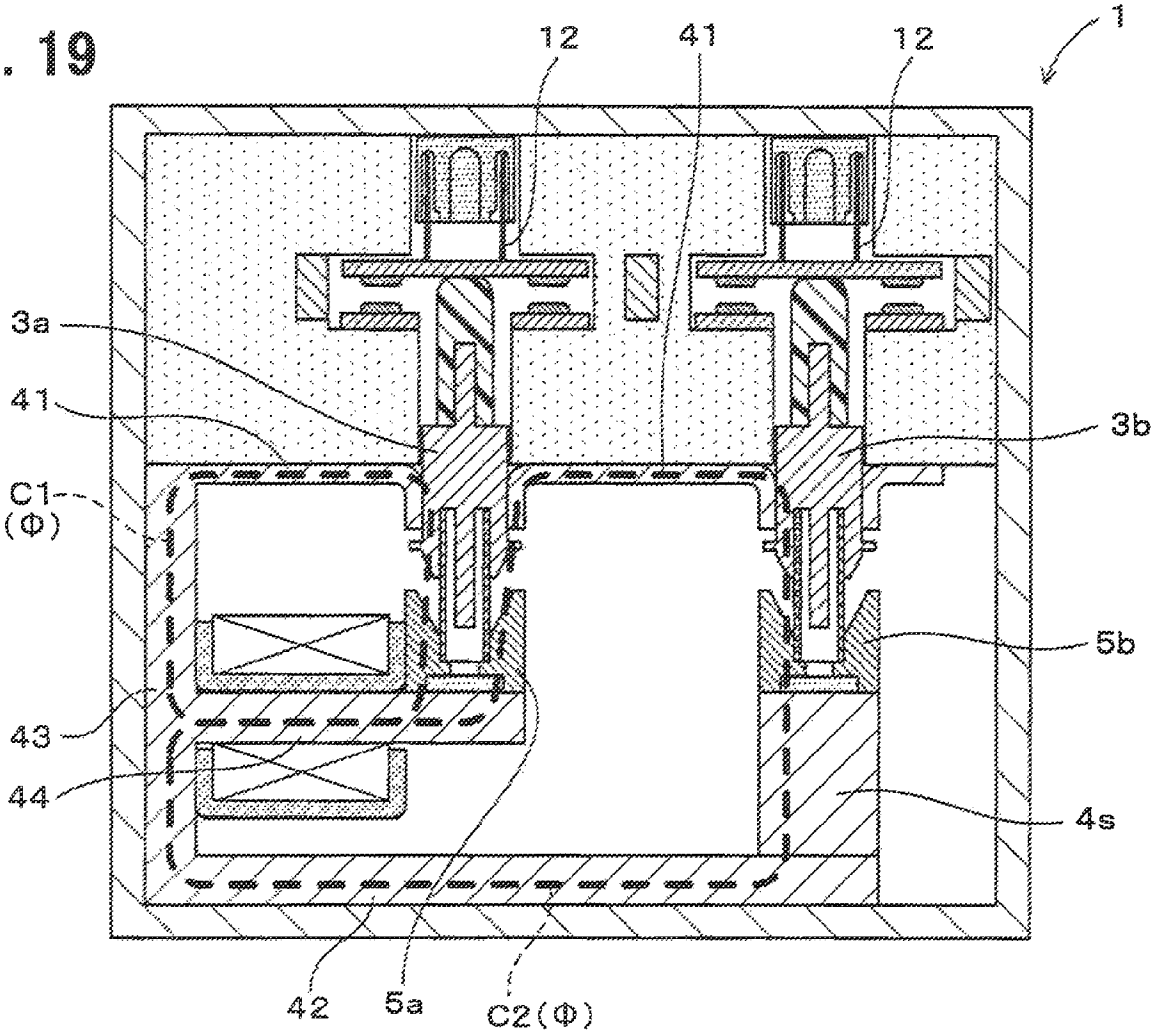
FIG. 19 is a diagram showing a cross section of an electromagnetic relay in a fifth embodiment.

In the embodiment, as illustrated in FIG. 19, the position of the first electromagnetic coil 2*a* is changed. As illustrated in the diagram, in the embodiment, a pillar-shaped yoke 44 is disposed in the center of the first electromagnetic coil 2*a* and is in contact with the first fixed core 5*a* and the side-wall yoke 43. By the pillar-shaped yoke 44, the first fixed core 5*a*, the first plunger 3*a*, the sliding contact yoke 41, and the side-wall yoke 43, the first magnetic circuit C1 in which the magnetic flux Φ flows is constructed.

With the second fixed core 5*b*, a yoke 45 for the core is in contact. The yoke 45 for the core is also in contact with the bottom yoke 42. By the first plunger 3*a*, the sliding contact yoke 41, the second plunger 3*b*, the second fixed core 5*b*, the yoke 45 for the core, the bottom yoke 42, the side-wall yoke 43, the pillar-shaped yoke 44, and the first fixed core 5*a*, the second magnetic circuit C2 in which the magnetic flux Φ flows is constructed.

The other configuration, operation, and effect of the fifth embodiment are similar to those of the first embodiment.

Sixth Embodiment

Figure 20:
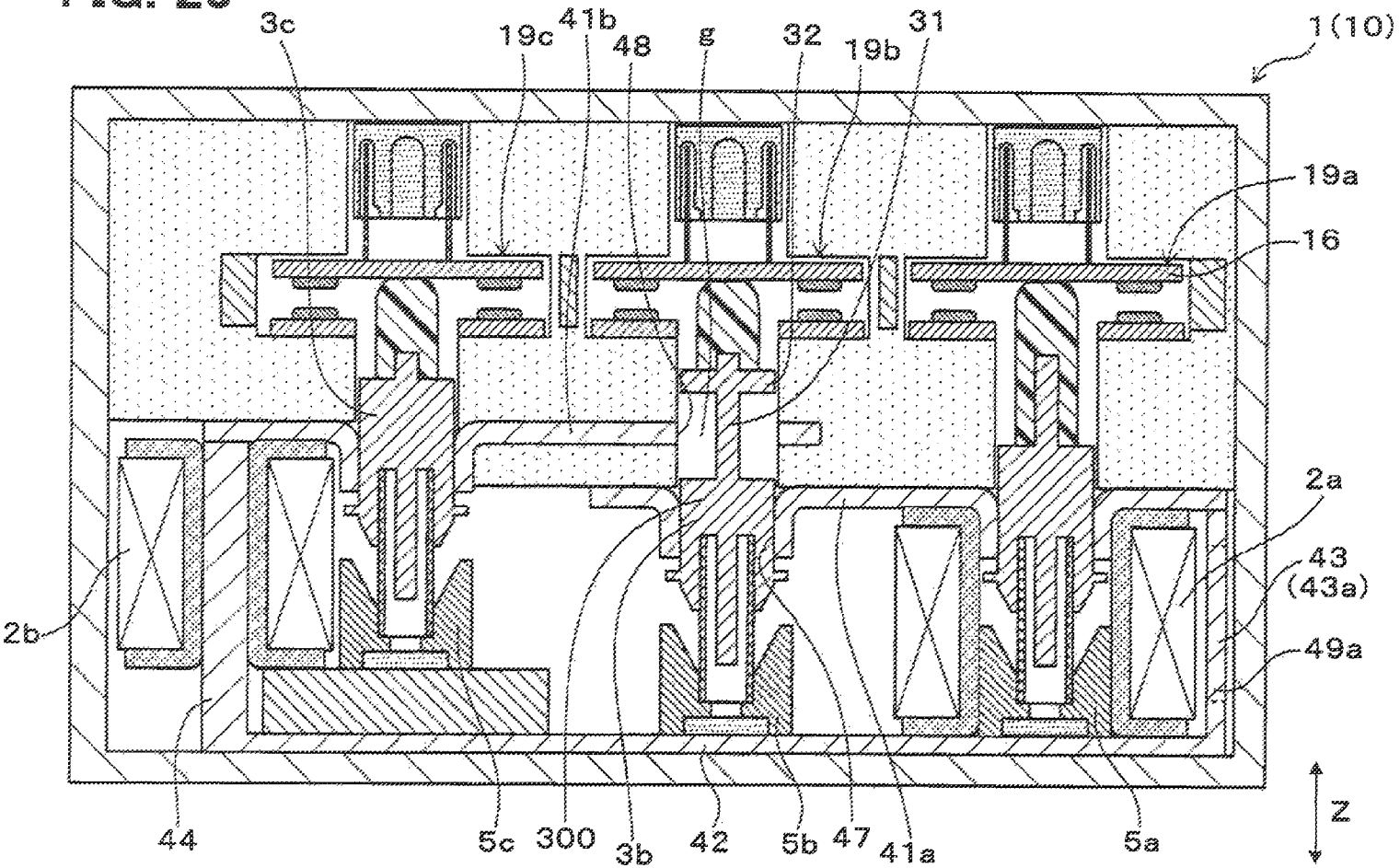
FIG. 20 is a diagram showing a cross section of an electromagnetic relay in a sixth embodiment.

In a sixth embodiment, as illustrated in FIG. 20, the position of the second electromagnetic coil 2*b* is changed. As illustrated in the diagram, in the embodiment, the pillar-shaped yoke 44 is disposed in the center of the second electromagnetic coil 2*b* and is in contact with the second part 41*b* of the yoke 4 and the bottom yoke 42. By the magnetic flux Φ generated by the passage of current to the second electromagnetic coil 2*b*, the third plunger 3*c* is attracted.

The other configuration, operation, and effect of the sixth embodiment are similar to those of the first embodiment.

Seventh Embodiment

Figure 21:
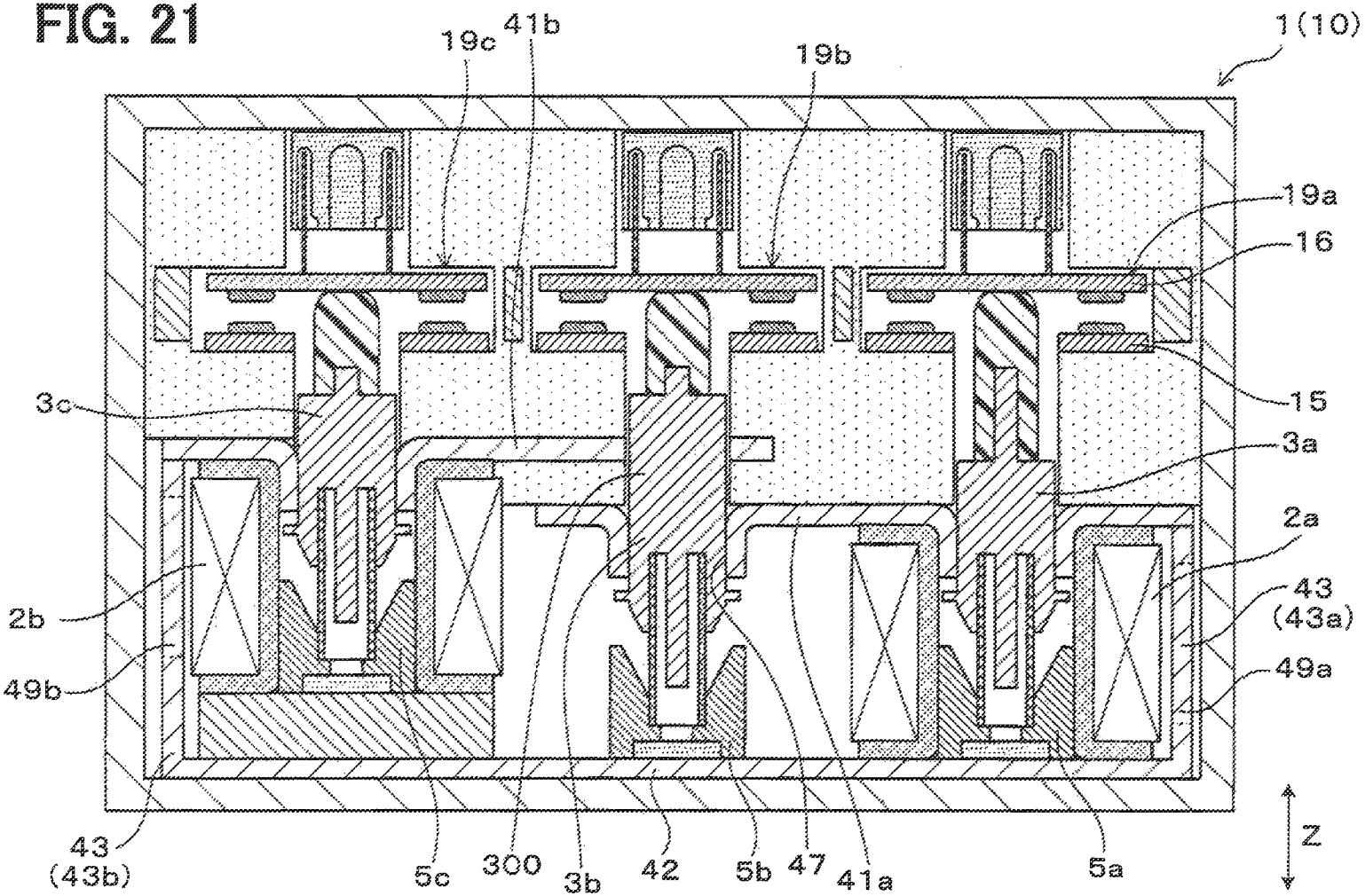
FIG. 21 is a diagram showing a cross section of an electromagnetic relay in a seventh embodiment.

In a seventh embodiment, as illustrated in FIG. 21, the diameter-reduced part 31 and the diameter-enlarged part 32 are not formed but only the body 300 is formed in the second plunger 3*b*.

The other configuration, operation, and effect of the seventh embodiment are similar to those of the first embodiment.

Eighth Embodiment

Figure 22:
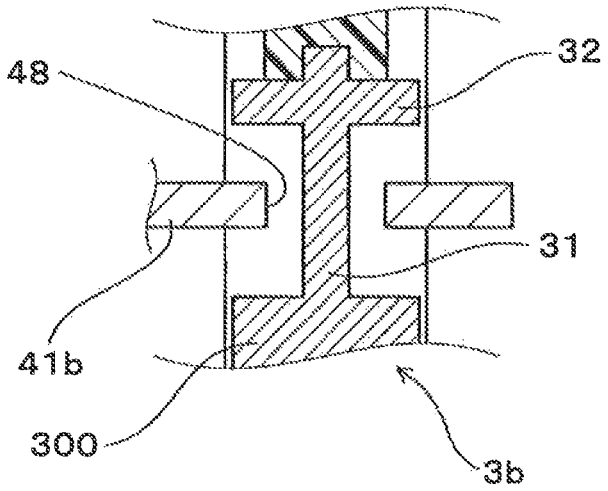
FIG. 22 is a diagram showing an enlarged diagram of a main part of a second plunger in an eighth embodiment.
Figure 23:
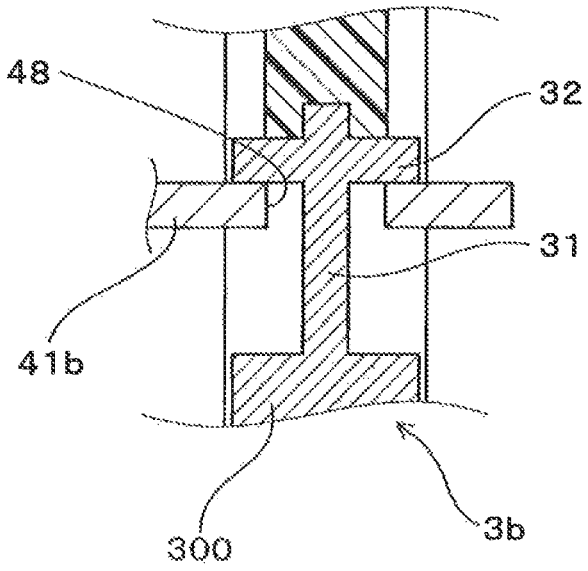
FIG. 23 is a diagram showing an enlarged diagram of a main part in a state where the second plunger is attracted in the eighth embodiment.

In an eighth embodiment, as illustrated in FIGS. 22 and 23, the through hole 48 formed in the second part 41*b* of the yoke 4 is made smaller than the diameter-enlarged part 32. It is constructed so that when the second plunger 3*b* is attracted, the diameter-enlarged part 32 comes into contact with the surface of the second part 41*b*.

With such a configuration, when the second plunger 3*b* is attracted, the second part 41*b* and the second plunger 3*b* come into contact with each other, so that the magnetic resistance between the second part 41*b* and the second plunger 3*b* can be further decreased. Consequently, when current is passed to the second electromagnetic coil 2*b*, the magnetic flux Φ of the second electromagnetic coil 2*b* flows more easily from the second part 41*b* to the diameter-enlarged part 32 (the second plunger 3*b*). Therefore, when the passage of current to the first electromagnetic coil 2*a* is stopped (refer to FIG. 12), the second plunger 3*b* can be reliably attracted by the magnetic flux Φ of the second electromagnetic coil 2*b*.

The other configuration, operation, and effect are similar to those of the first embodiment.

Ninth Embodiment

Figure 24:
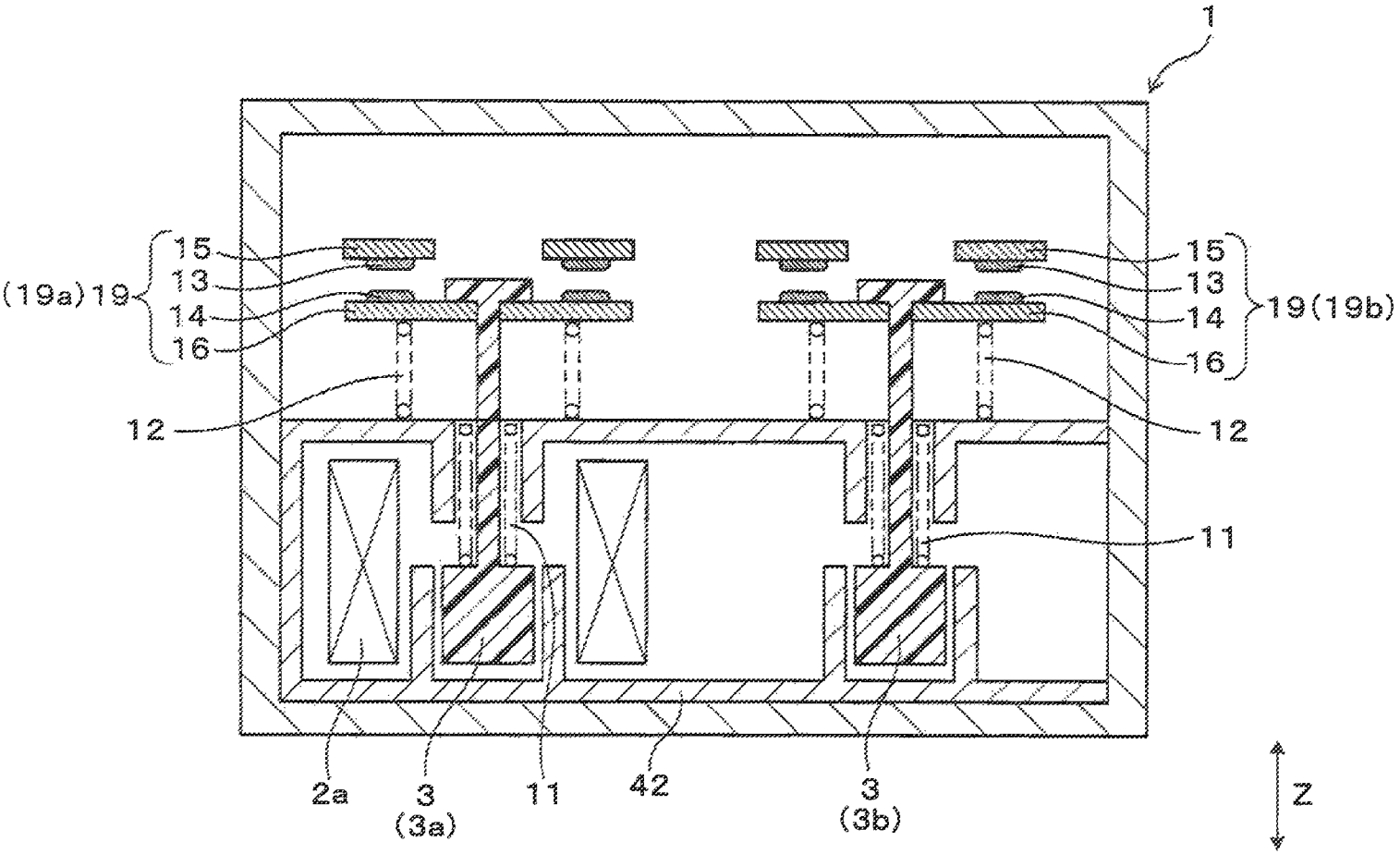
FIG. 24 is a diagram showing a cross section of an electromagnetic relay in an off state in a ninth embodiment.
Figure 25:
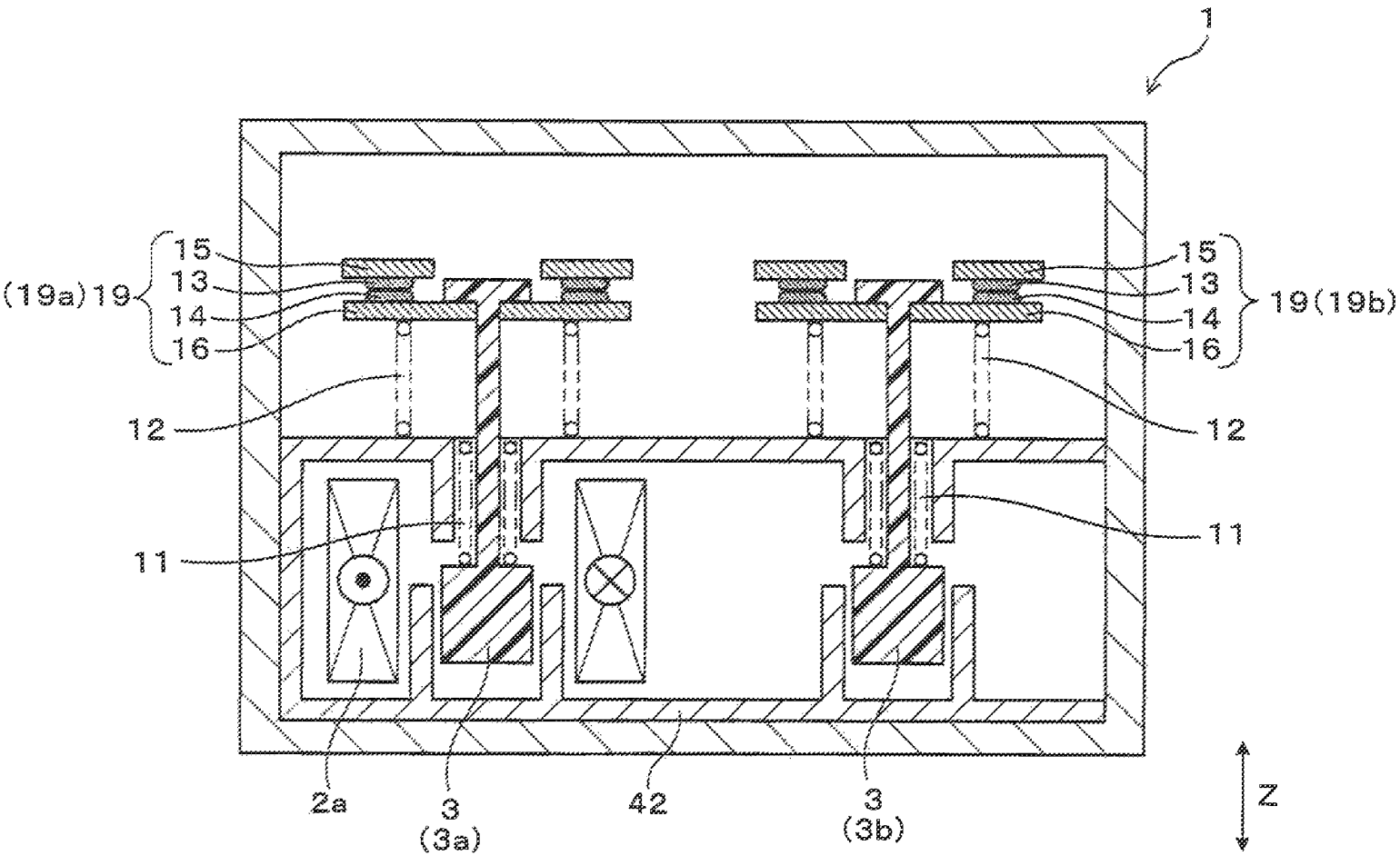
FIG. 25 is a diagram showing a cross section of an electromagnetic relay in an on state in the ninth embodiment.

In a ninth embodiment, as illustrated in FIGS. 24 and 25, the orientations of the switches 19*a* and 19*b* and the disposition positions of the spring members 11 and 12 are changed. In the embodiment, the fixed contact 13 and the fixed-contact supporting part 15 are provided in a position far from the plunger 3 in the Z direction, and the moving contact 14 and the moving-contact supporting part 16 are provided in a position close to the plunger 3 in the Z direction. The moving-contact supporting part 16 is attached to the plunger 3. Accompanying the forward/backward moving operation of the plunger 3, the moving contact 14 comes into contact with/moves apart from the fixed contact 13. The contact-side spring member 12 presses the moving-contact supporting part 16 toward the fixed-contact supporting part 15 side. The plunger-side spring member 11 presses the plunger 3*a* toward the bottom yoke 42 side.

As illustrated in FIG. 24, in the case where no current is passed to the first electromagnetic coil 2*a*, by the pressing force of the plunger-side spring member 11, the plunger 3*a* is pressed to the bottom yoke 42 side, and the switches 19*a* and 19*b* are turned off.

As illustrated in FIG. 25, when current is passed to the first electromagnetic coil 2*a*, the plungers 3*a* and 3*b* are pressed toward the fixed-contact supporting part 15 side. Consequently, the moving contact 14 comes into contact with the fixed contact 13, and the switches 19*a* and 19*b* are turned on.

The other configuration, operation, and effect of the ninth embodiment are similar to those of the first embodiment.

Tenth Embodiment

Figure 26:
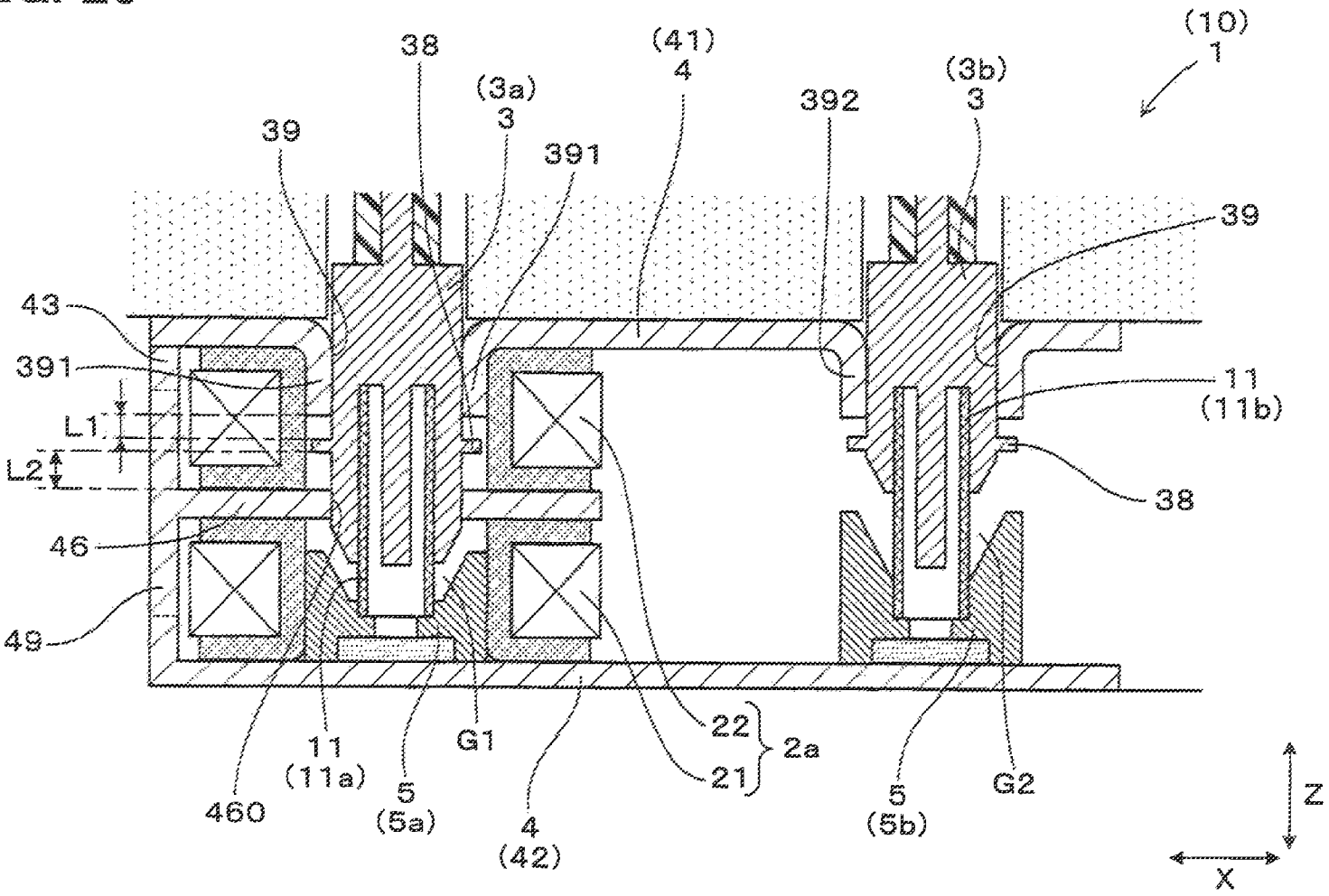
FIG. 26 is a diagram showing a cross section of an electromagnetic relay in an off state in a tenth embodiment.

In a tenth embodiment, the shape of the first electromagnetic coil 2*a* and that of the yoke 4 are changed. As illustrated in FIG. 26, the first electromagnetic coil 2*a* has the first coil part 21 and the second coil part 22 to which current can be separately passed. The first coil part 21 is disposed in a position closer to the first fixed core 5*a* than the second coil part 22 in the forward/backward movement direction of the first plunger 3*a*. The yoke 4 has an intermediate yoke 46 and the sliding contact yoke 41. The intermediate yoke 46 is disposed between the first and second coil parts 21 and 22. The sliding contact yoke 41 is provided in a position far from the first fixed core 5*a* as compared with the intermediate yoke 46 in the forward/backward movement direction (Z direction) of the first plunger 3*a*. With the sliding contact yoke 41, the first and second plungers 3*a* and 3*b* come into sliding-contact.

Figure 27:
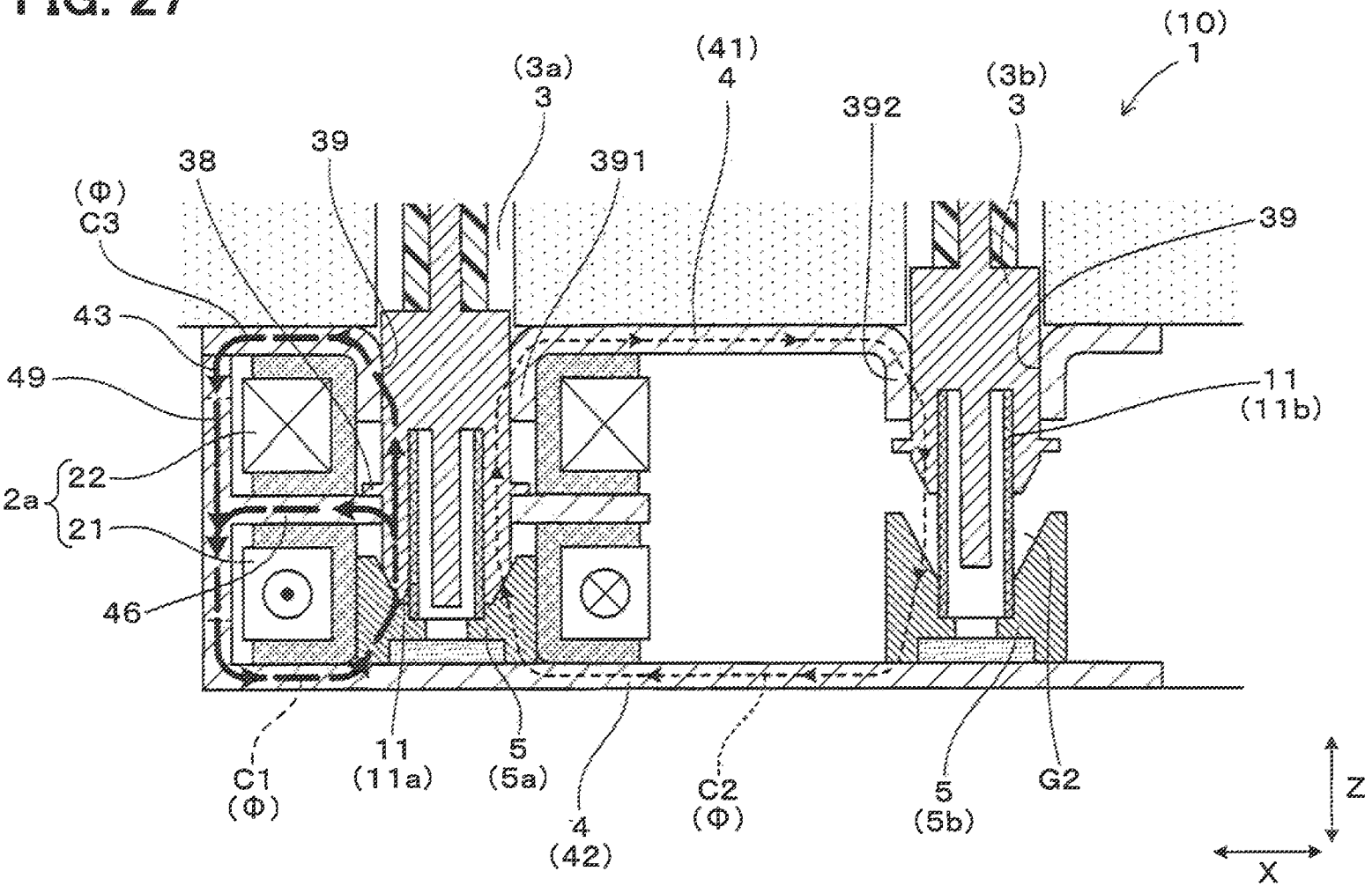
FIG. 27 is a diagram showing a cross section of the electromagnetic relay in a state where current is passed only to a first coil part in the tenth embodiment.
Figure 29:
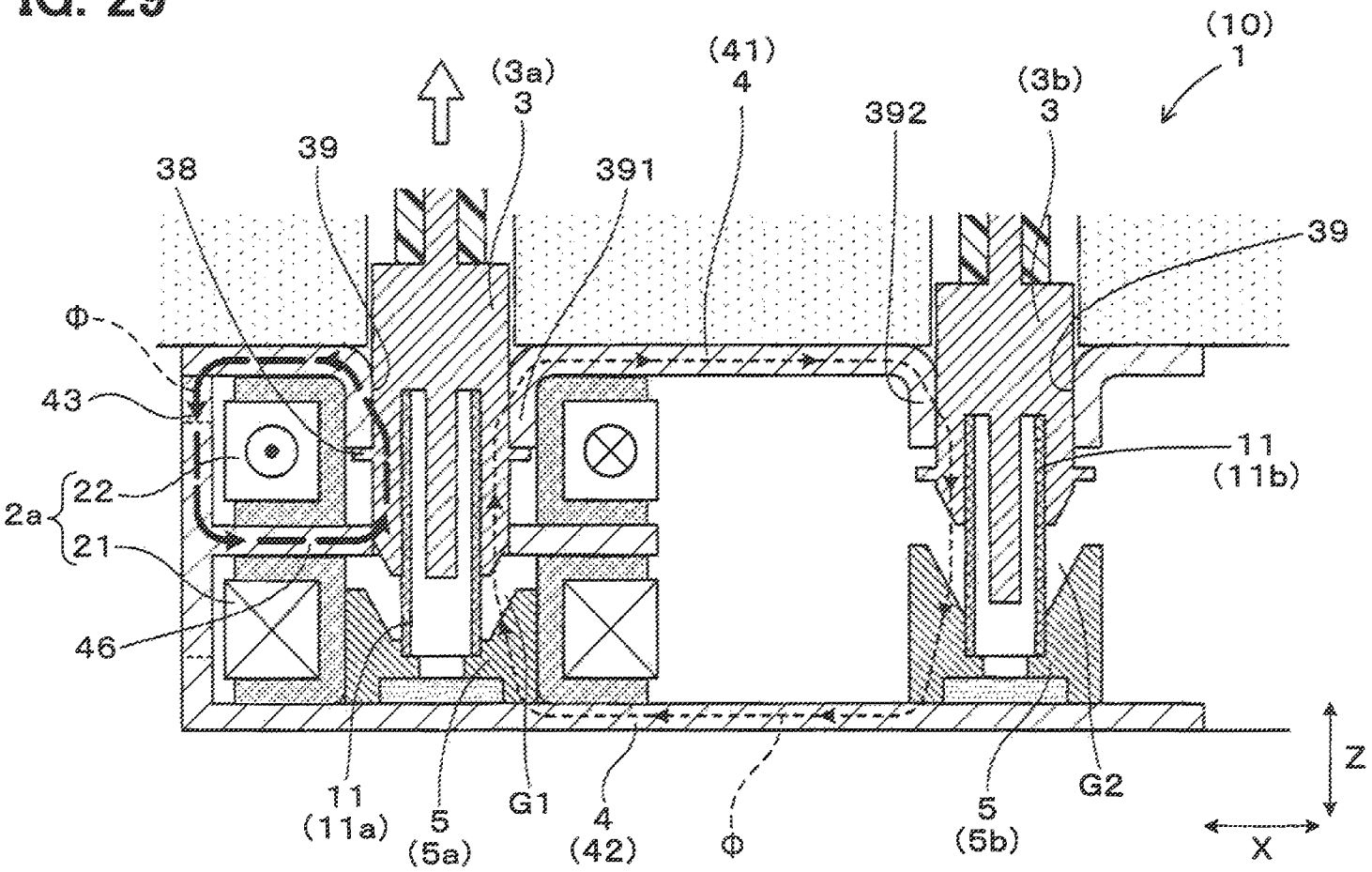
FIG. 29 is a diagram showing a cross section of the electromagnetic relay in a state where current is passed only to the second coil part in the tenth embodiment.

As illustrated in FIG. 27, when current is passed only to the first coil part 21 as one of the first and second coil parts 21 and 22, by the magnetic force generated by the magnetic flux Φ flowing in the intermediate yoke 46, the first plunger 3*a*, and the first fixed core 5*a*, the first plunger 3*a* is attracted by the first fixed core 5*a*. As illustrated in FIG. 29, when current is passed only to the second coil part 22 as one of the first and second coil parts 21 and 22, by the magnetic force generated by the magnetic flux Φ flowing in the intermediate yoke 46, the first plunger 3*a*, and the sliding-contact yoke 41, the first plunger 3*a* is attracted by the sliding-contact yoke 41, and the first plunger 3*a* moves apart from the first fixed core 5*a*.

In a manner similar to the first embodiment, the yoke 4 of the tenth embodiment has the side-wall yoke 43 and the bottom yoke 42. The side-wall yoke 43 is provided with the magnetic saturation part 49. In the sliding contact yoke 41, the through hole 39 through which the plunger 3 is inserted is formed. In the periphery of the through hole 39, opening walls 391 and 392 projected to the fixed core 5 side are formed. When the plunger 3 performs the forward/backward moving operation, the plunger 3 comes into slide-contact with the inner peripheral face of the opening walls 391 and 392. The opening wall 391 projects to the inside of the second coil part 22 of the first electromagnetic coil 2*a*.

In a manner similar to the first embodiment, the flange 38 is formed in the plunger 3. In the no-current passage state, length L1 from the flange 38 to the sliding contact yoke 41 (opening wall 391) in the Z direction is shorter than length L2 from the intermediate yoke 46 to the flange 38.

The intermediate yoke 46 is formed in a plate shape. In the intermediate yoke 46, a through hole 460 which penetrates in the Z direction is formed. The first plunger 3*a* is inserted in the through hole 460.

Figure 28:
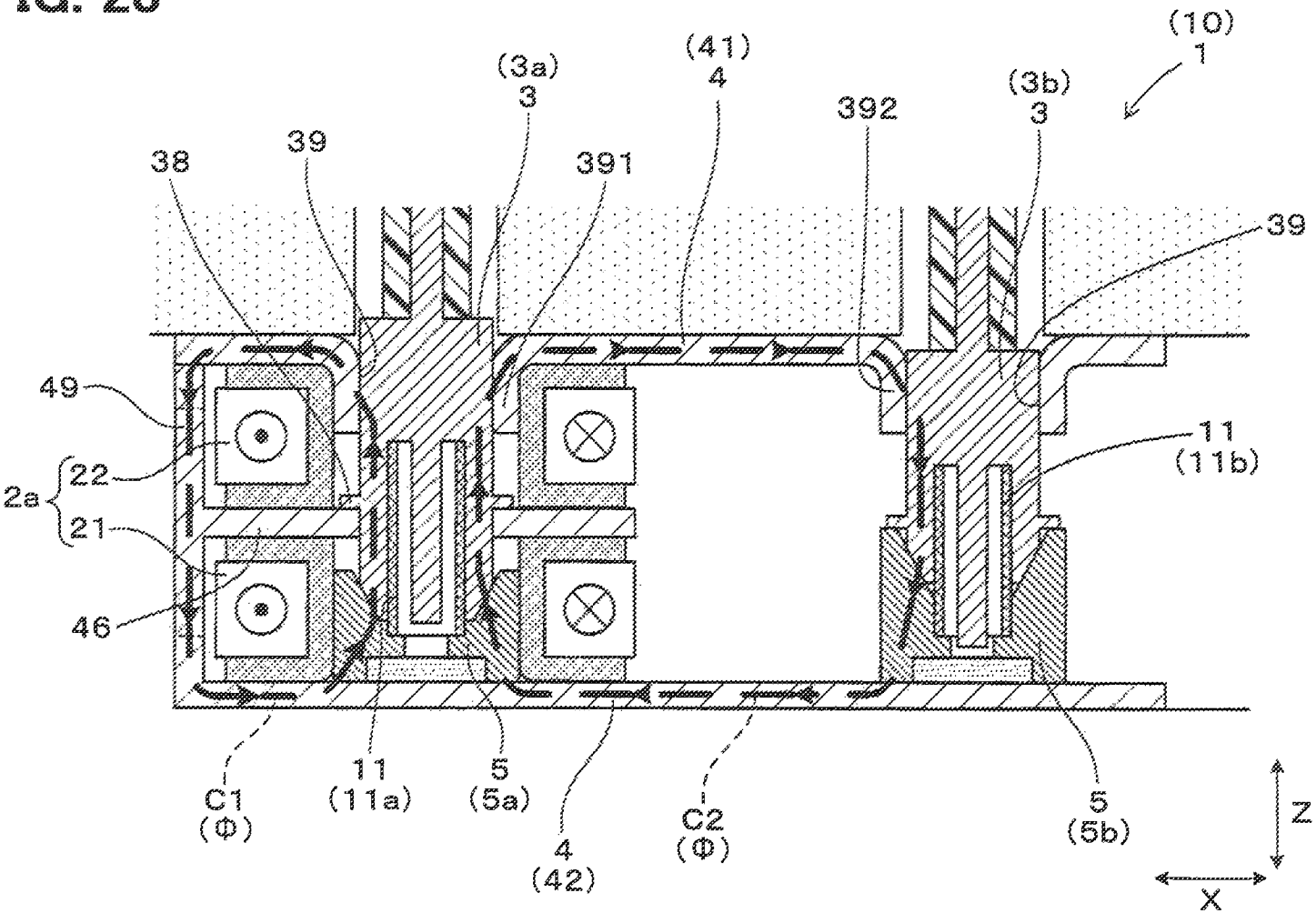
FIG. 28 is a diagram showing a cross section of the electromagnetic relay in a state where current is passed to the first coil part and, after that, passed also to the second coil part in the tenth embodiment.
Figure 30:
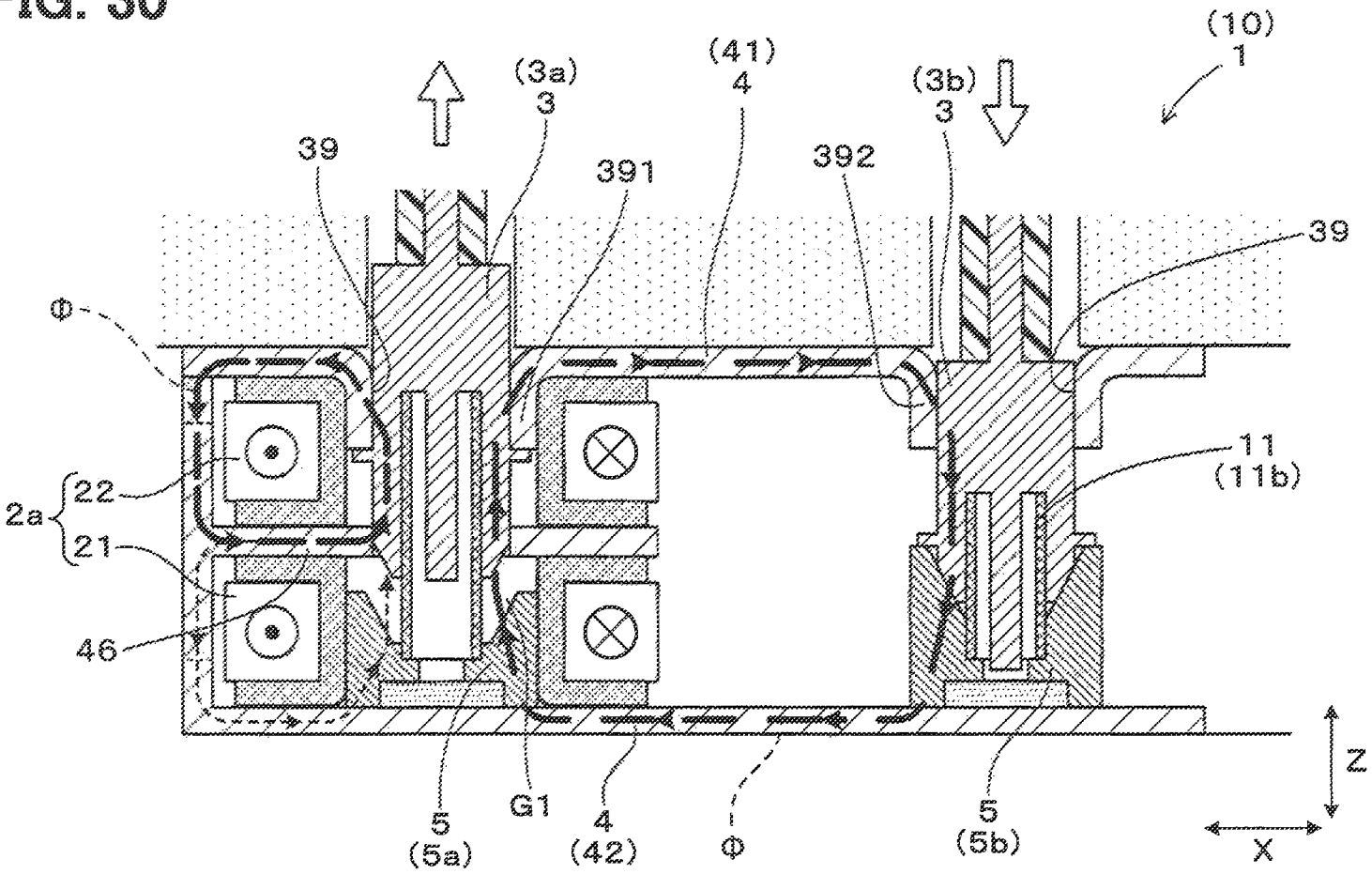
FIG. 30 is a diagram showing a cross section of the electromagnetic relay in a state where current is passed to the second coil part and, after that, passed also to the first coil part in the tenth embodiment.

The current passage modes in the solenoid device 1 of the embodiment are the first current passage mode in which, as illustrated in FIGS. 27 and 28, current is passed to the first coil part 21 first and, while maintaining the current passage, current is then passed to the second coil part 22, and the second current passage mode in which, as illustrated in FIGS. 29 and 30, current is passed to the second coil part 22 first and, while maintaining the current passage, current is then passed to the first coil part 21.

As illustrated in FIG. 27, in the first current passage mode, when current is passed to the first coil part 21, the magnetic flux Φ is generated. The magnetic flux Φ flows in the first magnetic circuit C1, the second magnetic circuit C2, and the third magnetic circuit C3. The first magnetic circuit C1 is made by the intermediate yoke 46, the side-wall yoke 43, the bottom yoke 42, the first fixed core 5*a*, and the first plunger 3*a*. The second magnetic circuit C2 is made by the first plunger 3*a*, the sliding contact yoke 41, the second plunger 3*b*, the second fixed core 5*b*, the bottom yoke 42, and the first fixed core 5*a*. The third magnetic circuit C3 is made by the first plunger 3*a*, the sliding contact yoke 41, the side-wall yoke 43, the bottom yoke 42, and the first fixed core 5*a*.

At the time of switching the first coil part 21 from the no-current passage state (refer to FIG. 26) to the current passage state (refer to FIG. 27), the magnetic flux Φ flowing in the first magnetic circuit C1 passes through the first gap G1. The magnetic flux Φ flowing in the second magnetic circuit C2 passes through both the first and second gaps G1 and G2. The magnetic flux Φ flowing in the first magnetic circuit C1, the magnetic flux Φ flowing in the second magnetic circuit C2, and the magnetic flux Φ flowing in the third magnetic circuit C3 pass through the first gap G1. Particularly, the strong magnetic flux Φ flows in the first and third magnetic circuits C1 and C3. By the magnetic force generated by the magnetic flux Φ, the first plunger 3*a* is attracted by the first fixed core 5*a*. When the first plunger 3*a* is attracted, the flange 38 comes into contact with the surface of the intermediate yoke 46.

As illustrated in FIG. 27, in the embodiment, when current is passed only to the first coil part 21, the magnetic flux Φ does not sufficiently flow in the second magnetic circuit C2, and the second plunger 3*b* is not attracted. As illustrated in FIG. 28, when current is passed to the first coil part 21 and, after that, current is passed also to the second coil part 22, the magnetic flux Φ of the first coil part 21 and the magnetic flux Φ of the second coil part 22 are added, and a large amount of the magnetic flux Φ flows in the second magnetic circuit C2. Consequently, the second plunger 3*b* is attracted by the second fixed core 5*b*.

As illustrated in FIG. 29, in the second current passage mode, when current is passed to only the second coil part 22 as one of the first and second coil parts 21 and 22, a part of the magnetic flux Φ flows in the first plunger 3*a*, the sliding contact yoke 41, the side-wall yoke 43, and the intermediate yoke 46. At this time, the magnetic flux Φ flows also between the flange 38 and the opening wall 391. By the magnetic force generated, the flange 38 is attracted by the opening wall 391.

Another part of the magnetic flux Φ flows in the first plunger 3*a*, the sliding contact yoke 41, the second plunger 3*b*, the second fixed core 5*b*, the bottom yoke 42, and the first fixed core 5*a*. In the embodiment, even when current is passed only to the second coil part 22, the magnetic flux Φ does not sufficiently flow in the second plunger 3*b*, and the second plunger 3*b* is not attracted. As illustrated in FIG. 30, when current is passed to the second coil part 22 and, after that, also to the first coil part 21, the magnetic flux Φ of the first coil part 21 and the magnetic flux Φ of the second coil part 22 are added, and a large amount of the magnetic flux Φ flows in the second plunger 3*b*. Consequently, strong magnetic force is generated in the second plunger 3*b*, and the second plunger 3*b* is attracted by the second fixed core 5*b*.

As described above, in the embodiment, in the first current passage mode (refer to FIGS. 27 and 28), the first plunger 3*a* is attracted by the first fixed core 5*a*, and the second plunger 3*b* is attracted by the second fixed core 5*b*. In the second current passage mode (refer to FIGS. 29 and 30), the first plunger 3*a* is attracted by the sliding contact yoke 41, and the second plunger 3*b* is attracted by the second fixed core 5*b*.

In the embodiment, in a manner similar to the first embodiment, the solenoid device 1 is used as the electromagnetic relay 10. The electromagnetic relay 10 can be provided for the power supply input unit 66 (refer to FIG. 6) in a manner similar to the first embodiment. For example, the second switch 19*b* (refer to FIG. 6) is opened/closed by the first plunger 3*a*, and the first switch 19*a* is opened/closed by the second plunger 3*b*. At the time of precharging the smoothing capacitor 61, it is necessary to turn on only the first switch 19*a* and turn off the second switch 19*b*. Consequently, at this time, current is passed to the first electromagnetic coil 2*a* by the second current passage mode (refer to FIGS. 29 and 30). By the operation, the first plunger 3*a* is moved apart from the first fixed core 5*a*, while preventing the second switch 19*b* from being turned on, the second plunger 3*b* is attracted to turn on the first switch 19*a*.

After completion of precharging the smoothing capacitor 61, passage of current to the first and second coil parts 21 and 22 is temporarily stopped, and current is passed only to the first coil part 21 (refer to FIG. 27). It turns on only the second switch 19*b* (refer to FIG. 6), and power is supplied to the electronic device 63. Alternatively, current is passed also to the second coil part 22 (refer to FIG. 28) to turn on both of the first and second switches 19*a* and 19*b*.

The operation and effect of the embodiment will be described. In the embodiment, as illustrated in FIG. 27, by passing current only to the first coil part 21, the first plunger 3*a* is attracted by the first fixed core 5*a*. Alternatively, by passing current only to the second coil part 22, the first plunger 3*a* can be attracted by the sliding contact yoke 41. That is, the first plunger 3*a* can be moved close to the first fixed core 5*a* or apart from the first fixed core 5*a*. Consequently, in the case where the first plunger 3*a* is not attracted by the first fixed core 5*a*, the first plunger 3*a* can be moved forcedly apart from the first fixed core 5*a*. Thus, the first plunger 3*a* can be prevented from being erroneously attracted by the first fixed core 5*a*.

As illustrated in FIG. 26, in the no-current passage state, the length L1 from the flange 38 of the first plunger 3*a* to the sliding contact yoke 41 (the opening wall 391) in the Z direction is shorter than the length L2 from the intermediate yoke 46 to the flange 38.

Consequently, when current is passed only to the second coil part 22, strong magnetic force is generated between the flange 38 and the sliding contact yoke 41 (opening wall 391). Therefore, the first plunger 3*a* can be reliably attracted by the sliding contact yoke 41, and the first plunger 3*a* can be prevented from being attracted by the intermediate yoke 46.

Figure 31:
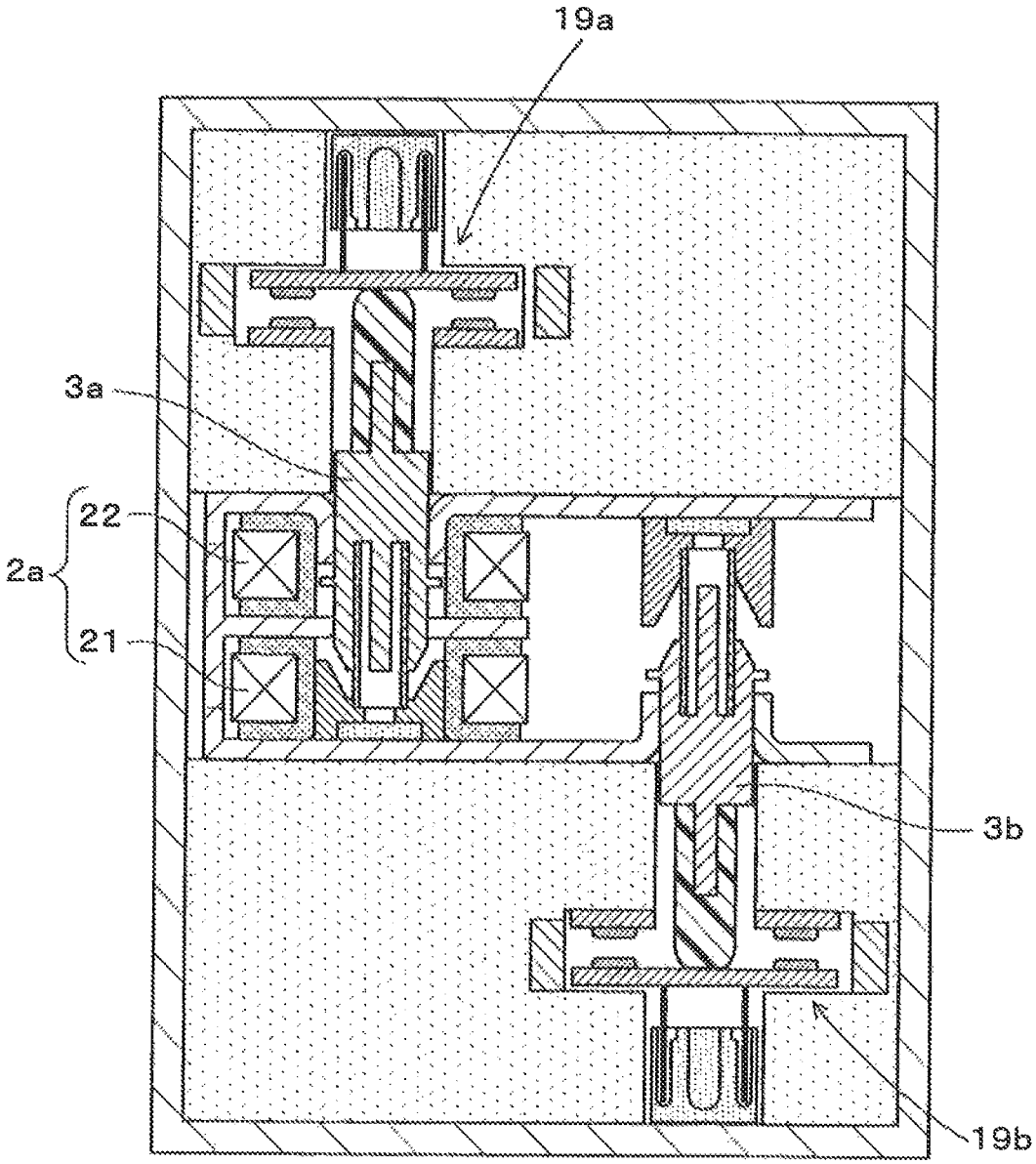
FIG. 31 is a diagram showing a cross section of the electromagnetic relay in which the orientation of a second plunger is made opposite, in the tenth embodiment.

In the embodiment, when the two plungers 3*a* and 3*b* move to the same side (the bottom yoke 42 side), the two switches 19*a* and 19*b* are turned one. As illustrated in FIG. 31, when the two plungers 3*a* and 3*b* move to the sides opposite to each other, the switches 19*a* and 19*b* may be turned on. In such a manner, when vibration occurs and the two plungers 3*a* and 3*b* move in the same direction, the two switches 19*a* and 19*b* can be prevented from being turned on simultaneously. Consequently, supply of power to the electronic device 63 (refer to FIG. 6) at unintended time is more suppressed.

The rest is similar to the first embodiment. Unless otherwise described, the same reference numerals as those used in the first embodiment in the reference numerals used for the drawings related to the embodiment refer to components similar to those of the first embodiment.

Eleventh Embodiment

Figure 32:
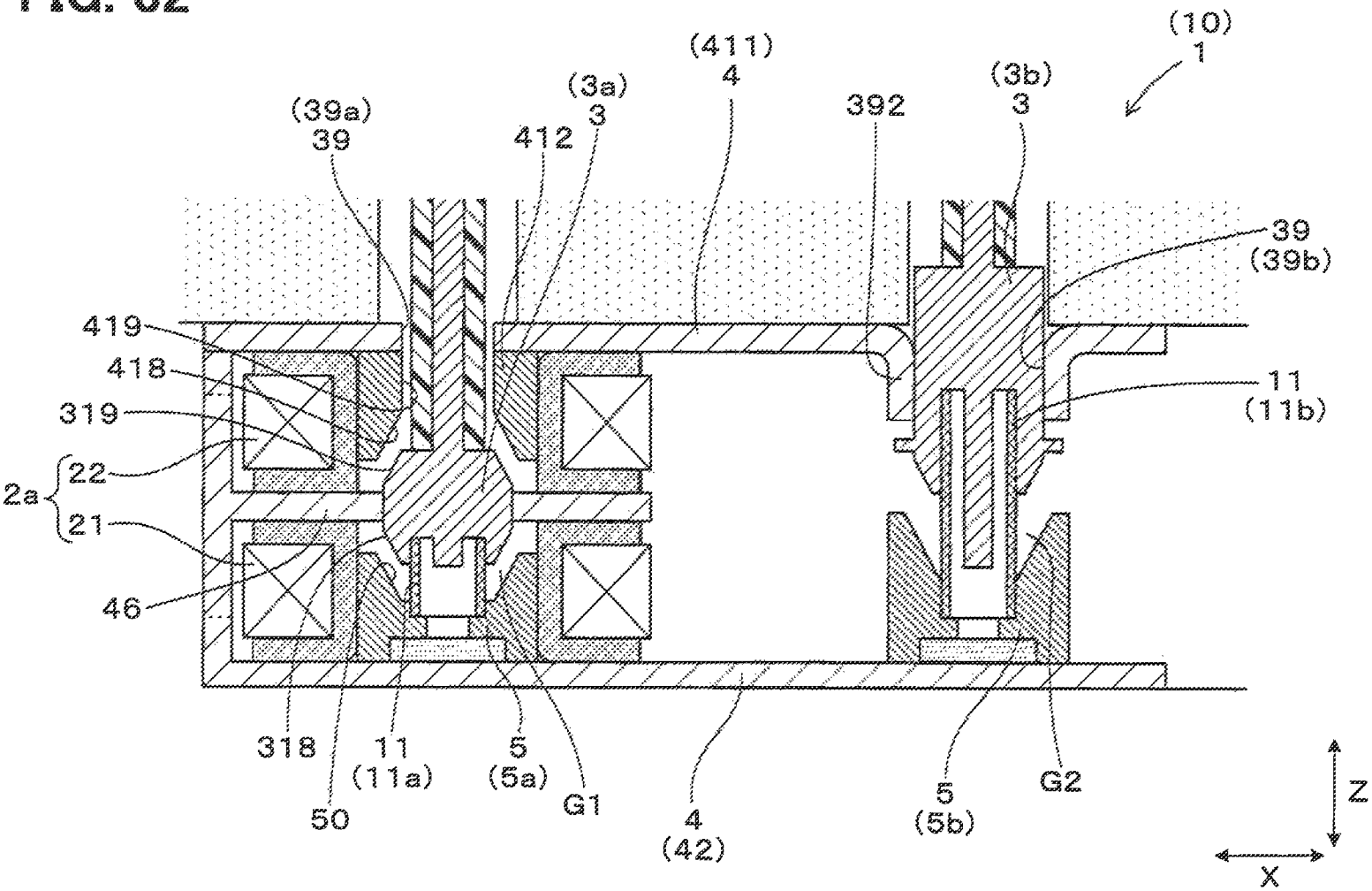
FIG. 32 is a diagram showing a cross section of an electromagnetic relay in an eleventh embodiment.

In an eleventh embodiment, the shape of the first plunger 3*a* and the shape of the sliding contact yoke are changed. As illustrated in FIG. 32, the solenoid device 1 of the embodiment has two sliding contact yokes; a first sliding contact yoke 411 and a second sliding contact yoke 412. The first sliding contact yoke 411 has a plate shape, and two through holes 39 are formed. The second sliding contact yoke 412 is disposed in the center of the second coil part 22 and fixed to the first sliding contact yoke 411. In the second sliding contact yoke 412, a through hole 419 penetrating in the Z direction and a conical face 418 are formed. A through hole 39*a* in the first sliding contact yoke 411 and the through hole 419 in the second sliding contact yoke 412 are communicated with each other.

In the first plunger 3*a*, tapered surfaces 318 and 319 each having a conical shape are formed. The tapered surface 318 is in contact with the conical surface 50 of the first fixed core 5*a*, and the other tapered surface 319 is in contact with the conical surface 418 of the second sliding contact yoke 412.

In the embodiment, when current is passed only to the first coil part 21 as one of the first and second coil parts 21 and 22, the first plunger 3*a* is attracted by the first fixed core 5*a*. Subsequently, when current is passed also to the second coil part 22, the magnetic fluxes Φ of the two coil parts 21 and 22 flow in the second plunger 3*b*, strong magnetic force is generated, and the second plunger 3*b* is attracted by the second fixed core 5*b*. When current is passed only to the second coil part 22, the first plunger 3*a* is attracted by the second sliding contact yoke 412. Subsequently, when current is passed also to the first coil part 21, the magnetic fluxes Φ of the two coil parts 21 and 22 flow in the second plunger 3*b*, strong magnetic force is generated, and the second plunger 3*b* is attracted by the second fixed core 5*b*.

The rest is similar to the tenth embodiment. The same reference numerals used in the tenth embodiment in the reference numerals used for the drawings related to the embodiment refer to components similar to those of the tenth embodiment.

Twelfth Embodiment

Figure 33:
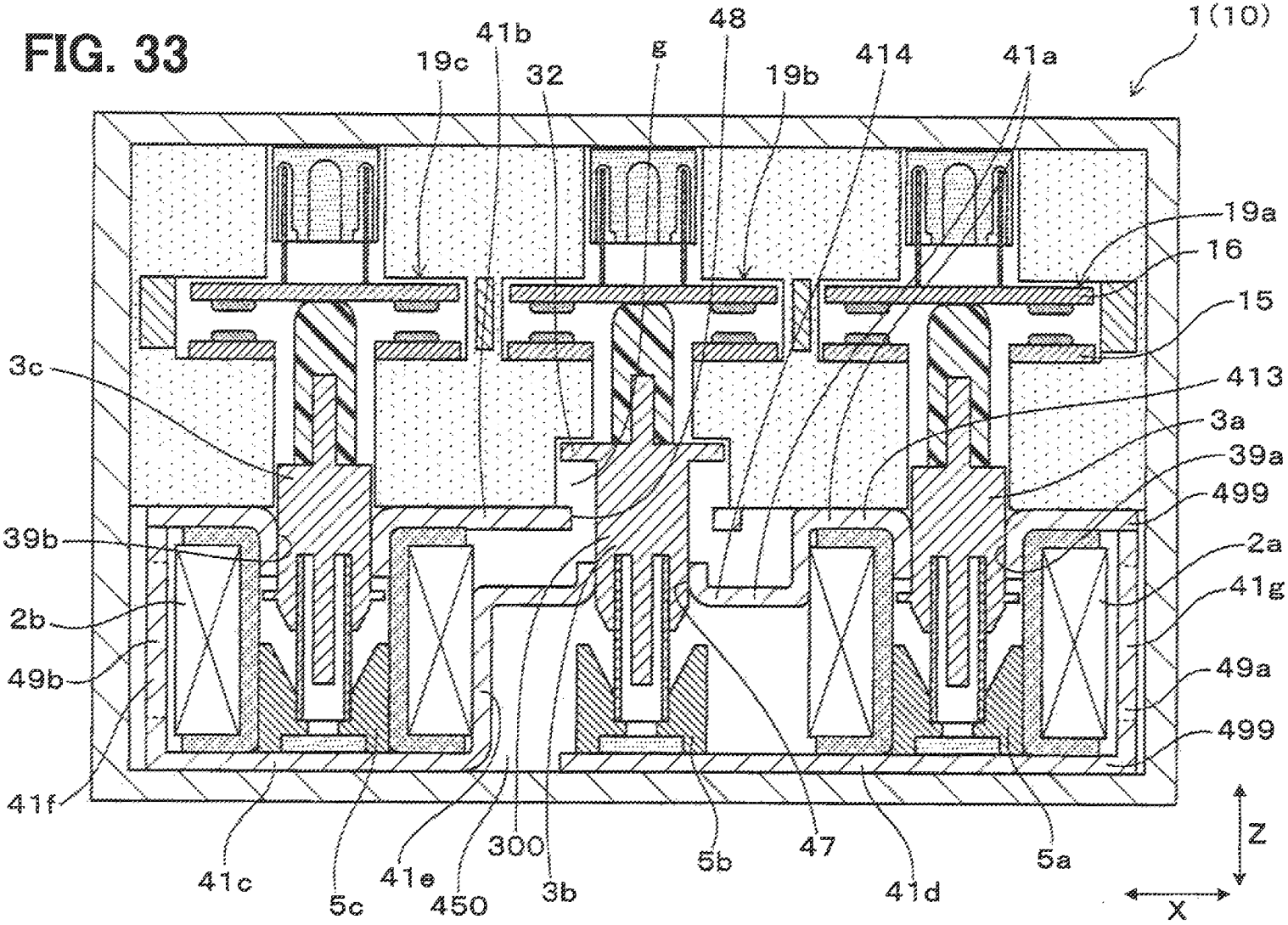
FIG. 33 is a diagram showing a cross section of an electromagnetic relay in an off state in a twelfth embodiment.

In twelfth embodiment, the number of the plungers 3 and the shape of the yoke 4 are changed. The solenoid device of the embodiment has three plungers 3*a* to 3*c* in a manner similar to the second embodiment as illustrated in FIG. 33. The second plunger 3*b* has the body 300 attracted by the second fixed core 5*b* and the diameter-enlarged part 32 whose diameter is larger than the body 300. The body 300 and the diameter-enlarged part 32 are made of soft magnetic material.

The yoke 4 has the first part 41*a* and the second part 41*b*. In the first part 41*a*, the two through holes 39*a* and 47 are formed. The plungers 3*a* and 3*b* are inserted in the through holes 39*a* and 47. When the plungers 3*a* and 3*b* move forward/backward, the plungers 3*a* and 3*b* slide-contact with the inner peripheral face of the through holes 39*a* and 47. The first part 41*a* is formed in a step shape. A part 414 in which the through hole 47 for the second plunger 3*b* in the first part 41*a* is formed is positioned on the side closer, in the Z direction, to a fourth part 41*d* than a part 413 in which the through hole 39*a* for the first plunger 3*a* is formed.

The second part 41*b* of the yoke 4 is apart from the first part 41*a*. In the second part 41*b*, the two through holes 48 and 39*b* are formed. The plungers 3*b* and 3*c* are inserted in the through holes 48 and 39*b*. When the third plunger 3*c* moves forward/backward, the third plunger 3*c* slide-contacts with the inner peripheral face of the through hole 39*b*. The inside diameter of the through hole 48 for the second plunger 3*b* is larger than the outside diameter of the body 300 and smaller than the outside diameter of the diameter-enlarged part 32.

The yoke 4 has a third part 41*c* and a fourth part 41*d*. The third part 41*c* is magnetically connected to the third fixed core 5*c*. The fourth part 41*d* is magnetically connected to the second fixed core 5*b* and the first fixed core 5*a*. A notch 450 for suppressing flow of the magnetic flux Φ between the third and fourth parts 41*c* and 41*d* is formed between the third and fourth parts 41*c* and 41*d*.

The yoke 4 also has a fifth part 41*e*, a sixth part 41*f*, and a seventh part 41*g*. The fifth part 41*e* connects the first part 41*a* and the third part 41*c*. The sixth part 41*f* connects the second and third parts 41*b* and 41*c*. The seventh part 41*g* couples the first and fourth parts 41*a* and 41*d* at an end 499 on the first plunger 3*a* side in the X direction.

Figure 34:
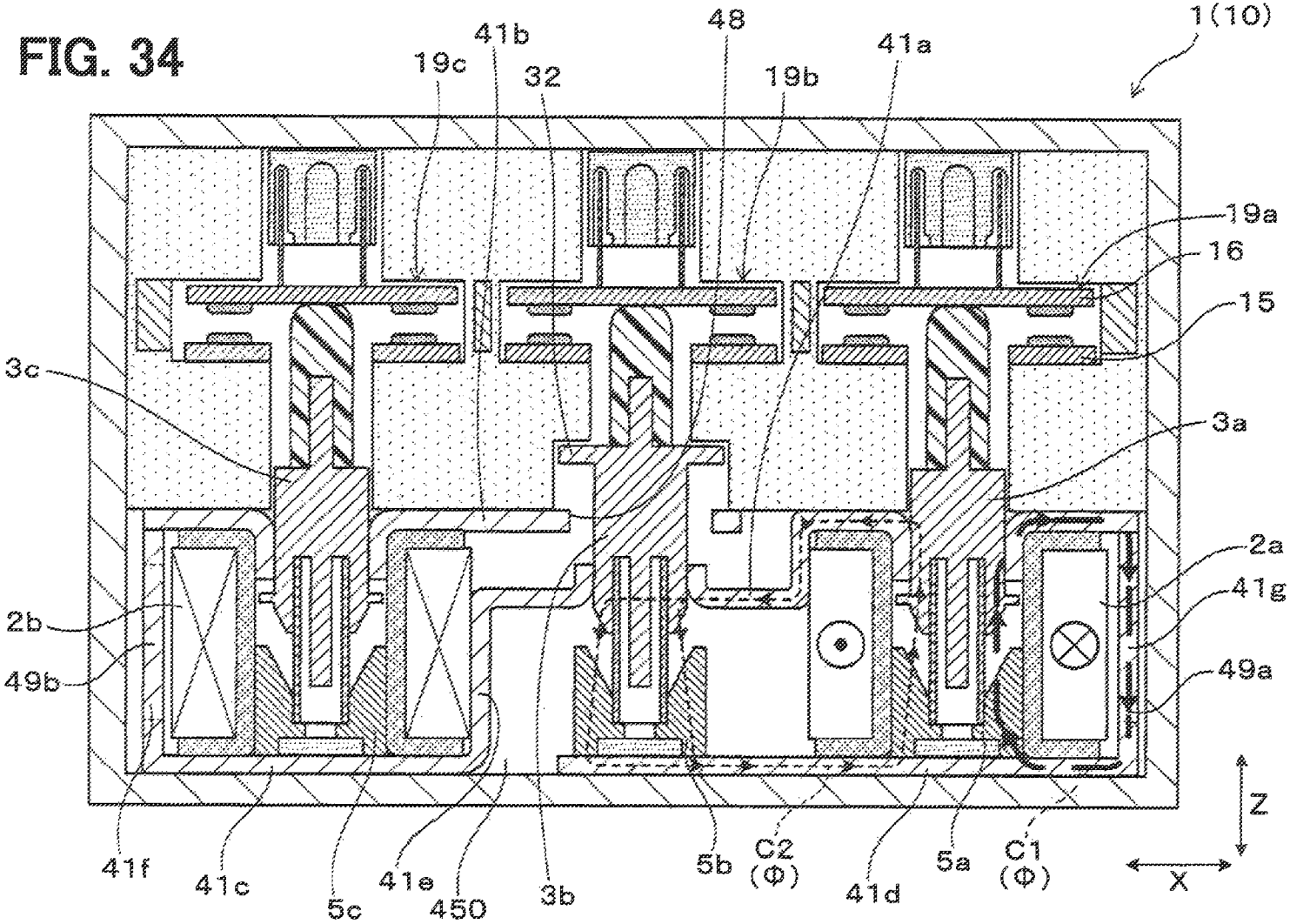
FIG. 34 is a diagram showing a diagram for explaining the order of operations of the electromagnetic relay and a path of magnetic flux in the twelfth embodiment.
Figure 35:
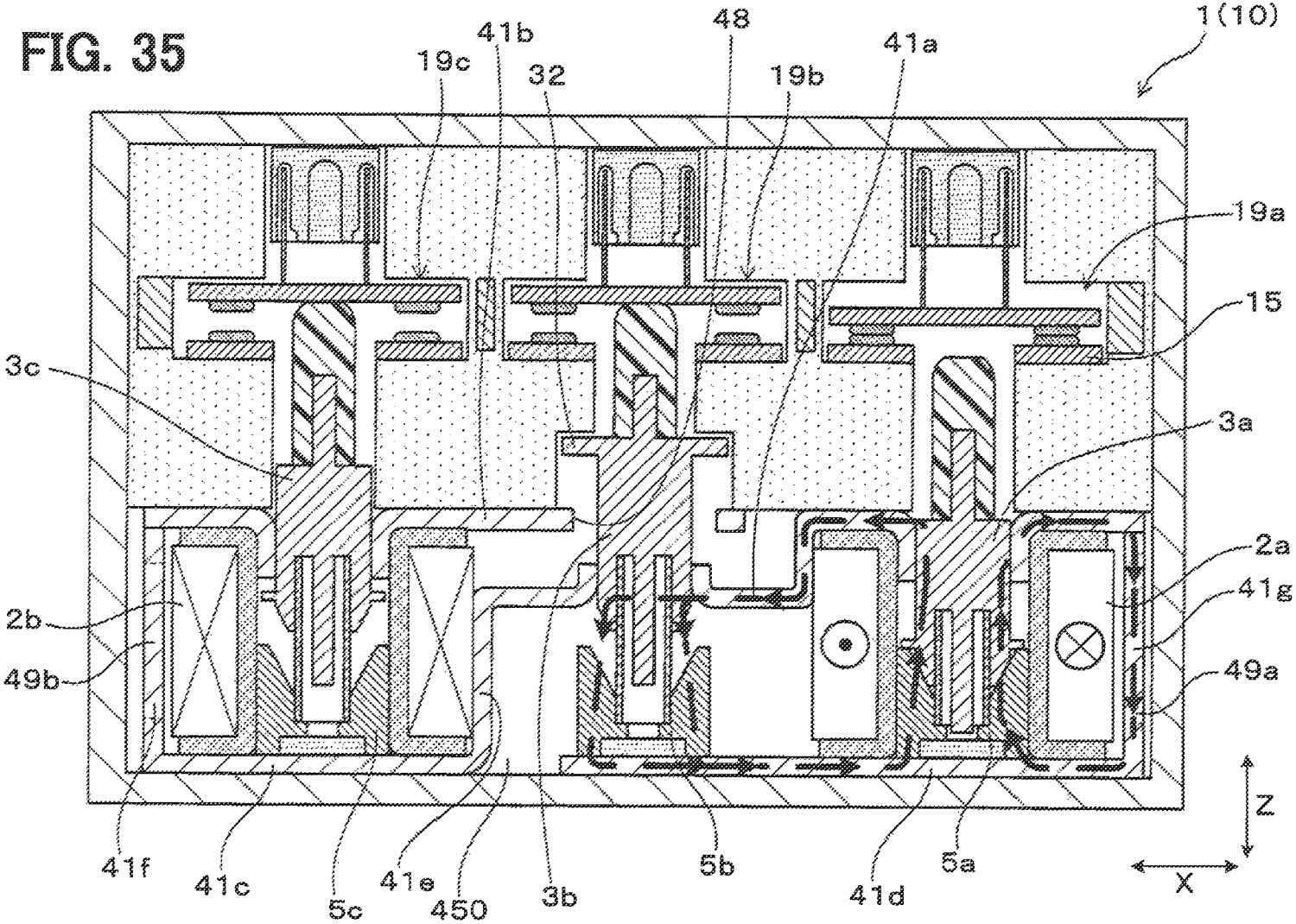
FIG. 35 is a diagram showing a diagram continued from FIG. 34.
Figure 36:
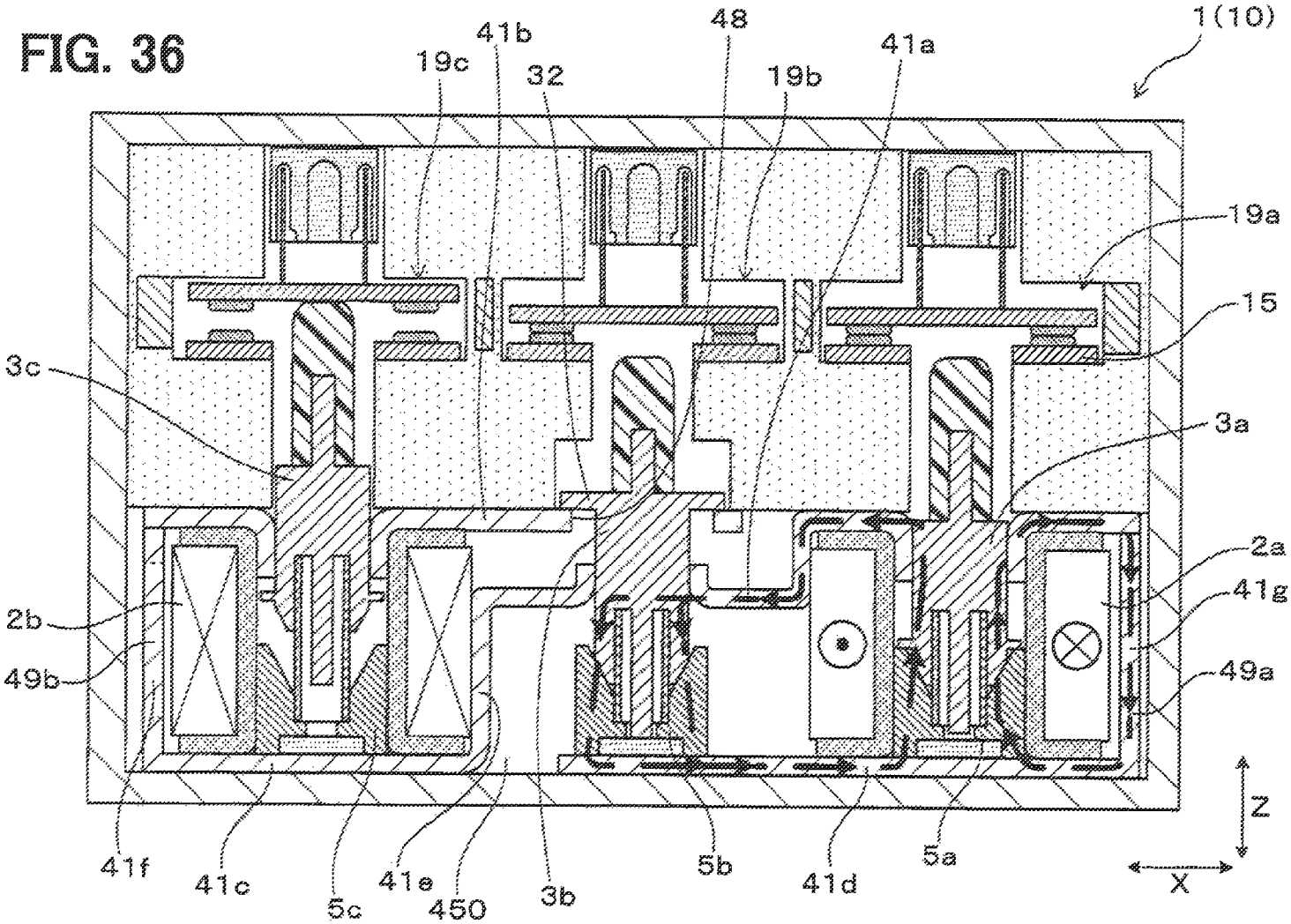
FIG. 36 is a diagram showing a diagram continued from FIG. 35.

As illustrated in FIG. 34, when current is passed to the first electromagnetic coil 2*a*, a part of the magnetic flux Φ flows in the first magnetic circuit C1 made by the first plunger 3*a*, a part of the yoke 4 (the first, seventh, and fourth parts 41*a*, 41*g*, and 41*d*), and the first fixed core 5*a*. Another part of the magnetic flux Φ flows in the second magnetic circuit C2 made by the first plunger 3*a*, the first part 41*a*, the second plunger 3*b*, the second fixed core 5*b*, the fourth part 41*d*, and the first fixed core 5*a*. As illustrated in FIGS. 34 to 36, the first plunger 3*a* is attracted by the first fixed core 5*a*, and the second plunger 3*b* is attracted by the second fixed core 5*b*.

To pass the stable magnetic flux Φ to the second magnetic circuit C2 at this time, it is important to magnetically saturate the first plunger 3*a* in the state of FIG. 35. It is therefore desirable to design so that any part of the yoke 4 (the first part 41*a*, the seventh part 41*g*, and the fourth part 41*d*) in the first magnetic circuit C1 magnetically saturates before the first plunger 3*a*.

As illustrated in FIG. 36, in a state where the second plunger 3*b* is attracted (attraction state), the diameter-enlarged part 32 comes close to the second part 41*b*. That is, the diameter-enlarged part 32 comes into contact with the peripheral part of the through hole 48. As illustrated in FIG. 34, in a state where the second plunger 3*b* is not attracted by the second fixed core 5*b* (no-attraction state), the diameter-enlarged part 32 is apart from the second part 41*b*, and the shortest distance from the second plunger 3*b* to the second part 41*b* becomes longer than that in the attraction state (refer to FIG. 36).

Figure 37:
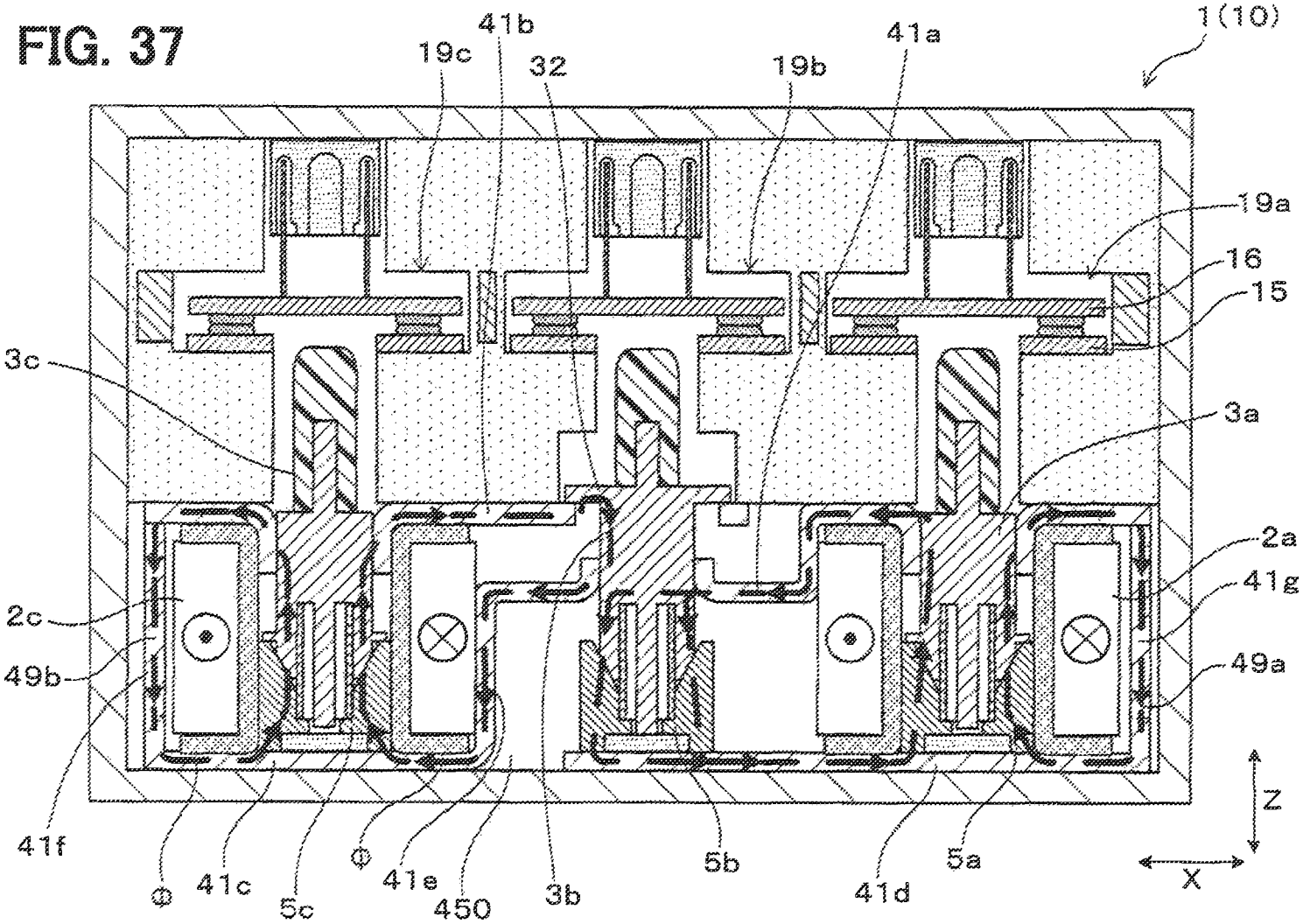
FIG. 37 is a diagram showing a diagram continued from FIG. 36.

When current is passed to the second electromagnetic coil 2*b* after attracting the first and second plungers 3*a* and 3*b* (refer to FIG. 36), the magnetic flux Φ is generated as illustrated in FIG. 37. A part of the magnetic flux Φ of the second electromagnetic coil 2*b* flows in the third plunger 3*c*, the second part 41*b*, the sixth part 41*f*, the third part 41*c*, and the third fixed core 5*c*. By the magnetic force generated, the third plunger 3*c* is attracted by the third fixed core 5*c*. Another part of the magnetic flux Φ of the second electromagnetic coil 2*b* flows in the third plunger 3*c*, the second part 41*b*, the diameter-enlarged part 32, the second plunger 3*b*, the first part 41*a*, the fifth part 41*e*, the third part 41*c*, and the third fixed core 5*c*. By the magnetic force generated, the diameter-enlarged part 32 is attracted by the second part 41*b*.

The direction of the passage of current in the second electromagnetic coil 2*b* may be opposite.

Figure 38:
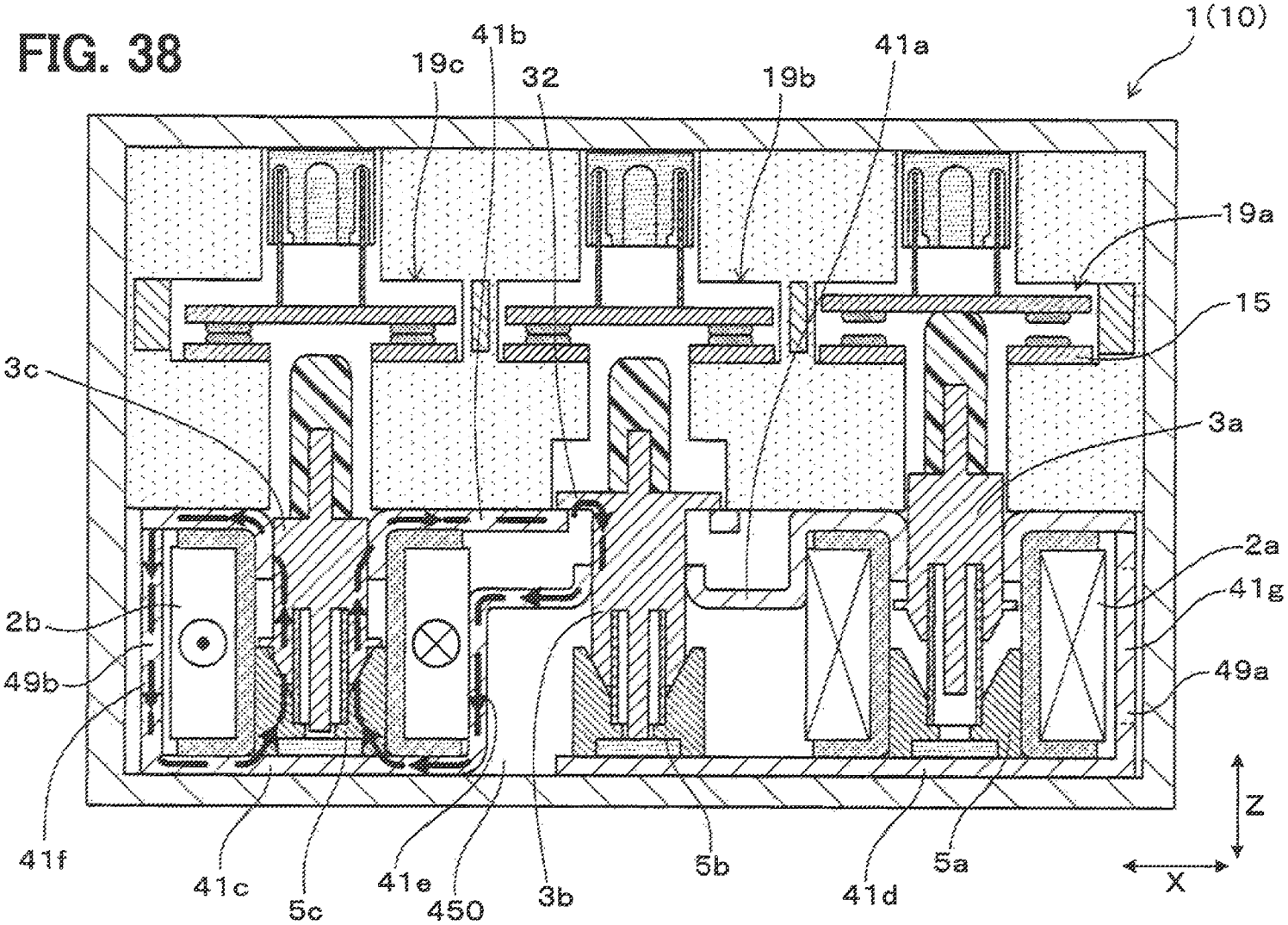
FIG. 38 is a diagram showing a diagram continued from FIG. 37.

After that, as illustrated in FIG. 38, when the passage of current to the first electromagnetic coil 2*a* is stopped, the magnetic flux Φ of the first electromagnetic coil 2*a* disappears, and attraction of the first plunger 3*a* is cancelled. However, since the magnetic flux Φ of the second electromagnetic coil 2*b* continues to flow between the second part 41*b* and the diameter-enlarged part 32, the diameter-enlarged part 32 is continuously attracted by the second part 41*b*.

The operation and effect of the embodiment will be described. In the embodiment, since the notch 450 is formed between the third and fourth parts 41*c* and 41*d*, the magnetic flux Φ does not easily flow between the third and fourth parts 41*c* and 41*d*. Consequently, if current is passed to the first electromagnetic coil 2*a* in a state where the second plunger 3*b* is not attracted (refer to FIGS. 34 and 34), it can suppress that the magnetic flux Φ generated flows from the second plunger 3*b* to the second part 41*b* and, further, to the fourth part 41*d* via the sixth part 41*f* and the third part 41*c*. Therefore, the magnetic flux Φ of the first electromagnetic coil 2*a* flows in the second plunger 3*b* more easily, and the second plunger 3*b* can be attracted by the strong magnetic force (refer to FIGS. 35 and 36).

Since no magnetomotive force exists between the first part 41*a* and the second part 41*b*, as illustrated in FIG. 36, the magnetic flux Φ of the first electromagnetic coil 2*a* hardly flows in the magnetic circuit made by the first part 41*a*, the second plunger 3*b*, the second part 41*b*, the sixth part 41*f*, the third part 41*c*, and the fifth part 41*e*.

As illustrated in FIGS. 37 and 38, since the notch 450 is formed in the embodiment, when current is passed to the second electromagnetic coil 2*b*, flow of the magnetic flux Φ of the second electromagnetic coil 2*b* between the third part 41*c* and the fourth part 41*d* is disturbed. Accordingly, the magnetic flux Φ of the second electromagnetic coil 2*b* does not easily flow in the magnetic circuit made by the first part 41*a*, the first plunger 3*a*, the first fixed core 5*a*, the fourth part 41*d*, and the third part 41*c*. Therefore, when the passage of current to the first electromagnetic coil 2*a* is stopped, the first plunger 3*a* is not continuously attracted by the magnetic flux Φ of the second electromagnetic coil 2*b*, and the attraction of the first plunger 3*a* can be smoothly cancelled.

The solenoid device 1 of the embodiment is constructed so that, as illustrated in FIGS. 36 and 37, the shortest distance from the second plunger 3*b* to the second part 41*b* in the state where the second plunger 3*b* is attracted (attraction state) is shorter than that in the no-attraction state (refer to FIG. 35). Consequently, in the attraction state, the magnetic resistance between the second plunger 3*b* and the second part 41*b* can be made low, so that the magnetic flux Φ generated by the passage of current to the second electromagnetic coil 2*b* flows more easily in the second plunger 3*b*. Therefore, as illustrated in FIG. 38, when the passage of current to the first electromagnetic coil 2*a* is stopped, the second plunger 3*b* can be reliably attracted by the magnetic flux Φ of the second electromagnetic coil 2*b*.

Although the diameter-enlarged part 32 of the second plunger 3 is in contact with the second part 41*b* in the attraction state as illustrated in FIG. 36 in the embodiment, they may be slightly apart from each other.

The electromagnetic relay 10 of the embodiment is used for the circuit illustrated in FIG. 13. When current is passed to the first electromagnetic coil 2*a*, the first and second switches 19*a* and 19*b* are turned on (refer to FIGS. 34 to 36). Current can be gradually passed via the precharge resistor 62 (refer to FIG. 13) to charge the smoothing capacitor 61. When current is passed to the second electromagnetic coil 2*b* after completion of the charging (refer to FIG. 37), the third switch 19*c* is turned on. After that, when the passage of current to the first electromagnetic coil 2*a* is stopped (refer to FIG. 38), while setting the second and third switches 19*b* and 19*c* in the on state by the magnetic force generated by the magnetic flux Φ of the second electromagnetic coil 2*b*, the first switch 19*a* can be turned off. In this state, power can be supplied to the electronic device 63. Although the state of supplying power to the electronic device 63 lasts relatively long, since current is passed only to the electromagnetic coil 2 (the second electromagnetic coil 2*b*) as one of the two electromagnetic coils 2*a* and 2*b*, the power consumption in the electromagnetic coils 2 can be reduced to the half of that in the case of passing current to both of the two electromagnetic coils 2*a* and 2*b*.

As described above, in the embodiment, by passing current to the first electromagnetic coil 2*a*, the first and second plungers 3*a* and 3*b* can be reliably attracted (refer to FIG. 36). After that, by passing current to the second electromagnetic coil 2*b* to stop the passage of current to the first electromagnetic coil 2*a*, only the second and third plungers 3*b* and 3*c* can be reliably attracted (refer to FIG. 38).

In the embodiment, in the case of passing current to the second electromagnetic coil 2*b* before the first electromagnetic coil 2*a*, since the second plunger 3*b* is in the no-attraction state, the magnetic resistance between the second part 41*b* and the second plunger 3*b* is high. Due to this, flow of the magnetic flux Φ generated by the second electromagnetic coil 2*b* into the second plunger 3*b* is suppressed. Therefore, the second plunger 3*b* is not attracted, and only the third plunger 3*c* can be attracted.

Although the third and fourth parts 41*c* and 41*d* are completely apart from each other in the notch 450 in the embodiment, the third and fourth parts 41*c* and 41*d* may be magnetically slightly connected to each other.

The rest is similar to the second embodiment. Unless otherwise described, the same reference numerals as those used in the second embodiment in the reference numerals used for the drawings related to the embodiment refer to components similar to those of the second embodiment.

Thirteenth Embodiment

Figure 39:
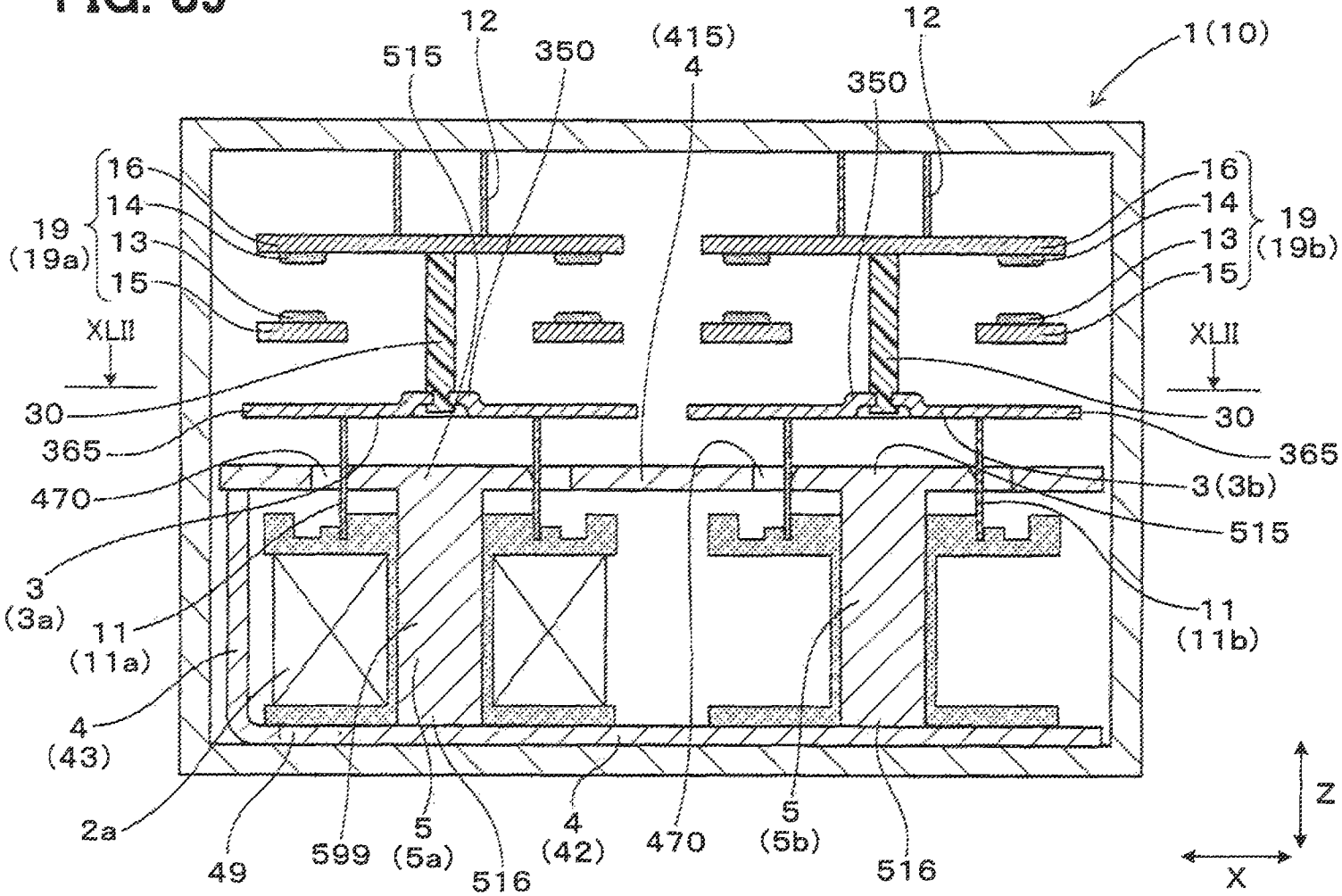
FIG. 39 is a diagram showing a cross section of an electromagnetic relay in an off state in a thirteenth embodiment.

In a thirteenth embodiment, the shape of the plunger 3 and the shape of the fixed core 5 are changed. As illustrated in FIG. 39, each of the first and second plungers 3*a* and 3*b* of the embodiment is formed in a plate shape. The plunger 3 moves forward/backward in the plate thickness directions (Z directions). In the embodiment, each of the fixed cores 5 (5*a* and 5*b*) is formed in a pillar shape. The first fixed core 5*a* is disposed in the center of the first electromagnetic coil 2*a*, and its one end 515 is opposed to the center 350 of the first plunger 3*a*. The diameter of the one end 515 of the first fixed core 5*a* is larger than a part 599 disposed in the center of the first electromagnetic coil 2*a*.

The yoke 4 is formed by a contact/separate yoke 415 to/from which the plunger 3 comes into contact/is apart, the bottom yoke 42, and the side-wall yoke 43 connecting the bottom yoke 42 and the contact/separate yoke 415. A through hole 470 is formed in the contact/separate yoke 415. The other end 516 of the fixed core 5 is in contact with the bottom yoke 42. The bottom yoke 42 is provided with the magnetic saturation part 49.

Figure 41:
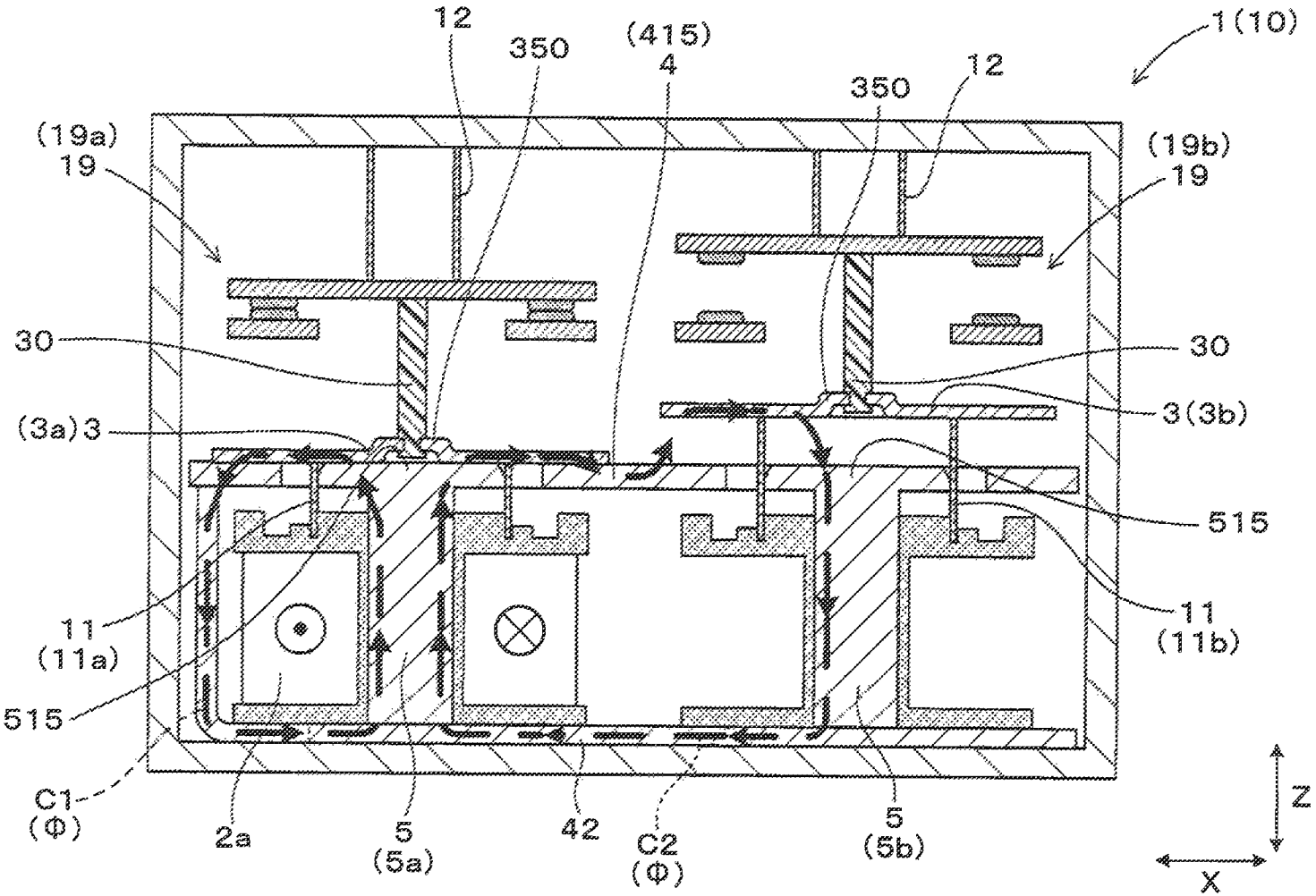
FIG. 41 is a diagram continued from FIG. 40.
Figure 42:
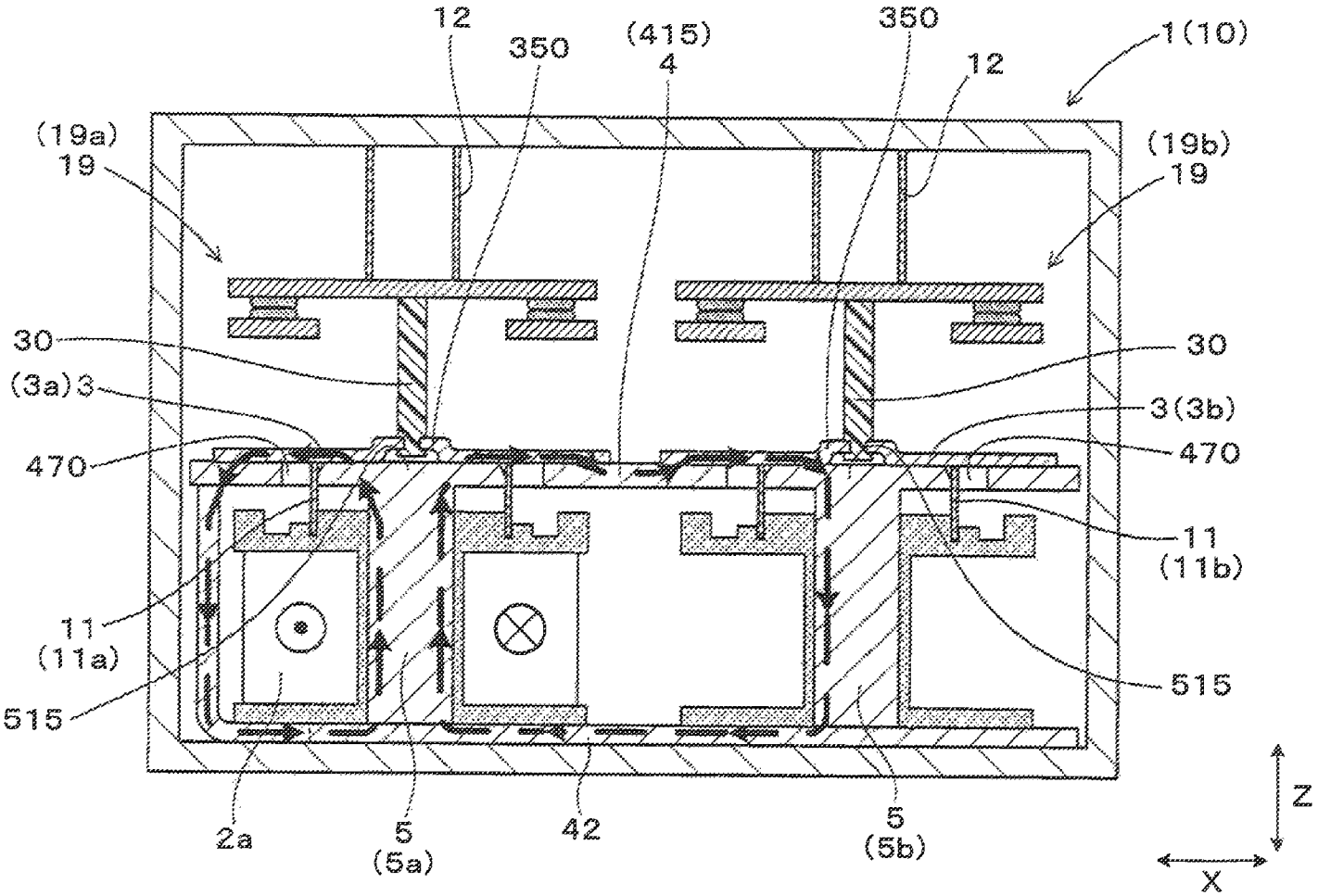
FIG. 42 is a diagram continued from FIG. 41.
Figure 43:
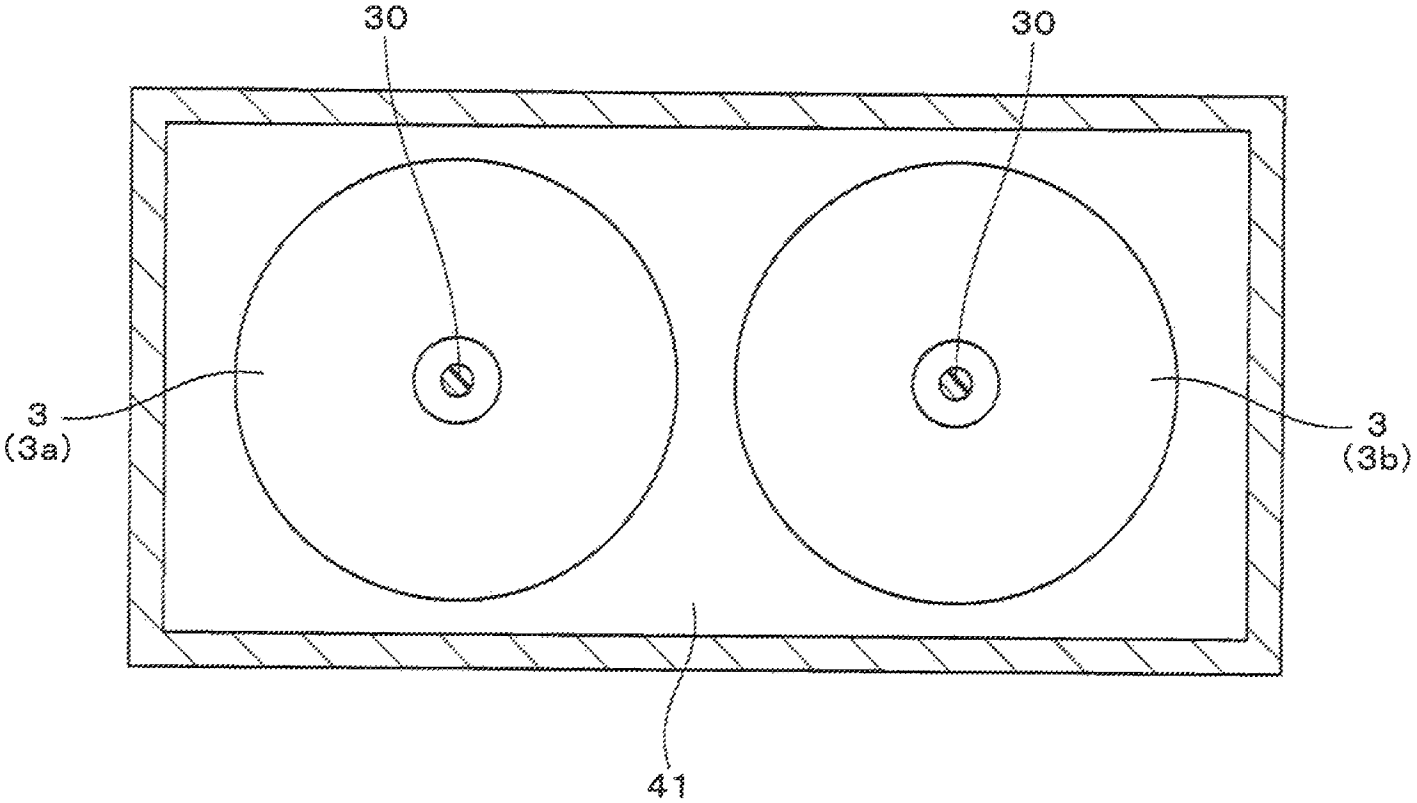
FIG. 43 is a diagram showing a cross section taken along line XLII-XLII of FIG. 39.

As illustrated in FIG. 43, the plunger 3 has a disc shape. As illustrated in FIGS. 41 and 42, when the plunger 3 moves forward/backward, the outer periphery 365 of the plunger 3 comes into contact with/is apart from the surface of the contact/separate yoke 415, and the center 350 of the plunger 3 comes into contact with/is apart from the surface of the one end 515 of the fixed core 5.

Figure 40:
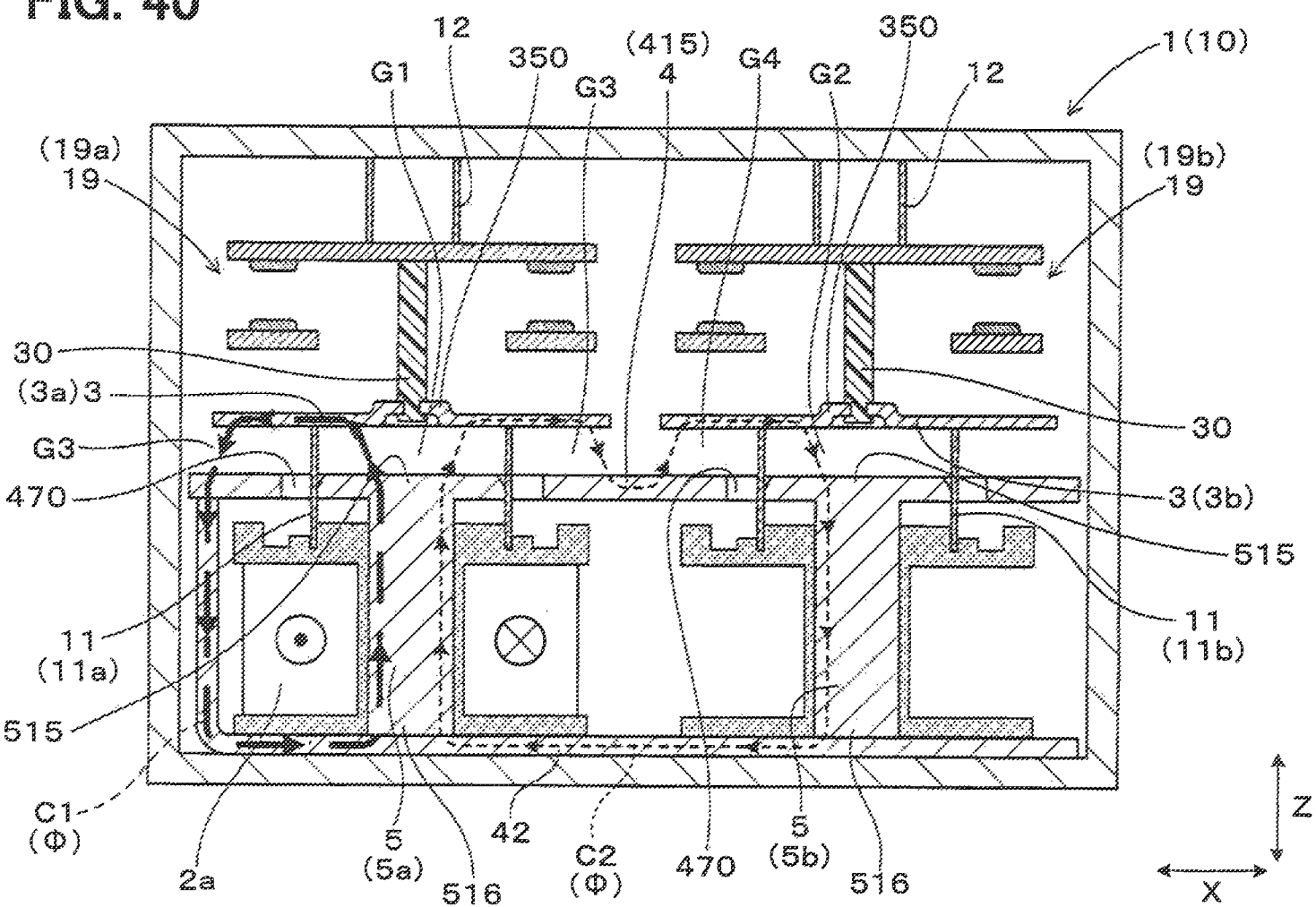
FIG. 40 is a diagram for explaining the order of operations of the electromagnetic relay and a path of magnetic flux in the thirteenth embodiment.

As illustrated in FIG. 40, when the first electromagnetic coil 2*a* is set to the current passage state, the magnetic flux Φ is generated. A part of the magnetic flux Φ flows in the first magnetic circuit C1 made by the first fixed core 5*a*, the first plunger 3*a*, and the yoke 4. Another part of the magnetic flux Φ flows in the second magnetic circuit C2 made by the first fixed core 5*a*, the first plunger 3*a*, the contact/separate yoke 415, the second plunger 3*b*, the second fixed core 5*b*, and the bottom yoke 42.

As illustrated in FIG. 40, at the time of switching the first electromagnetic coil 2*a* from the no-current passage state to the current passage state, the magnetic flux Φ flowing in the first magnetic circuit C1 flows in the first gap G1 between the first fixed core 5*a* and the first plunger 3*a* and the third gap G3 between the first plunger 3*a* and the contact/separate yoke 415. The magnetic flux Φ flowing in the second magnetic circuit C2 flows in the above-described two gaps G1 and G3 and, in addition, a fourth gap G4 between the contact/separate yoke 415 and the second plunger 3*b* and a second gap G2 between the second plunger 3*b* and the second fixed core 5*b*. Since the number of gaps in the first magnetic circuit C1 is smaller than that in the second magnetic circuit C2, strong magnetic flux Φ flows in the first magnetic circuit C1. Consequently, as illustrated in FIG. 41, the first plunger 3*a* is attracted first. When the first plunger 3*a* is attracted, the gaps G1 and G3 disappear, the magnetic resistance of the second magnetic circuit C2 decreases, and the large amount of the magnetic flux Φ flows in the second magnetic circuit C2. As a result, as illustrated in FIG. 42, the second plunger 3*b* is attracted.

The operation and effect of the embodiment will be described. In the embodiment, the plunger 3 does not slide-contact with the yoke 4 in its forward/backward moving operation. Consequently, abrasion of the plunger 3 can be suppressed. In the case where the plunger 3 slide-contacts with the yoke 4, to prevent abrasion of the plunger 3, a thin film made of solid lubricant or the like is often formed on the surface of the plunger 3. However, by preventing the plunger 3 from coming into slide-contact with the yoke 4 like in the embodiment, it becomes unnecessary to form a thin film made of solid lubricant. It can reduce the manufacture cost of the plunger 3.

The rest is similar to the first embodiment. The same reference numerals used in the first embodiment in the reference numerals used for the drawings related to the embodiment refer to components similar to those of the first embodiment.

Fourteenth Embodiment

Figure 44:
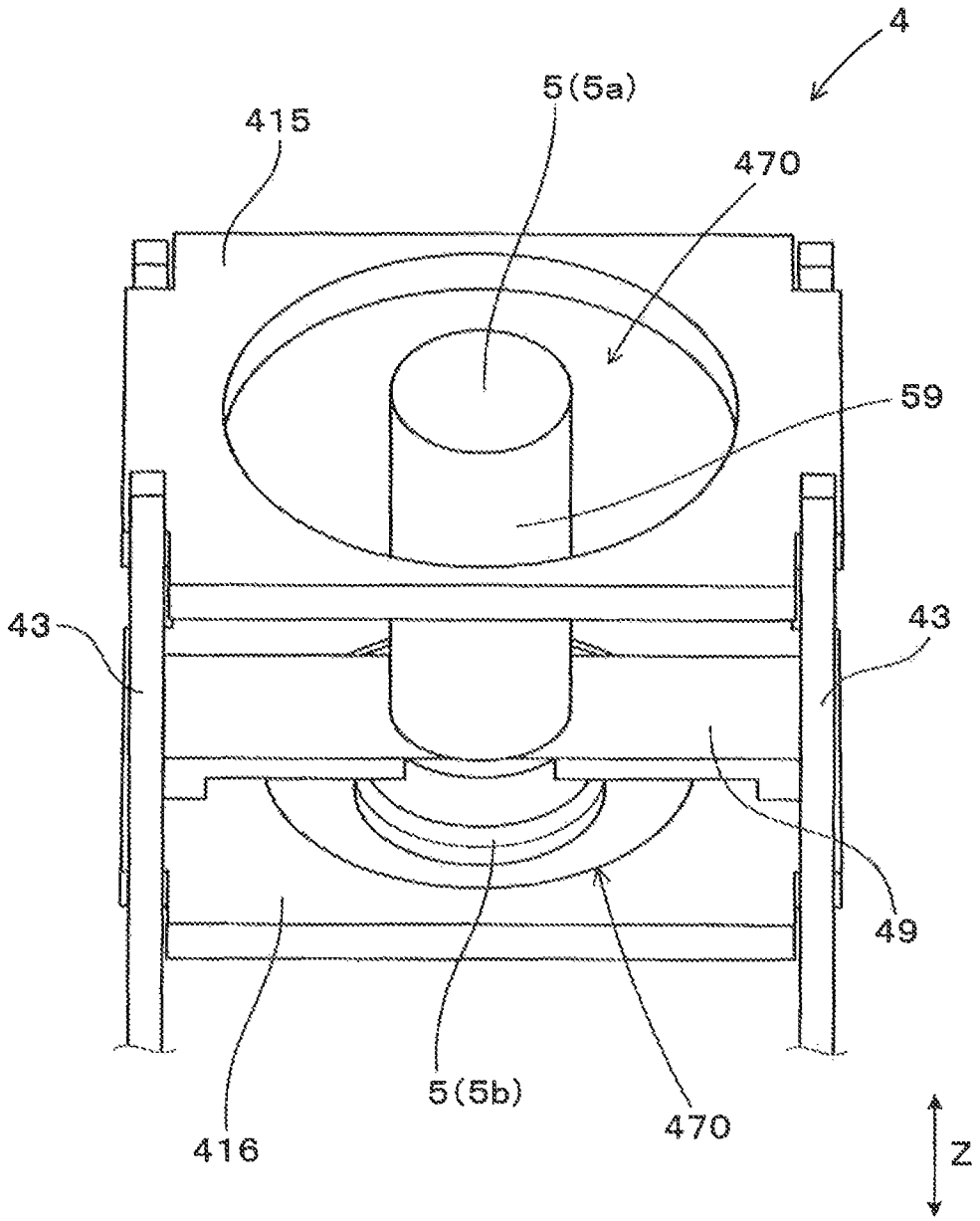
FIG. 44 is a diagram showing a perspective view of a yoke and a fixed core in a fourteenth embodiment.
Figure 45:
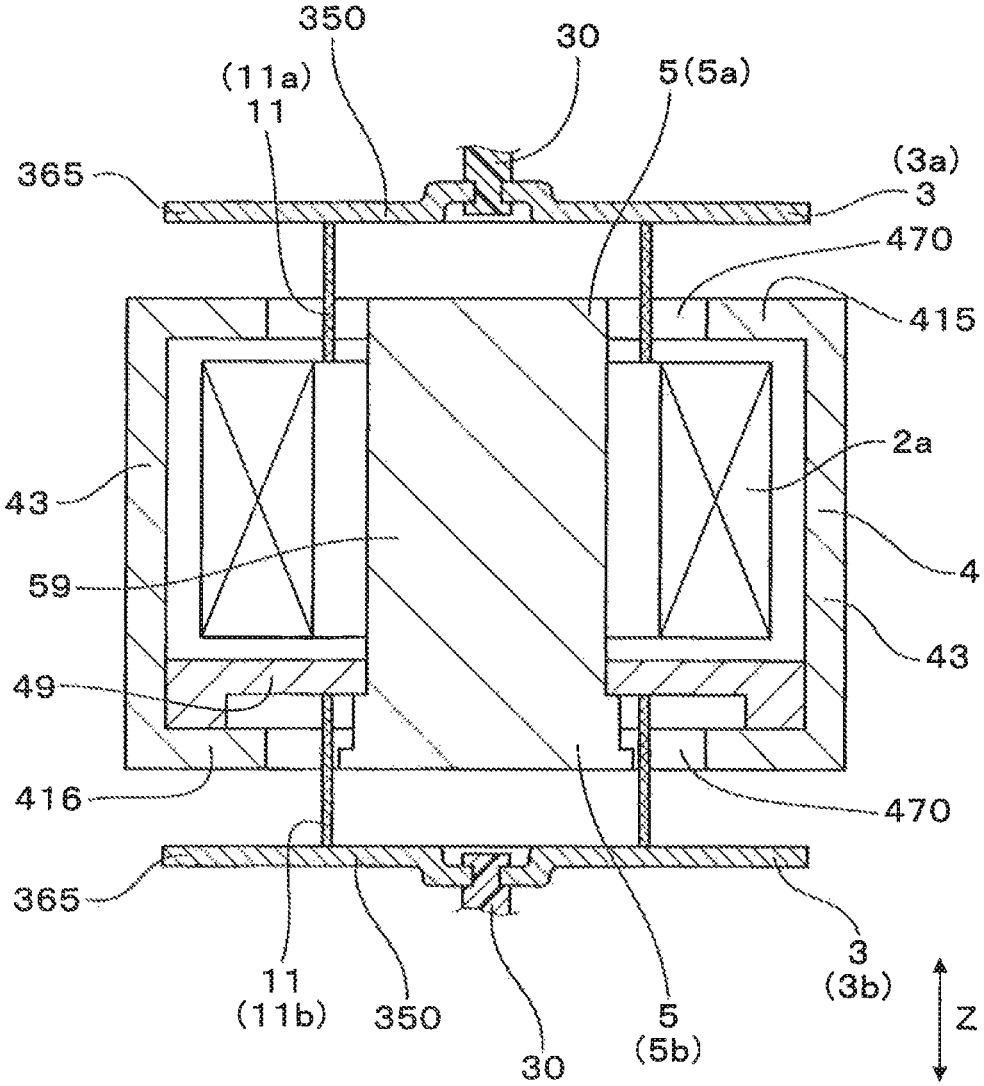
FIG. 45 is a diagram showing an enlarged cross section of a main part of the electromagnetic relay in the fourteenth embodiment.

In a fourteenth embodiment, the shape of the yoke 4 and the shape of the plunger 3 are changed. As illustrated in FIGS. 44 and 45, the yoke 4 of the embodiment has two contact/separate yokes 415 and 416 which are parallel to each other and two side-wall yokes 43. The first electromagnetic coil 2*a* is provided in the yoke 4. In each of the contact/separate yokes 415 and 416, in a manner similar to the thirteenth embodiment, the through hole 470 which penetrates in the Z direction is formed.

In the center of the first electromagnetic coil 2*a*, a pillar-shaped core 59 in which the first and second fixed cores 5*a* and 5*b* are integrated is provided. One end part of the pillar-shaped core 59 serves as the first fixed core 5*a*, and the other end part of the pillar-shaped core 59 serves as the second fixed core 5*b*.

The second fixed core 5*b* and the side-wall yoke 43 are connected to each other via the magnetic saturation part 49. The minimum cross area of the magnetic saturation part 49 is smaller than that of the side-wall yoke 43 or the pillar-shaped core 59. When current is passed to the first electromagnetic coil 2*a* and the first plunger 3*a* is attracted, the magnetic saturation part 49 magnetically saturates.

As illustrated in FIG. 45, each of the two plungers 3 (3*a* and 3*b*) has a plate shape. The first plunger 3*a* is provided on one of the sides in the axial direction (Z direction) of the pillar-shaped core 59 for the first electromagnetic coil 2*a*. The second plunger 3*b* is provided on the other side in the Z direction for the first electromagnetic coil 2*a*.

Figure 47:
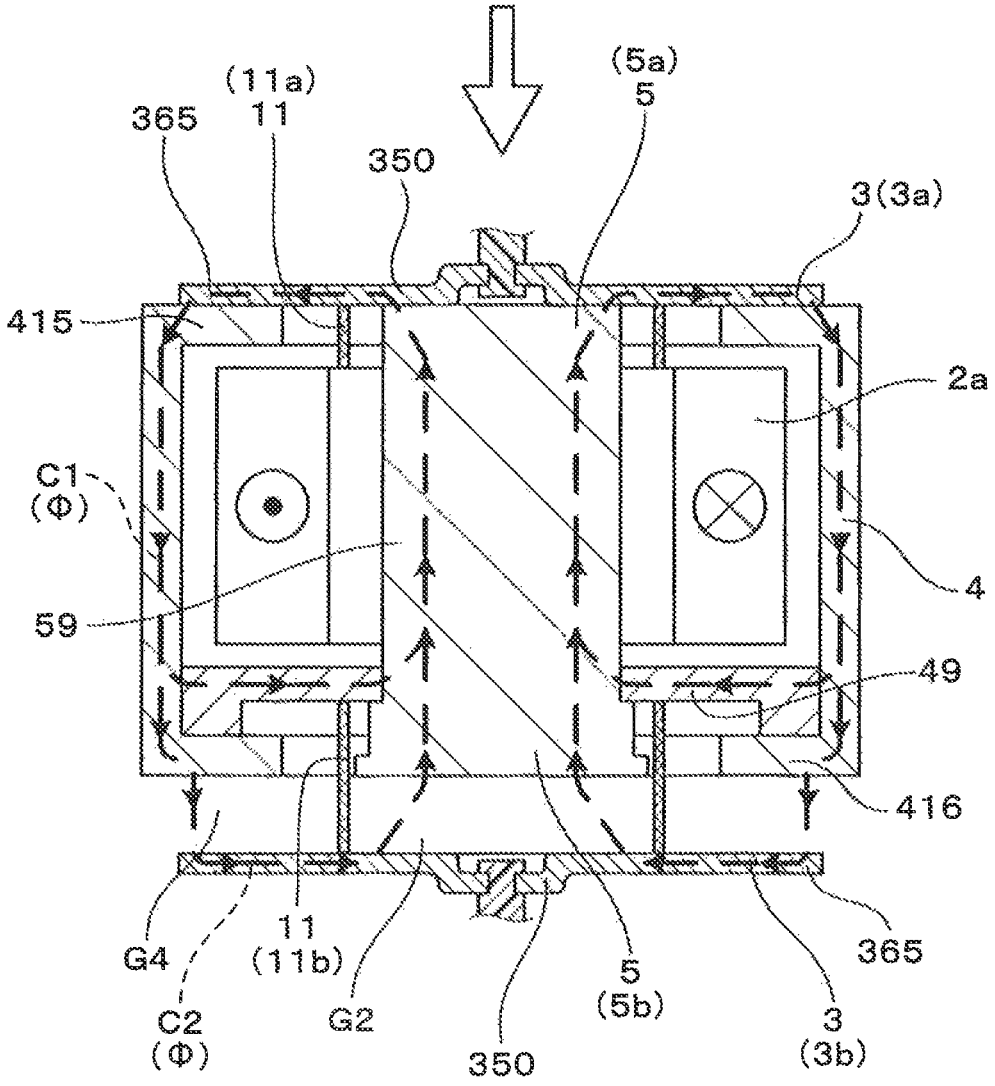
FIG. 47 is a diagram continued from FIG. 46.
Figure 48:
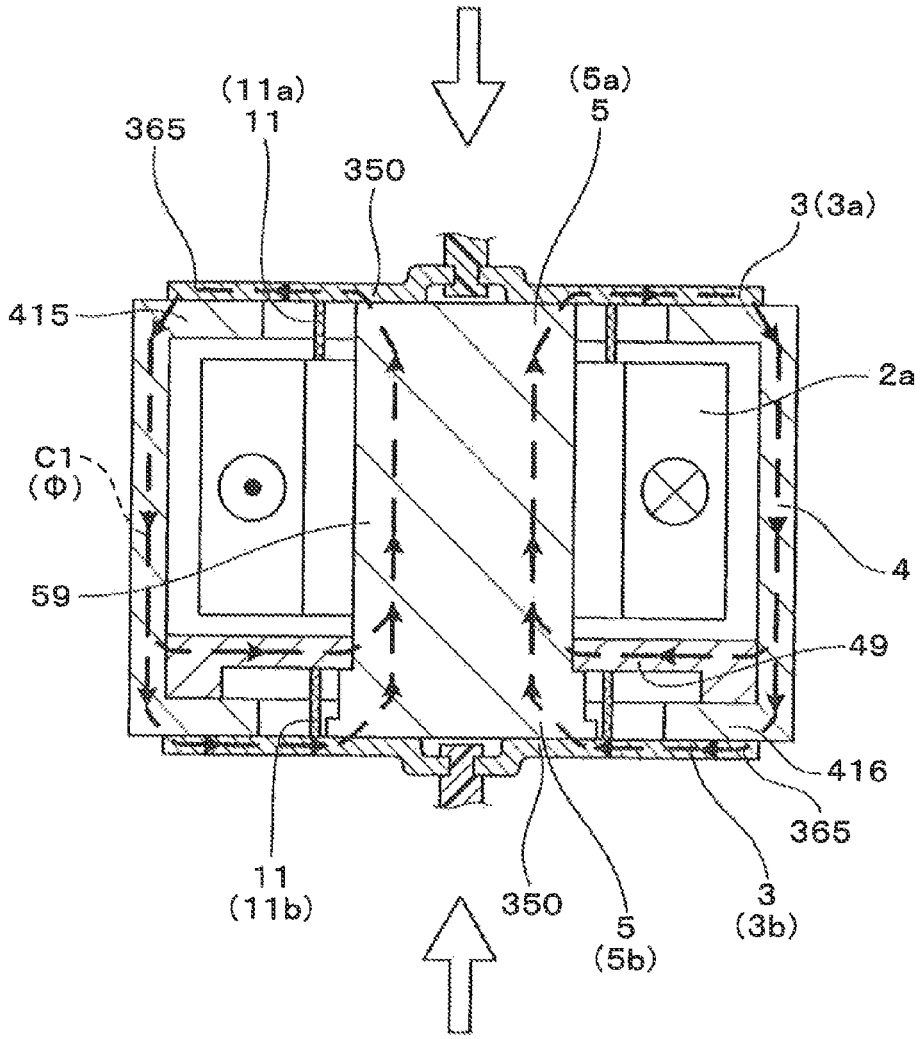
FIG. 48 is a diagram continued from FIG. 47.

As illustrated in FIGS. 47 and 48, the center 350 of the plunger 3 is attracted by the fixed core 5. When the plunger 3 performs the forward/backward moving operation, the outer periphery 365 of the plunger 3 comes into contact with/is apart from the surface of the contact/separate yokes 415 and 416.

Figure 46:
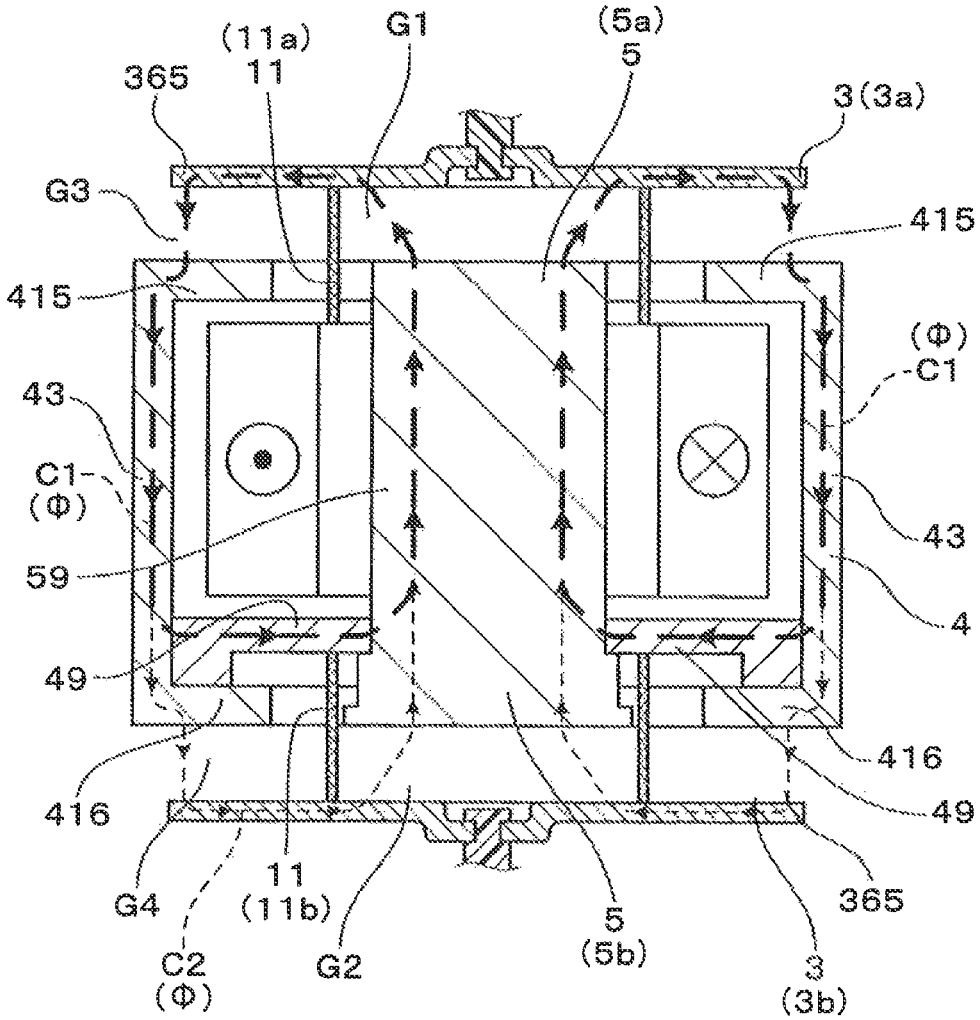
FIG. 46 is a diagram for explaining the order of operations of the electromagnetic relay and a path of magnetic flux in the fourteenth embodiment.

As illustrated in FIG. 46, when the first electromagnetic coil 2*a* is set to the current passage state, the magnetic flux Φ is generated. A part of the magnetic flux Φ flows in the first magnetic circuit C1 made by the pillar-shaped core 59, the first plunger 3*a*, the contact/separate yoke 415, the side-wall yoke 43, and the magnetic saturation part 49. Another part of the magnetic flux Φ flows in the second magnetic circuit C2 made by the pillar-shaped core 59, the first plunger 3*a*, the contact/separate yoke 415, the side-wall yoke 43, the other contact/separate yoke 416, and the second plunger 3*b*.

The magnetic flux Φ flowing in the first magnetic circuit C1 passes through the first gap G1 between the first fixed core 5*a* and the first plunger 3*a* and the third gap G3 between the first plunger 3*a* and the contact/separate yoke 415. The magnetic flux Φ flowing in the second magnetic circuit C2 passes through the above-described two gaps G1 and G3 and, in addition, the fourth gap G4 between the other contact/separate yoke 416 and the second plunger 3*b* and the second gap G2 between the second plunger 3*b* and the second fixed core 5*b*. The number of gaps in the first magnetic circuit C1 is smaller than that in the second magnetic circuit C2. Consequently, the amount of the magnetic flux Φ flowing in the first magnetic circuit C1 is large and the amount of the magnetic flux Φ flowing in the second magnetic circuit C2 is small. Therefore, strong magnetic force is generated in the first plunger 3*a* and, as illustrated in FIG. 47, the first plunger 3*a* is attracted first.

When the first plunger 3*a* is attracted, the gaps G1 and G3 disappear, and the magnetic resistance decreases. Due to this, the amount of the magnetic flux Φ flowing in the first magnetic circuit C1 increases. Since the magnetic flux Φ of the first magnetic circuit C1 passes through the magnetic saturation part 49, after the magnetic flux Φ increases, magnetic saturation occurs in the magnetic saturation part 49. Therefore, by the magnetic saturation part 49, the amount of the magnetic flux Φ flowing in the first magnetic circuit C1 is regulated and, instead, the amount of the magnetic flux Φ in the second magnetic circuit C2 increases. As a result, the magnetic force generated in the second plunger 3*b* increases and, as illustrated in FIG. 48, the second plunger 3*b* is attracted by the second fixed core 5*b*.

The operation and effect of the embodiment will be described. Since the first and second fixed cores 5*a* and 5*b* are integrated, as compared with the case where the first and second fixed cores 5*a* and 5*b* are separately formed, the core 5 can be miniaturized. In addition, the number of components can be decreased, so that the manufacture cost of the solenoid device 1 can be reduced.

In the embodiment, since the magnetic saturation part 49 is provided in the first magnetic circuit C1, even when the first plunger 3*a* is attracted and the magnetic flux Φ of the first magnetic circuit C1 increases, the amount of the magnetic flux Φ can be regulated by the magnetic saturation part 49. Consequently, the amount of the magnetic flux Φ flowing in the second magnetic circuit C2 can be increased, and the second plunger 3*b* can be reliably attracted.

The rest is similar to the thirteenth embodiment. Unless otherwise described, the same reference numerals used in the thirteenth embodiment in the reference numerals used for the drawings related to the embodiment refer to components similar to those of the thirteenth embodiment.

Fifteenth Embodiment

Figure 49:
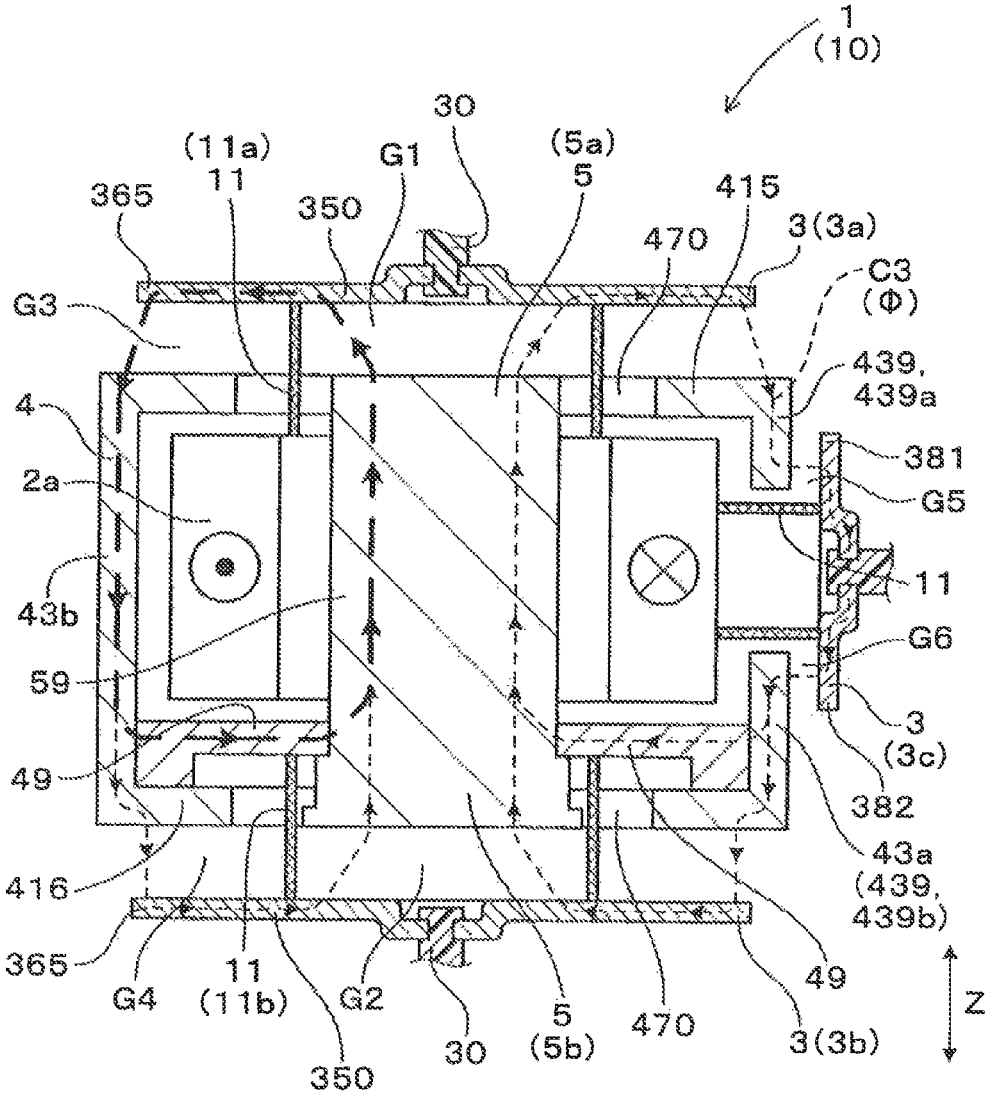
FIG. 49 is a diagram showing a cross section of an electromagnetic relay in a fifteenth embodiment.

In a fifteenth embodiment, the number of plungers 3 is changed. As illustrated in FIG. 49, the solenoid device 1 of the embodiment has three plungers 3 (3*a* to 3*c*). Each of the three plungers 3*a* to 3*c* is formed in a plate shape. In the embodiment, the side-wall yoke 43*a* as one of the two side-wall yokes 43 (43*a* and 43*b*) is used as a third fixed core 439. By the third fixed core 349, the third plunger 3*c* is attracted. The third fixed core 439 is divided into two parts; a first core part 439*a* and a second core part 439*b*. When the third plunger 3*c* moves forward/backward, one end 381 of the third plunger 3*c* comes into contact with/is apart from the first core part 439*a*, and the other end 382 comes into contact with/is apart from the second core part 439*b*.

In the solenoid device 1 of the embodiment, in a manner similar to the fourteenth embodiment, the magnetic flux Φ of the first electromagnetic coil 2*a* flows in the first and second magnetic circuits C1 and C2. In the embodiment, the magnetic flux Φ flows in the magnetic circuits C1 and C2 and, in addition, the third magnetic circuit C3. The third magnetic circuit C3 is made by the pillar-shaped core 59, the contact/separate yoke 415, the first core part 439*a*, the third plunger 3*c*, the second core part 439*b*, and the magnetic saturation part 49. In a state where the third plunger 3*c* is not attracted, a fifth gap G5 is formed between the first core part 439*a* and the third plunger 3*c*, and a sixth gap G6 is formed between the second core part 439*b* and the third plunger 3*c*.

The magnetic flux Φ generated by the passage of current to the first electromagnetic coil 2*a* flows so as to be split to the three magnetic circuits C1, C2, and C3. When the first electromagnetic coil 2*a* is switched from the no-current passage state to the current passage state, the magnetic flux Φ of the first magnetic circuit C1 passes through the first and third gaps G1 and G3. The magnetic flux Φ of the second magnetic circuit C2 passes through the four gaps G1, G3, G2, and G4. The magnetic flux Φ of the third magnetic circuit C3 passes through the four gaps G1, G3, G5, and G6. As described above, the number of gaps G in the first magnetic circuit C1 is smaller than that in the second magnetic circuit C2 or the third magnetic circuit C3, Consequently, the large amount of the magnetic flux Φ flows in the first magnetic circuit C1 and the amount of the magnetic flux Φ flowing in the second and third magnetic circuits C2 and C3 is small. Therefore, the first plunger 3*a* is attracted first.

When the first plunger 3*a* is attracted, the gaps G1 and G3 disappear, the magnetic resistance decreases, and the amount of the magnetic flux Φ flowing in the first magnetic circuit C1 increases. Since the magnetic flux Φ of the first magnetic circuit C1 passes through the magnetic saturation part 49, after the magnetic flux Φ increases, magnetic saturation occurs in the magnetic saturation part 49. Therefore, by the magnetic saturation part 49, the amount of the magnetic flux Φ in the first magnetic circuit C1 is regulated and, instead, the amount of the magnetic flux Φ in the second and third magnetic circuits C2 and C3 increases. As a result, the magnetic force acting on the second and third plungers 3*b* and 3*c* increases, the second plunger 3*b* is attracted by the second fixed core 5*b*, and the third plunger 3*c* is attracted by the side-wall yoke 43*a*.

The operation and effect of the embodiment will be described. With the configuration, the larger number of the plungers 3 can be moved forward/backward. The attraction direction of the first plunger 3*a* and that of the second plunger 3*b* are opposite to each other, and the direction of attracting the third plunger 3*c* is orthogonal to the attraction directions of the first and second plungers 3*a* and 3*b*. Therefore, even if the plungers 3*a* to 3*c* swing due to the vibration from the outside when no current is passed to the first electromagnetic coil 2*a*, the plungers 3*a* to 3*c* do not simultaneously come close to the yoke 4. Consequently, for example, in the case where the electromagnetic relay 10 is constructed by the solenoid device 1, switches (not illustrated) which are turned on/off by the plungers 3 can be prevented from being simultaneously turned on.

The rest is similar to the fourteenth embodiment. Unless otherwise described, the same reference numerals used in the fourteenth embodiment in the reference numerals used for the drawings related to the embodiment refer to components similar to those of the fourteenth embodiment.

Sixteenth Embodiment

Figure 50:
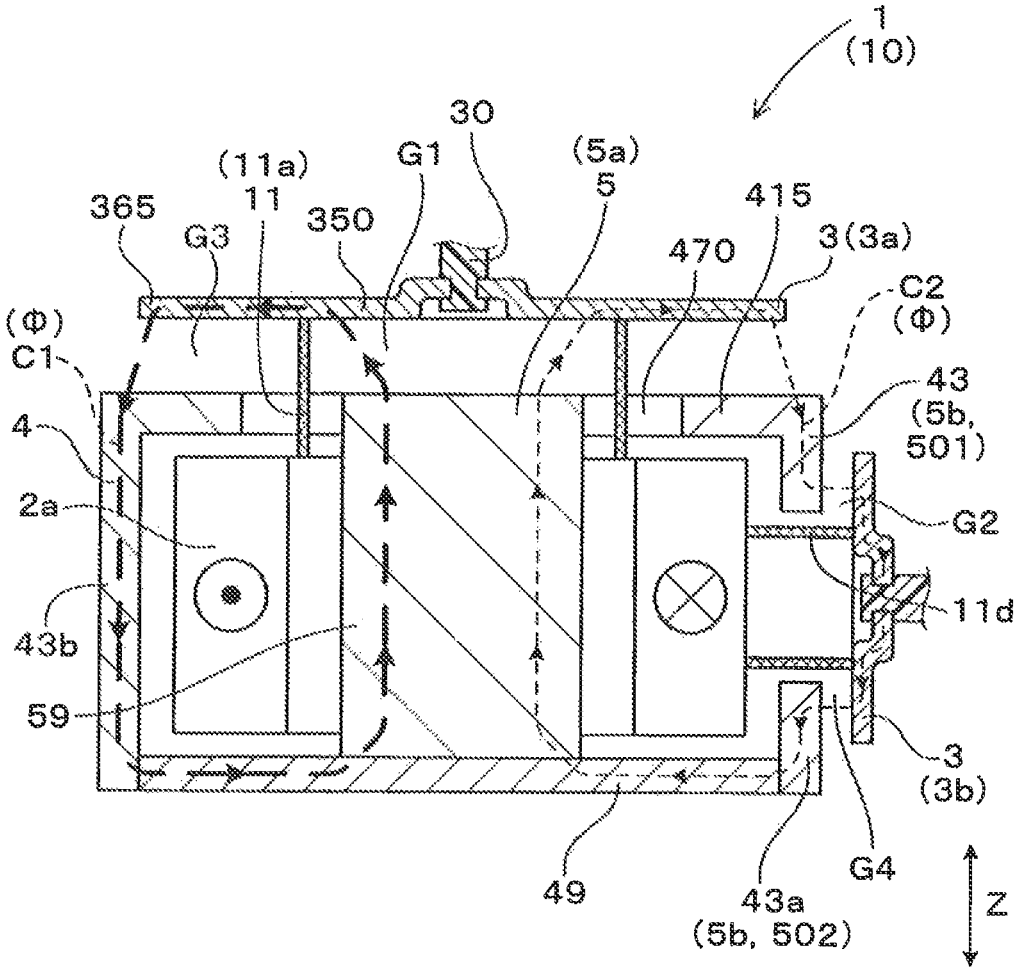
FIG. 50 is a diagram showing a cross section of an electromagnetic relay in a sixteenth embodiment.

In a sixteenth embodiment, the number and positions of plungers 3 are changed. As illustrated in FIG. 50, the solenoid device 1 of the embodiment has two plungers 3 (3*a* and 3*b*) each formed in a plate shape. In a manner similar to the fourteenth embodiment, the pillar-shaped core 59 is provided in the center of the first electromagnetic coil 2*a*. The first fixed core 5*a* is constructed at one end of the pillar-shaped core 59.

The other end of the pillar-shaped core 59 is connected to the magnetic saturation part 49.

In the embodiment, the side-wall yoke 43*a* as one of the two side-wall yokes 43 (43*a* and 43*b*) is used as the second fixed core 5*b*. The second fixed core 5*b* is made by a first core part 501 connected to the contact/separate yoke 415 and a second core part 502 connected to the magnetic saturation part 49. In a state where the second plunger 3*b* is not attracted, the second gap G2 is formed between the first core part 501 and the second plunger 3*b*, and the fourth gap G4 is formed between the second core part 502 and the second plunger 3*b*.

The magnetic flux Φ generated by the passage of current to the first electromagnetic coil 2*a* flows so as to be split to the first and second magnetic circuits C1 and C2. The second magnetic circuit C2 of the embodiment is made by the pillar-shaped core 59, the contact/separate yoke 415, the first core part 501, the second yoke 3*b*, the second core part 502, and the magnetic saturation part 49. When the first electromagnetic coil 2*a* is switched from the no-current passage state to the current passage state, the magnetic flux Φ of the first magnetic circuit C1 passes through the first and third gaps G1 and G3. The magnetic flux Φ of the second magnetic circuit C2 passes through the second and fourth gaps G2 and G4 in addition to the first and third gaps G1 and G3. As described above, the number of gaps G in the first magnetic circuit C1 is smaller than that in the second magnetic circuit C2. Consequently, the large amount of the magnetic flux Φ flows in the first magnetic circuit C1 and the amount of the magnetic flux Φ flowing in the second magnetic circuit C2 is small. Therefore, the first plunger 3*a* is attracted first.

When the first plunger 3*a* is attracted, the first and third gaps G1 and G3 disappear, the magnetic resistance decreases, and the amount of the magnetic flux Φ flowing in the first magnetic circuit C1 increases. Since the magnetic flux Φ of the first magnetic circuit C1 passes through the magnetic saturation part 49, after the magnetic flux Φ increases, magnetic saturation occurs in the magnetic saturation part 49. Therefore, by the magnetic saturation part 49, the amount of the magnetic flux Φ in the first magnetic circuit C1 is regulated and the amount of the magnetic flux Φ in the second magnetic circuit C2 increases. As a result, the magnetic force acting on the second plunger 3*b* increases, and the second plunger 3*b* is attracted by the second fixed core 5*b*.

The operation and effect of the embodiment will be described. In the embodiment, the attraction direction of the first plunger 3*a* and that of the second plunger 3*b* are orthogonal to each other. Therefore, even if the plungers 3*a* and 3*b* swing due to the vibration from the outside when no current is passed to the first electromagnetic coil 2*a*, the two plungers 3*a* and 3*b* do not simultaneously come close to the fixed cores 5 (5*a* and 5*b*), Consequently, in the case where the electromagnetic relay 10 is constructed by the solenoid device 1, switches (not illustrated) which are turned on/off by the plungers 3*a* and 3*b* can be prevented from being turned on simultaneously.

The rest is similar to the fourteenth embodiment. Unless otherwise described, the same reference numerals used in the fourteenth embodiment in the reference numerals used for the drawings related to the embodiment refer to components similar to those of the fourteenth embodiment.

Seventeenth Embodiment

Figure 51:
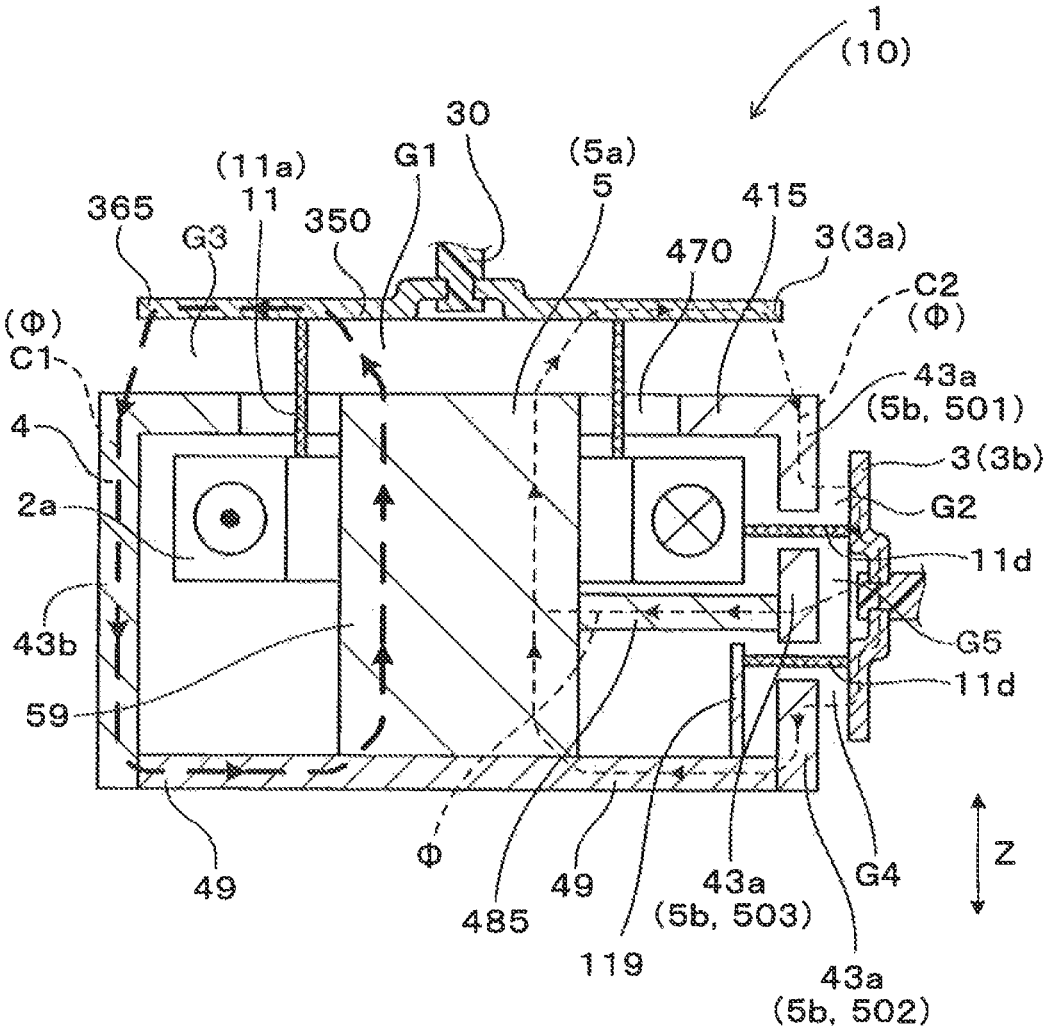
FIG. 51 is a diagram showing a cross section of an electromagnetic relay in a seventeenth embodiment.

In a seventeenth embodiment, the number and positions of plungers 3 are changed. As illustrated in FIG. 51, the solenoid device 1 of the embodiment has two plungers 3 (3*a* and 3*b*) each formed in a plate shape. In the seventeenth embodiment, in a manner similar to the sixteenth embodiment, the side-wall yoke 43*a* as one of the two side-wall yokes 43 (43*a* and 43*b*) is used as the second fixed core 5*b*. The second fixed core 5*b* is made by the first core part 501 connected to the contact/separate yoke 415, the second core part 502 connected to the magnetic saturation part 49, and a third core part 503 disposed between the first and second core parts 501 and 502.

Between the third core part 503 and the pillar-shaped core 59, an auxiliary yoke 485 is provided. The magnetic saturation part 49 is provided with a plate-shaped member 119 made of resin. A part of the plunger-side spring member 11*d* of the second plunger 3*b* is attached to the plate-shaped member 119.

In a state where the second plunger 3*b* is not attracted, the second gap G2 is formed between the second plunger 3*b* and the first core part 501, and the fourth gap G4 is formed between the second plunger 3*b* and the second core part 502. The fifth gap G5 is formed between the second plunger 3*b* and the third core part 503.

The magnetic flux Φ generated by the passage of current to the first electromagnetic coil 2*a* flows so as to be split to the first and second magnetic circuits C1 and C2. The second magnetic circuit C2 of the embodiment is made by the pillar-shaped core 59, the first plunger 3*a*, the contact/separate yoke 415, the first core part 501, the second yoke 3*b*, the second core part 502, and the magnetic saturation part 49. When the first electromagnetic coil 2*a* is switched from the no-current passage state to the current passage state, the magnetic flux Φ of the first magnetic circuit C1 passes through the first and third gaps G1 and G3. The magnetic flux Φ of the second magnetic circuit C2 passes through the second and fourth gaps G2 and G4 in addition to the first and third gaps G1 and G3. As described above, the number of gaps G in the first magnetic circuit C1 is smaller than that in the second magnetic circuit C2. Consequently, the large amount of the magnetic flux Φ flows in the first magnetic circuit C1 and the amount of the magnetic flux Φ flowing in the second magnetic circuit C2 is small. Therefore, the first plunger 3*a* is attracted first.

A part of the magnetic flux Φ flowing in the second magnetic circuit C2 is split in some midpoint, passes through the third core part 503 and the auxiliary yoke 485, and flows in the pillar-shaped core 59.

When the first plunger 3*a* is attracted, the first and third gaps G1 and G3 disappear, the magnetic resistance decreases, and the amount of the magnetic flux Φ flowing in the first magnetic circuit C1 increases. Since the magnetic flux Φ of the first magnetic circuit C1 passes through the magnetic saturation part 49, after the magnetic flux Φ increases, magnetic saturation occurs in the magnetic saturation part 49. Therefore, by the magnetic saturation part 49, the amount of the magnetic flux Φ in the first magnetic circuit C1 is regulated and the amount of the magnetic flux Φ in the second magnetic circuit C2 increases. As a result, the magnetic force acting on the second plunger 3*b* increases, and the second plunger 3*b* is attracted by the second fixed core 5*b*.

The operation and effect of the embodiment will be described. In the embodiment, a part of the plunger-side spring member 11*d* of the second plunger 3*b* can be attached to the plate-shaped member 119, Consequently, as compared with the case of attaching all of the plunger-side spring member 11*d* to the surface (curved face) of the first electromagnetic coil 2*a* as in the sixteenth embodiment (refer to FIG. 50), the plunger-side spring member 11*d* can be attached more easily at the time of manufacture. Therefore, the solenoid device 1 is manufactured more easily.

The rest is similar to the sixteenth embodiment. Unless otherwise described, the same reference numerals used in the sixteenth embodiment in the reference numerals used for the drawings related to the embodiment refer to components similar, to those of the sixteenth embodiment.

While the present disclosure has been described with reference to embodiments thereof, it is to be understood that the disclosure is not limited to the embodiments and constructions. The present disclosure is intended to cover various modification and equivalent arrangements. In addition, while the various combinations and configurations, other combinations and configurations, including more, less or only a single element, are also within the spirit and scope of the present disclosure.

What is claimed is:

1. A solenoid device comprising:

a first electromagnetic coil for generating magnetic flux when current passes through the first electromagnetic coil;

a first plunger and a second plunger, each of which moves backward and forward according to energization to the first electromagnetic coil;

a first fixed core facing the first plunger in a backward-forward movement direction of the first plunger;

a second fixed core facing the second plunger in a backward-forward movement direction of the second plunger; and a yoke, wherein the yoke, the first plunger, the first fixed core, the second plunger, and the second fixed core provide a magnetic circuit, in which the magnetic flux flows, wherein, when the first electromagnetic coil is not energized in a unenergization state, a first gap is formed between the first plunger and the first fixed core, and a second gap is formed between the second plunger and the second fixed core, wherein, when the first electromagnetic coil is energized in a energization state, the magnetic flux flows in a first magnetic circuit, provided by the first plunger, the first fixed core and the yoke, and a second magnetic circuit, provided by the first plunger, the first fixed core, the second plunger, the second fixed core and the yoke, wherein, when the first electromagnetic coil is energized in the energization state, the first plunger is attracted toward the first fixed core by magnetic force, which is generated by a flow of the magnetic flux in the first magnetic circuit, and the second plunger is attracted toward the second fixed core by magnetic force, which is generated by a flow of the magnetic flux in the second magnetic circuit, and wherein, while switching from the unenergization state to the energization state, the magnetic flux flowing in the first magnetic circuit passes through the first gap, and the magnetic flux flowing in the second magnetic circuit passes through the first gap and the second gap.

2. The solenoid device according to claim 1, wherein the yoke includes a magnetic saturation part disposed on the first magnetic circuit, the magnetic saturation part, in which magnetic saturation locally occurs, and wherein the magnetic saturation part regulates an amount of the magnetic flux flowing in the first magnetic circuit.

3. The solenoid device according to claim 1, wherein the first electromagnetic coil has a first coil part and a second coil part, each of which is energized independently, wherein the first coil part is disposed in a position closer to the first fixed core than the second coil part in the backward-forward movement direction of the first plunger, wherein the yoke includes: an intermediate yoke disposed between the first coil part and the second coil part; and a sliding-contact yoke disposed in a position farther from the first fixed core than the intermediate yoke in the backward-forward movement direction of the first plunger, wherein the first plunger and the second plunger slide in contact with the sliding-contact yoke, wherein, when only the first coil part is energized, the first plunger is attracted toward the first fixed core by the magnetic force, which is generated by magnetic flux flowing in the intermediate yoke, the first plunger and the first fixed core, and wherein, when only the second coil part is energized, the first plunger is attracted toward the sliding-contact yoke by magnetic force generated by magnetic flux flowing in the intermediate yoke, the first plunger, and the sliding-contact yoke so that the first plunger is moved apart from the first fixed core.

4. The solenoid device according to claim 3, wherein the first plunger includes a flange having a diameter larger than a body of the first plunger in a radial direction of the first plunger, and wherein, when the first electromagnetic coil is not energized in a unenergization state, a length between the flange and the sliding-contact yoke in the backward-forward movement direction of the first plunger is shorter than a length between the intermediate yoke and the flange.

5. The solenoid device according to claim 1, wherein each of the first plunger and the second plunger has a plate shape, wherein each of the first plunger and the second plunger moves backward and forward in a plate thickness direction of the plate shape, wherein, when each of the first plunger and the second plunger moves backward and forward, each of the first plunger and the second plunger contacts and moves apart from a surface of the yoke.

6. The solenoid device according to claim 5, further comprising:

a pillar-shaped core inserted in a center of the first electromagnetic coil, wherein the first fixed core and the second fixed core are integrated into the pillar-shaped core, wherein the first plunger is disposed on one side of the first electromagnetic coil in an axial direction of the pillar-shaped core, and wherein the second plunger is disposed on the other side of the first electromagnetic coil in the axial direction of the pillar-shaped core.

7. The solenoid device according to claim 5, wherein, when the first electromagnetic coil is not energized in the unenergization state, a third gap is formed between the first plunger and the yoke, and a fourth gap is formed between the second plunger and the yoke, and wherein, while switching from the unenergization state to the energization state, the magnetic flux flowing in the first magnetic circuit passes through the first gap and the third gap, and the magnetic flux flowing in the second magnetic circuit passes through the first gap, the third gap, the fourth gap and the second gap.

8. The solenoid device according to claim 1, further comprising:

a second electromagnetic coil for generating magnetic flux when current passes through the second electromagnetic coil;

a third plunger moving backward and forward according to energization to the second electromagnetic coil; and a third fixed core facing the third plunger in a backward-forward movement direction of the third plunger, wherein, after the first electromagnetic coil is energized in the energization state so that the first plunger is attracted toward the first fixed core, and the second plunger is attracted toward the second fixed core, the second electromagnetic coil is energized so that the third plunger is attracted toward the third fixed core.

9. The solenoid device according to claim 8, wherein, after the first electromagnetic coil is energized in the energization state, the second electromagnetic coil is energized so that the magnetic flux generated by energization to the second electromagnetic coil flows in the second plunger, and wherein, after the second electromagnetic coil is energized, energization to the first electromagnetic coil is terminated so that only attraction of the first plunger is cancelled under a condition that the second plunger and the third plunger are attracted by the magnetic flux of the second electromagnetic coil.

10. The solenoid device according to claim 8, wherein, when the second electromagnetic coil is energized before the first electromagnetic coil is energized, only the third plunger is attracted toward the third fixed core.

11. The solenoid device according to claim 8, wherein the second plunger includes: a body to be attracted toward the second fixed core; a diameter-reduced part projecting from the body to a side opposite to the second fixed core in the backward-forward movement direction of the second plunger; and a diameter-enlarged part disposed on the diameter-reduced part and having a diameter larger than the diameter-reduced part, wherein the body, the diameter-reduced part and the diameter-enlarged part are made of soft magnetic material, wherein the yoke includes a first yoke part and a second yoke part separated apart from the first yoke part, wherein the body slides in contact with the first yoke part, wherein the third plunger slides in contact with the second yoke part, wherein, when the second plunger is attracted toward the second fixed core, the diameter-enlarged part comes close to the second yoke part and a gap between the second plunger and the second yoke part is reduced, and wherein, when the second plunger is not attracted toward the second fixed core, the diameter-enlarged part is disposed apart from the second yoke part and the diameter-reduced part moves close to the second yoke part, so that the gap between the second plunger and the second yoke part becomes wider than a case where the second plunger is attracted toward the second fixed core.

12. The solenoid device according to claim 8, wherein the second plunger includes: a body to be attracted toward the second fixed core; and a diameter-enlarged part having a diameter larger than the body, wherein the body and the diameter-enlarged part are made of soft magnetic material, wherein the yoke includes a first yoke part, a second yoke part, a third yoke part, a fourth yoke part, a fifth yoke part, and a sixth yoke part, wherein the body of the second plunger and the first plunger slide in contact with the first yoke part, wherein the second yoke part is apart from the first yoke part, wherein the third plunger slides in contact with the second yoke part, wherein the third yoke part is connected to the third fixed core, wherein the fourth yoke part is connected to the second fixed core and the first fixed core, wherein the fifth yoke part connects between the first yoke part and the third yoke part, wherein the sixth yoke part connects between the second yoke part and the third yoke part, the solenoid device further comprising:

a notch for suppressing a flow of the magnetic flux between the third yoke part and the fourth yoke part, wherein the notch is disposed between the third yoke part and the fourth yoke part, wherein, when the second plunger is attracted toward the second fixed core, the diameter-enlarged part comes close to the second yoke part so that a shortest distance between the second plunger and the second yoke part is reduced, and wherein, when the second plunger is not attracted toward the second fixed core, the diameter-enlarged part is disposed apart from the second yoke part, and the shortest distance between the second plunger and the second yoke part becomes longer than a case where the second plunger is attracted toward the second fixed core.

13. The solenoid device according to claim 8, wherein a center axis of one of the first plunger, the second plunger and the third plunger turns to a direction, which is different from center axes of other two of the first plunger, the second plunger and the third plunger.

14. The solenoid device according to claim 8, wherein at least one of the first plunger, the second plunger and the third plunger includes a flange, which protrudes from a body of the at least one of the first plunger, the second plunger and the third plunger in a radial direction of the at least one of the first plunger, the second plunger and the third plunger, and wherein the magnetic flux passes through the flange.

* * * * *